US012742611B2

(12) United States Patent
Mayberry et al.

(10) Patent No.: US 12,742,611 B2
(45) Date of Patent: Sep. 22, 2026

(54) FIREARM ACCESSORY MOUNTING INTERFACE

(71) Applicant: Magpul Industries Corp., Austin, TX (US)

(72) Inventors: Michael T. Mayberry, Denver, CO (US); William Bradley Bennett, Lafayette, CO (US); Timothy Eric Roberts, Broomfield, CO (US); Duane Liptak, Wimberly, TX (US); Brian L. Nakayama, Arvada, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/775,633

(22) Filed: Jul. 17, 2024

(65) Prior Publication Data

US 2024/0401908 A1 Dec. 5, 2024

Related U.S. Application Data

(63) Continuation of application No. 17/993,219, filed on Nov. 23, 2022, now Pat. No. 12,066,272, which is a (Continued)

(51) Int. Cl.
*F41C 27/00* (2006.01)
*F41A 23/08* (2006.01)

(Continued)

(52) U.S. Cl.
CPC ..... *F41C 27/00* (2013.01); *F41A 23/08* (2013.01); *F41C 23/16* (2013.01); *F41G 1/00* (2013.01);

(Continued)

(58) Field of Classification Search
CPC ..... F41C 27/00; F41C 23/16; F41C 23/02; F41A 23/08; F41G 1/00; F41G 11/001; F41G 11/003; F41G 11/004; F41G 11/005
See application file for complete search history.

(56) References Cited

U.S. PATENT DOCUMENTS 317,448 A 5/1885 Evans
632,457 A 9/1899 Gardiner (Continued)

FOREIGN PATENT DOCUMENTS

CA 2512872 A1 8/2004
DE 4244396 A1 6/1994

(Continued)

OTHER PUBLICATIONS

Adafruit Industries, "New Products Jan. 26, 2013", Website located at https://www.youtube.com/watch?v=E6n2Mkr2P8o, Jan. 29, 2013, pp. 2.

(Continued)

*Primary Examiner* — Joshua E Freeman
(74) *Attorney, Agent, or Firm* — NOD Law PC

(57) ABSTRACT

An accessory mounting interface for a firearm, and a related method, are disclosed. The interface has a firearm accessory, a first elongated fastener, and a second fastener rotationally mated to the first elongated fastener. The first elongated fastener has right-handed threading and is arranged through a through hole in the firearm accessory with a first end extending below first and second halves of a first slot protrusion of the firearm accessory. The second fastener has a length greater than a width, the length measured along a longitudinal axis of the second fastener, the second fastener having a plurality of straight edges. At least one of the plurality of straight edges prevents the second fastener from rotating further than a closed position when the at least one (Continued)

of the straight edges abuts a sidewall of an elongated slot in the firearm.

20 Claims, 58 Drawing Sheets

Related U.S. Application Data continuation of application No. 17/225,237, filed on Apr. 8, 2021, now Pat. No. 11,536,535, which is a continuation of application No. 16/690,872, filed on Nov. 21, 2019, now Pat. No. 11,002,509, which is a continuation of application No. 15/926,780, filed on Mar. 20, 2018, now Pat. No. 10,520,279, which is a continuation of application No. 15/357,216, filed on Nov. 21, 2016, now Pat. No. 9,976,832, which is a continuation of application No. 14/964,859, filed on Dec. 10, 2015, now Pat. No. 9,523,554, which is a continuation of application No. 14/658,171, filed on Mar. 14, 2015, now Pat. No. 9,239,210, which is a continuation-in-part of application No. 14/555,615, filed on Nov. 27, 2014, now Pat. No. 9,239,209, which is a continuation-in-part of application No. 14/271,912, filed on May 7, 2014, now Pat. No. 8,925,236.

(60) Provisional application No. 61/974,968, filed on Apr. 3, 2014.

(51) Int. Cl.

| | |
|---|---|
| ***F41C 23/16*** | (2006.01) |
| ***F41G 1/00*** | (2006.01) |
| ***F41G 11/00*** | (2006.01) |
| *F41C 23/02* | (2006.01) |

(52) U.S. Cl.

CPC ..... *F41G 11/001* (2013.01); *F41G 11/003* (2013.01); *F41G 11/004* (2013.01); *F41G 11/005* (2013.01); *F41C 23/02* (2013.01)

(56) References Cited

U.S. PATENT DOCUMENTS

| | | | |
|---|---|---|---|
| 1,099,996 | A | 6/1914 | Parsons |
| 1,219,881 | A | 3/1917 | Gideon |
| 1,316,640 | A | 9/1919 | Farsons |
| 1,748,006 | A | 2/1930 | Wohlart |
| 1,820,667 | A | 8/1931 | Leyes |
| 1,964,427 | A | 6/1934 | Chandler |
| 1,993,749 | A | 3/1935 | Pleister |
| 2,078,010 | A | 4/1937 | Meepos |
| 2,102,964 | A | 12/1937 | Mossberg |
| 2,116,618 | A | 5/1938 | Crockett |
| 2,187,054 | A | 1/1940 | Redfield |
| D143,086 | S | 12/1945 | Lowdermilk |
| 2,455,438 | A | 12/1948 | Oppold |
| 2,480,662 | A | 8/1949 | Mckinzie |
| 2,642,689 | A | 6/1953 | Cline |
| 2,771,699 | A | 11/1956 | Herter |
| 2,782,545 | A | 2/1957 | Schadeck |
| 3,078,899 | A | 2/1963 | Maclean et al. |
| 3,104,136 | A | 9/1963 | Merriman |
| 3,204,284 | A | 9/1965 | Merriman |
| 3,226,872 | A | 1/1966 | Pachmayr |
| 3,265,416 | A | 8/1966 | Downes |
| 3,273,444 | A | 9/1966 | Houvener et al. |
| D209,171 | S | 11/1967 | Myatt et al. |
| 3,463,045 | A | 8/1969 | Prescott |
| 3,493,025 | A | 2/1970 | Carl et al. |
| 3,798,818 | A | 3/1974 | Casull |
| 3,799,027 | A | 3/1974 | Galloway |
| 3,844,194 | A | 10/1974 | Reinwall |
| 3,880,389 | A | 4/1975 | Burris |
| 3,895,408 | A | 7/1975 | Leingang |
| D243,580 | S | 3/1977 | DeCaro |
| 4,205,473 | A | 6/1980 | Wilson |
| D255,772 | S | 7/1980 | Johnson et al. |
| 4,353,180 | A | 10/1982 | Wilson |
| 4,464,076 | A | 8/1984 | Leibhard |
| 4,488,844 | A | 12/1984 | Baubles |
| 4,502,238 | A | 3/1985 | Farrar et al. |
| 4,542,606 | A | 9/1985 | Hoenig |
| 4,545,697 | A | 10/1985 | Verdenne et al. |
| 4,571,872 | A | 2/1986 | Johnson |
| 4,575,295 | A | 3/1986 | Rebentisch |
| 4,602,450 | A | 7/1986 | Hoenig |
| 4,605,350 | A | 8/1986 | Chater et al. |
| 4,656,689 | A | 4/1987 | Dennis |
| 4,830,531 | A | 5/1989 | Condit et al. |
| D302,109 | S | 7/1989 | Cayce et al. |
| 4,859,118 | A | 8/1989 | Schaeffer |
| 4,959,908 | A | 10/1990 | Weyrauch |
| 5,020,952 | A | 6/1991 | Zeigler et al. |
| 5,048,215 | A | 9/1991 | Davis |
| 5,069,586 | A | 12/1991 | Casey |
| 5,076,748 | A | 12/1991 | Waterfield et al. |
| 5,199,836 | A | 4/1993 | Gogarty |
| 5,352,066 | A | 10/1994 | Schaeffer et al. |
| 5,375,361 | A | 12/1994 | Rustick |
| D367,002 | S | 2/1996 | Grey |
| 5,603,594 | A | 2/1997 | Lincoln |
| 5,813,158 | A | 9/1998 | Campbell et al. |
| D415,533 | S | 10/1999 | Shost, Jr. et al. |
| 6,086,300 | A | 7/2000 | Froehlich |
| 6,294,734 | B1 | 9/2001 | Daoud |
| 6,305,888 | B1 | 10/2001 | Leistner |
| D452,140 | S | 12/2001 | Shinjo et al. |
| 6,328,513 | B1 | 12/2001 | Niwa et al. |
| 6,331,092 | B1 | 12/2001 | Linger |
| D452,644 | S | 1/2002 | Morita |
| D457,054 | S | 5/2002 | Pamer et al. |
| 6,712,540 | B2 | 3/2004 | Schmalzhofer et al. |
| 6,712,543 | B1 | 3/2004 | Schmalzhofer |
| 6,733,221 | B2 | 5/2004 | Linger |
| 6,764,109 | B2 | 7/2004 | Gary et al. |
| 6,767,020 | B2 | 7/2004 | Yamamoto et al. |
| D499,010 | S | 11/2004 | Velten |
| D512,302 | S | 12/2005 | Velten |
| 7,004,667 | B2 | 2/2006 | Ludwig et al. |
| 7,036,261 | B2 | 5/2006 | Murello |
| 7,096,620 | B2 | 8/2006 | Zeh |
| 7,189,163 | B2 | 3/2007 | Nagayama |
| 7,191,557 | B2 | 3/2007 | Gablowski et al. |
| 7,322,141 | B1 | 1/2008 | Leung |
| 7,430,829 | B2 | 10/2008 | Murello |
| D604,793 | S | 11/2009 | Fitzpatrick et al. |
| 7,654,027 | B1 | 2/2010 | Grover |
| 7,716,865 | B2 | 5/2010 | Daniel et al. |
| 7,731,464 | B2 | 6/2010 | Nagayama |
| 7,765,731 | B1 | 8/2010 | Liebig |
| 7,770,317 | B1 | 8/2010 | Tankersley |
| 7,793,968 | B1 | 9/2010 | Withers |
| 7,802,392 | B2 | 9/2010 | Peterson et al. |
| 7,802,395 | B1 | 9/2010 | Swan |
| 7,802,953 | B2 | 9/2010 | Stephen |
| 7,814,698 | B2 | 10/2010 | Fluhr et al. |
| 7,823,319 | B2 | 11/2010 | Casas |
| 7,836,625 | B2 | 11/2010 | Swan et al. |
| 7,913,957 | B2 | 3/2011 | Nelson et al. |
| D637,896 | S | 5/2011 | Dotsey |
| 7,954,268 | B2 | 6/2011 | Bentley |
| D642,652 | S | 8/2011 | Juarez et al. |
| D660,140 | S | 5/2012 | Pawluk |
| 8,201,353 | B1 | 6/2012 | Swan |
| 8,215,047 | B2 | 7/2012 | Ash, Jr. et al. |
| 8,245,428 | B2 | 8/2012 | Griffin |
| 8,282,318 | B2 | 10/2012 | Robertson, Jr. |
| 8,393,104 | B1 | 3/2013 | Moody et al. |
| D679,580 | S | 4/2013 | Fitzpatrick et al. |
| 8,429,843 | B2 | 4/2013 | Yan |

(56) References Cited

U.S. PATENT DOCUMENTS

| | | | | |
|---|---|---|---|---|
| 8,453,402 | B2 | 6/2013 | Huang | |
| 8,500,358 | B1 | 8/2013 | Cassidy | |
| 8,516,732 | B2 | 8/2013 | Burnsed, Jr. | |
| 8,522,467 | B1 | 9/2013 | Christensen et al. | |
| 8,544,153 | B2 | 10/2013 | Mayberry et al. | |
| 8,596,701 | B2 | 12/2013 | Alba | |
| 8,607,490 | B1 | 12/2013 | Zinsner | |
| 8,656,622 | B2 | 2/2014 | Peterson et al. | |
| 8,657,547 | B2 | 2/2014 | Herndon et al. | |
| 8,739,448 | B2 | 6/2014 | Kimmel et al. | |
| 8,752,320 | B2 | 6/2014 | Masters | |
| 8,819,980 | B2 | 9/2014 | Geissele | |
| 8,821,061 | B2 | 9/2014 | Baus | |
| 8,832,985 | B2 | 9/2014 | Smith | |
| 8,832,986 | B2 | 9/2014 | Mayberry et al. | |
| 8,839,544 | B2 | 9/2014 | Troy et al. | |
| 8,925,236 | B1 | 1/2015 | Mayberry et al. | |
| 8,931,137 | B2 | 1/2015 | Daniel et al. | |
| 9,010,008 | B2 | 4/2015 | Hovey | |
| 9,103,365 | B2 | 8/2015 | Whipple et al. | |
| D737,674 | S | 9/2015 | Tobaruela | |
| 9,127,906 | B2 | 9/2015 | Wells et al. | |
| 9,157,696 | B2 | 10/2015 | Dextraze | |
| 9,239,209 | B2 | 1/2016 | Mayberry et al. | |
| 9,239,210 | B2 | 1/2016 | Mayberry et al. | |
| 9,267,753 | B2 | 2/2016 | Dextraze et al. | |
| D751,661 | S | 3/2016 | Gibbens et al. | |
| 9,429,388 | B2 | 8/2016 | Mayberry et al. | |
| 9,523,554 | B2 | 12/2016 | Mayberry et al. | |
| 9,709,358 | B2 | 7/2017 | Kincel et al. | |
| 9,777,985 | B2 | 10/2017 | Roberts et al. | |
| 9,885,376 | B1 | 2/2018 | Meyer et al. | |
| 9,921,029 | B2 | 3/2018 | Roberts et al. | |
| 9,964,380 | B1 | 5/2018 | Oglesby | |
| 9,976,832 | B2 | 5/2018 | Mayberry et al. | |
| 10,101,126 | B2 | 10/2018 | Sharron et al. | |
| 10,371,482 | B2 | 8/2019 | Roberts et al. | |
| 10,520,279 | B2 | 12/2019 | Mayberry et al. | |
| 11,002,509 | B2 | 5/2021 | Mayberry et al. | |
| 11,536,535 | B2 | 12/2022 | Mayberry et al. | |
| 12,066,272 | B2 | 8/2024 | Mayberry et al. | |
| 2004/0009034 | A1* | 1/2004 | Miller | F41G 11/003 403/363 |
| 2004/0064994 | A1 | 4/2004 | Luke | |
| 2005/0019225 | A1 | 1/2005 | Sanadi | |
| 2005/0183380 | A1 | 8/2005 | Sato | |
| 2005/0276677 | A1 | 12/2005 | Andersson et al. | |
| 2006/0238307 | A1 | 10/2006 | Bauer et al. | |
| 2006/0283070 | A1 | 12/2006 | Murello | |
| 2007/0234623 | A1 | 10/2007 | Carney | |
| 2008/0301994 | A1 | 12/2008 | Langevin et al. | |
| 2010/0038607 | A1 | 2/2010 | Nagayama | |
| 2010/0303538 | A1 | 12/2010 | Kor et al. | |
| 2011/0000146 | A1 | 1/2011 | Takeda et al. | |
| 2012/0097807 | A1 | 4/2012 | Rees | |
| 2012/0167434 | A1* | 7/2012 | Masters | F41G 11/003 42/90 |
| 2012/0297970 | A1* | 11/2012 | Langevin | F41A 3/66 42/14 |
| 2013/0074394 | A1 | 3/2013 | Larue | |
| 2013/0177366 | A1 | 7/2013 | Whipple et al. | |
| 2013/0276341 | A1 | 10/2013 | Wells et al. | |
| 2013/0326925 | A1 | 12/2013 | Power | |
| 2014/0041273 | A1 | 2/2014 | Masters | |
| 2014/0059908 | A1 | 3/2014 | Dextraze et al. | |
| 2014/0116057 | A1 | 5/2014 | Peters et al. | |
| 2014/0130390 | A1* | 5/2014 | Geissele | F41C 23/16 42/71.01 |
| 2014/0325889 | A1 | 11/2014 | Michal et al. | |
| 2015/0007476 | A1* | 1/2015 | Dextraze | F41C 23/16 42/71.01 |
| 2015/0020427 | A1 | 1/2015 | Compton et al. | |
| 2015/0135576 | A1 | 5/2015 | Wells et al. | |
| 2015/0184976 | A1 | 7/2015 | Kuczynko | |
| 2015/0285289 | A1 | 10/2015 | Burton et al. | |
| 2015/0285583 | A1 | 10/2015 | Mayberry et al. | |
| 2015/0285584 | A1 | 10/2015 | Mayberry et al. | |
| 2015/0323284 | A1 | 11/2015 | Larson, Jr. | |
| 2016/0010946 | A1 | 1/2016 | Gibbens et al. | |
| 2016/0091277 | A1 | 3/2016 | Mayberry et al. | |
| 2016/0187100 | A1 | 6/2016 | Mayberry et al. | |
| 2016/0209175 | A1 | 7/2016 | Sharron et al. | |
| 2016/0245616 | A1 | 8/2016 | Derousse | |
| 2017/0067718 | A1 | 3/2017 | Mayberry et al. | |
| 2017/0082395 | A1 | 3/2017 | Roberts et al. | |
| 2017/0138693 | A1 | 5/2017 | Roberts et al. | |
| 2018/0112952 | A1 | 4/2018 | Kincel et al. | |
| 2018/0202761 | A1 | 7/2018 | Roberts et al. | |
| 2018/0328693 | A1 | 11/2018 | Mayberry et al. | |
| 2020/0263952 | A1 | 8/2020 | Mayberry et al. | |
| 2021/0302123 | A1 | 9/2021 | Mayberry et al. | |
| 2023/0109948 | A1 | 4/2023 | Mayberry et al. | |

FOREIGN PATENT DOCUMENTS

| | | | |
|---|---|---|---|
| DE | 19829791 | C1 | 11/1999 |
| DE | 20217838 | U1 | 12/2003 |
| DE | 102006011569 | A1 | 9/2007 |
| EP | 0441224 | A1 | 8/1991 |
| EP | 0478928 | A2 | 4/1992 |
| EP | 0601824 | A1 | 6/1994 |
| EP | 1500827 | A1 | 1/2005 |
| EP | 3557179 | A2 | 10/2019 |
| GB | 2501013 | A | 10/2013 |

OTHER PUBLICATIONS

Aircraft Spruce & Specialty Co., "Camloc", webpage found at http://www.aircraftspruce.com/menus/ha/fast_1camloc.html downloaded on Sep. 26, 2014, pp. 2.

Applicant Initiated Interview Summary received for U.S. Appl. No. 14/658,171 dated Sep. 29, 2015, 6 pages.

Applicant Initiated Interview Summary received for U.S. Appl. No. 15/357,216 dated Oct. 16, 2017, 4 pages.

AR15, "Introducing the New ARC LOK Mounting System", Known to exist as early as Apr. 22, 2014, pp. 6, Publisher: Website located at http://www.AR15.com/forums/t_2_611/248819_Introducing_the_new_ARC_LOK_mounting_system_.html.

AR15, "Introducing the New ARC LOK Mounting System", Webpage found at http //www AR15 com/forums/t_2_611/248819_IntroducingthenewARC_LOK_mountingsystem_html downloaded on Mar. 6, 2015, pp. 6.

AR15.com, "Magpul M93 QD Plate", Retrieved from http://www.ar15.com/archive/topic.html?b=3&f=12&t=242264, Known to exist as early as Dec. 5, 2013, 19 pages.

AR15.com, "Magpul's PR5 G3", Retrieved from http://www.ar15.com/archive/topic.html?b=6&f=9&t=213719, Known to exist as early as Dec. 5, 2013, 1 page.

Armedcitizen76, "Loose AR15 Upper and Lower Fix—Demon Tactical Quick Pin", Retrieved from http://www.youtube.com/watch?v=l75YCnj3FTE, Known to exist as early as Aug. 18, 2013, 3 pages.

Berger Tools Ltd, "GN505 T Nuts, Steel, for Aluminum Extrusion", Website localed at https://www.berger-tools.co.uk/Gn505_T_Nut_Steel_For_Aluminum_Extrusion/, Known to exist as early as Feb. 11, 2016, pp. 5.

Bicylcedesigner.com, "Stem for Threaded Headset", Retrieved from https://www.bicycledesigner.com/bike-parts/bicycle-stem/stem-for-threaded-headset-1.html, Known to exist as early as Dec. 5, 2013, 4 pages.

Demon Tactical, "Demon Tactical Quick Pin", Retrieved from http://demontactical.com/demon-tactical-quickp-57648.html, Known to exist as early as Dec. 5, 2013, 1 page.

Elzetta, "Configure Your Own Mini-CQB Weapon Light", Known to exist as early as Apr. 7, 2015, pp. 2, Publisher: Website located at http://www.elzetta.com/configure-your-own-mini-weapon-light.html.

Elzetta, "Configure Your Own Mini-CQB Weapon Light", Known to exist as early as Apr. 7, 2014, pp. 2, Publisher: Website located at http://www.elzetta.com/configure-your-own-mini-weapon-light.html.

(56) References Cited

OTHER PUBLICATIONS

Elzetta, "Pre-Order Configure Your Own Mini-CQB Weapon Light", Webpage found at http://www.elzetta.com/pre-order-configure-your-own-mini-cqb-weapon-light.html/Inventor(s) aware of prior art on or before Apr. 7, 2015, pp. 2, Published in US.
Ex Parte Quayle Action received for U.S. Appl. No. 15/063, 396 dated Apr. 29, 2016, 12 pages.
Fastenal, "M6 9.7mm x 19mm Zinc Slot 10 Drop-In T-Nut", Website located at https://www.fastenal.com/products/details/0961750, known to exist as early as Feb. 11, 2016, pp. 4.
Final Office Action received for U.S. Appl. No. 14/555,615 dated Aug. 12, 2015, 9 pages.
Final Office Action received for U.S. Appl. No. 16/690,872 dated Sep. 29, 2020, 33 pages.
GIBBZ ARMS, "GIBBZ ARMS G4 Upper Reciever", KTEAEA Aug. 31, 2015, pp. 8.
GIBBZ ARMS, "Innovation in Firearms,", First Known to Applicant Aug. 31, 2015, 8 pages.
Global Industrial "80/20 ® 3932 Drop-In T-Nuts", "Retrieved from http://www.globalindustrial.com/p/building-materials/struts-and-framing/8020/3932-dropin-tnuts?infoParam.campaignId=T9F&gclid=CKiwqoe-_cACFSMLMgodkBUA5A&gclsrc=aw.ds", Known to exist as early as Sep. 26, 2014, 2 pages.
Gruber, Stephen S, "Response to Office Action re U.S. Appl. No. 14/555,615", Mar. 10, 2015, pp. 8, Published in US.
Gruber, Stephen S., "Response to Office Action re U.S. Appl. No. 15/063,396", May 11, 2016, pp. 7, Published in: US.
Gruber, Stephen, "Response to Office Action re Application No. 153572116", Nov. 27, 2017, pp. 12, Published in: US.
Gruber, Stephen, "Response to Office Action Regarding U.S. Appl. No. 15/926,780", Jul. 19, 2019, pp. 9, Published in: US.
Gruber, Stephen, "Response to Office Action Regarding U.S. Appl. No. 15/926,780", Sep. 11, 2019, pp. 9, Published in: US.
Gruber, Stephen, "Response to Office Action Regarding U.S. Appl. No. 16/690,872", Jun. 4, 2020, pp. 10, Published in: US.
Gruber, Stephen, "Response to Office Action Regarding U.S. Appl. No. 16/690,872", Nov. 30, 2020, pp. 10, Published in: US.
Impact Weapons Components, "OCP Sling Mount-N-Slot—Magpul Industries Corp. MS2 & MS3 Slings", Website located at http://www.impactweaponscomponents.com/product/ocp-sling-mount-n-slol-designed-for-magpul-Industries-wrp-ms2-ms3-slings/, Known to exist as early as Jul. 1, 2011, pp. 3.
Impact Weapons Components, "QD Rotation Limited Sling Mount-N-Slot", Website located at http://www.impactweaponscomponents.com/product/rotation-limited-quick-detach-sling/, Known to exist as early as Sep. 14, 2011, pp. 5.
Impact Weapons Components, "Reversible Barrier Weapon Control Hand Stop—Magpul MOE ALL", Website located at http://www.impactweaponscomponents.com/product/barrier-weapon-control-handstop-moe-all-and-m-lok/, known to exist as early as Jul. 20, 2015, pp. 2.
Johnson, Stephen, "Final Office Action Regarding U.S. Appl. No. 15/926,780", Aug. 16, 2019, pp. 12, Published in: US.
Johnson, Stephen, "Office Action re U.S. Appl. No. 14/555,615", Jan. 14, 2015, pp. 7, Published in US.
Johnson, Stephen, "Office Action re U.S. Appl. No. 14/555,615", Mar. 20, 2015, pp. 39, Published in US.
Johnson, Stephen, "Office Action re U.S. Appl. No. 14/555,615", Aug. 12, 2015, pp. 9, Published in: US.
Johnson, Stephen, "Office Action re U.S. Appl. No. 14/658,171", Aug. 20, 2015, pp. 9, Published in: US.
Johnson, Stephen, "Office Action re U.S. Appl. No. 15/063,396", Apr. 29, 2016, pp. 11, Published in: US.
Johnson, Stephen, "Office Action U.S. Appl. No. 15/357,216", Oct. 5, 2017, pp. 41, Published in: US.
Johnson, Stephen, "Office Action U.S. Appl. No. 15/926,780", Apr. 25, 2019, pp. 48, Published in: US.
Johnson, Stephen, "Office Action U.S. Appl. No. 16/690,872", Sep. 29, 2020, pp. 33, Published in: US.
Lanner Tactical, "Lantac Kam, Keyed Accessory Mount System", Website located at https://www.youtube.com/watch?v=gHZ23qo8a0c, Mar. 16, 2015, pp. 2.
Magpul Industries, Corp., "Forward Sling Mount", Retrieved from https://www.magpul.com/products.forwardling-mount-1, Known to exist as early as Mar. 26, 2015, 4 pages.
Magpul, "MSA®—MOE® Sling Attachment", Retrieved from https://magpul.com/products/msa-moe-sling-attachment, Known to exist as early as Oct. 2001, 4 pages.
Manticore Arms, Inc., "ARCLight ARC Lok Aluminum Rail Segments", Publisher: Website located at http://www.manticorearms.com/ARC-LOK-aluminum-rail-segments-MA-5470.htm, Known to exist as early as Apr. 22, 2014, pp. 1, Published in: US.
Manticore Arms, Inc., "ARCLight ARC Lok Aluminum Rail Segments", Publisher: Website located at http://www.manticorearms.com/ARC-LOK-aluminum-rail-segments-MA-5470.htm downloaded on Mar. 19, 2015, Known to exist as early as Mar. 19, 2015, pp. 1, published in: US.
McMaster-Carr, "Quick-Access Captive Panel Screws", KTEAEA Sep. 26, 2014, pp. 2, Publisher: Website located at http://www.mcmaster.com/?error_redirect=true#quarter-turn-fasteners/=10n0src.
McMaster-Carr, "Quick-Access Captive Panel Screws", Webpage found at http //www mcmaster com/?errorredirect=true#quarter-turn-fasteners/=tw6p2t, pp. 4.
McMaster-Carr, "Strut Channel", Webpage found at http:/lwww.mcmaster.com/?error_redirect=true#strut-channelsystem/=tw6og7 downloaded on Sep. 26, 2014, pp. 7.
Non Final Office Action received for U.S. Appl. No. 14/271,912 dated Aug. 18, 2014, 33 pages.
Non Final Office Action received for U.S. Appl. No. 14/555,615 dated Mar. 20, 2015, 32 pages.
Non Final Office Action received for U.S. Appl. No. 14/658,171 dated Apr. 15, 2015, 21 pages.
Non Final Office Action received for U.S. Appl. No. 14/860,191 dated Feb. 1, 2018, 16 pages.
Non Final Office Action received for U.S. Appl. No. 15/284,249 dated Oct. 5, 2017, 33 pages.
Non Final Office Action received for U.S. Appl. No. 15/357,216 dated Oct. 5, 2017, 12 pages.
Non Final Office Action received for U.S. Appl. No. 15/919,623 dated Dec. 19, 2018, 13 pages.
Non Final Office Action received for U.S. Appl. No. 15/926,780 dated Apr. 25, 2019, 53 pages.
Non Final Office Action received for U.S. Appl. No. 16/690,872 dated Mar. 9, 2020, 44 pages.
Non Final Office Action received for U.S. Appl. No. 17/225,237 dated Mar. 17, 2022, 43 pages.
Notice of Allowance received for U.S. Appl. No. 14/271,912 dated Nov. 5, 2014, 25 pages.
Notice of Allowance received for U.S. Appl. No. 14/555,615 dated Nov. 27, 2015, 47 pages.
Notice of Allowance received for U.S. Appl. No. 14/658,171 dated Dec. 7, 2015, 42 pages.
Notice of Allowance received for U.S. Appl. No. 14/964,859 dated Aug. 12, 2016, 71 pages.
Notice of Allowance received for U.S. Appl. No. 15/063,396 dated Jun. 7, 2016, 41 pages.
Notice of Allowance received for U.S. Appl. No. 15/284,249 dated Dec. 22, 2017, 14 pages.
Notice of Allowance received for U.S. Appl. No. 15/357,216 dated Dec. 26, 2017, 15 pages.
Notice of Allowance received for U.S. Appl. No. 15/357,216 dated Mar. 16, 2018, 13 pages.
Notice of Allowance received for U.S. Appl. No. 15/357,216 dated Mar. 29, 2018, 6 pages.
Notice of Allowance received for U.S. Appl. No. 15/919,623 dated Apr. 10, 2019, 53 pages.
Notice of Allowance received for U.S. Appl. No. 14/964,859 dated Oct. 3, 2019, 16 pages.
Notice of Allowance received for U.S. Appl. No. 16/690,872 dated Feb. 2, 2021, 15 pages.

(56) References Cited

OTHER PUBLICATIONS

Notice of Allowance received for U.S. Appl. No. 16/690,872 dated Mar. 10, 2021, 9 pages.
Notice of Allowance received for U.S. Appl. No. 17/225,237 dated Sep. 21, 2022, 20 pages.
Noveske, "Noveske QD End Plate", Known to exist as early as Dec. 5, 2013, 2 pages.
Proto-PIC, "Aluminum Extrusion Slim T-Nut for 20x20 M4 Thread", Website localed at https://proto-pic.co.uk/aluminium-extrusion-slim-t-nut-for-20x20-m4-thread-pack-0f-50/, Known to exist as early as Feb. 11, 2016, pp. 9.
Response filed on Jul. 14, 2015 for Non-Final Office Action for U.S. Appl. No. 14/658,171 Mail received dated Apr. 15, 2015, 11 pages.
Response filed on Jul. 24, 2015 for Non-Final Office Action for U.S. Appl. No. 15/926,780 Mail received dated Apr. 25, 2015, 9 pages.
Response filed on Jun. 5, 2020 for Non-Final Office Action for U.S. Appl. No. 16/690,872 Mail received dated Mar. 23, 2020, 10 pages.
Response filed on Jun. 18, 2015 for Non-Final Office Action for U.S. Appl. No. 14/555,615 Mail received dated Mar. 20, 2015, 12 pages.
Response filed on Mar. 10, 2015 for Requirement for Restriction of U.S. Appl. No. 14/555,615 Mail received dated Jan. 14, 2015, 8 pages.
Response filed on May 12, 2016 for Ex Parte Quayle Action of U.S. Appl. No. 15/063,396 Mail received dated Apr. 29, 2016, 7 pages.
Response filed on Nov. 12, 2015 for Final Office Action of U.S. Appl. No. 14/658,171 Mail received dated Aug. 20, 2015, 14 pages.
Response filed on Nov. 28, 2017 for Non-Final Office Action of U.S. Appl. No. 15/357,216 Mail received dated Oct. 5, 2017, 12 pages.
Response filed on Nov. 30, 2020 for Final Office Action of U.S. Appl. No. 16/690,872 Mail received dated Sep. 29, 2020, 10 pages.
Response filed on Sep. 11, 2019 for Final Office Action of U.S. Appl. No. 15/926,780 Mail received dated Aug. 16, 2019, 8 pages.
Response filed on Sep. 18, 2014 for Non-Final Office Action of U.S. Appl. No. 14/271,912 Mail received dated Aug. 18, 2014, 9 pages.
Response filed on Sep. 30, 2015 for Final Office Action of U.S. Appl. No. 14/555,615 Mail received dated Aug. 12, 2015, 10 pages.
Restricted Requirement received for U.S. Appl. No. 14/555,615 dated Jan. 14, 2015, 7 pages.
Schneider, Laura A., "Response to Office Action U.S. Appl. No. 14/555,615", Jun. 18, 2015, pp. 12, Published in: US.
Schneider, Laura A., "Response to Office Action U.S. Appl. No. 14/555,615", Sep. 28, 2015, pp. 10, Published in: US.
Schneider, Laura A., "Response to Office Action U.S. Appl. No. 14/658,171", Jul. 14, 2015, pp. 11, Published in: US.
Schneider, Laura A., "Response to Office Action U.S. Appl. No. 14/658,171", Sep. 28, 2015, pp. 13, Published in: US.
Schneider, Laura, "Response to Office Action U.S. Appl. No. 14/658,171", Nov. 12, 2015, pp. 14, Published in: US.
Shengzhou Baotian Metalwork Co.LTD, "T Nuts 316.ss", Website localed at http://www.globalsources.com/si/AS/Shengzhou-Baotian/6008831781474/pdtt/T-Nut-316.ss/1083595328.htm, Known to exist as early as Feb. 11, 2016, pp. 4.
Southco, "DZUS Push-To-Close, Turn-To-Open Quarter Fasteners", Webpage found at http //www southco com downloaded on Sep. 26, 2014, pp. 2.
Youtube, "Elzetta Mini CQB & ZKL Bow Mount", Webpage found at https://www.youtube.com/watch?v=dEb7OIT_2Kk, Known to exist as early as Jan. 29, 2015, pp. 1, Published in: US.
Youtube, "Elzetta Mini CQB & ZKL Bow Mounti SHOT Show 2015", Webpage found at https //www youtube com/watch~v=dEb701T_2Kk Inventor(s) aware of prior art on or before Jan. 29, 2015, pp. 1, Published in US.
Non-Final Office Action received for U.S. Appl. No. 198/354,422, mailed on May 4, 2026, 6 pages.

* cited by examiner

4800

FIREARM ACCESSORY MOUNTING INTERFACE

PRIORITY

The present application is a continuation of U.S. patent application Ser. No. 17/993,219 filed Nov. 23, 2022, and entitled "FIREARM ACCESSORY MOUNTING INTERFACE" which is a continuation of U.S. patent application Ser. No. 17/225,237 filed Apr. 8, 2021, and entitled "FIREARM ACCESSORY MOUNTING INTERFACE," issued as U.S. Pat. No. 11,536,535 on Dec. 27, 2022, which is a continuation of U.S. patent application Ser. No. 16/690,872 filed Nov. 21, 2019, and entitled "FIREARM ACCESSORY MOUNTING INTERFACE," issued as U.S. Pat. No. 11,002,509 on May 11, 2021, which is a continuation of U.S. patent application Ser. No. 15/926,780 filed Mar. 20, 2018, and entitled "FIREARM ACCESSORY MOUNTING INTERFACE," issued as U.S. Pat. No. 10,520,279 on Dec. 31, 2019, which is a continuation of U.S. patent application Ser. No. 15/357,216 filed Nov. 21, 2016, and entitled "FIREARM ACCESSORY MOUNTING INTERFACE," issued as U.S. Pat. No. 9,976,832 on May 22, 2018, which is a continuation of U.S. patent application Ser. No. 14/964,859 filed Dec. 10, 2015, and entitled "FIREARM ACCESSORY MOUNTING INTERFACE," issued as U.S. Pat. No. 9,523,554 on Dec. 20, 2016, which is a continuation of U.S. patent application Ser. No. 14/658,171 filed Mar. 14, 2015 and entitled "FIREARM ACCESSORY MOUNTING INTERFACE," issued as U.S. Pat. No. 9,239,210 on Jan. 19, 2016, which is a continuation-in-part of U.S. patent application Ser. No. 14/555,615, entitled "FIREARM ACCESSORY MOUNTING INTERFACE," filed Nov. 27, 2014 and issued as U.S. Pat. No. 9,239,209 on Jan. 19, 2016, which is a continuation-in-part of U.S. patent application Ser. No. 14/271,912, entitled "FIREARM ACCESSORY MOUNTING INTERFACE", filed May 7, 2014 and issued as U.S. Pat. No. 8,925,236 on Jan. 6, 2015, which claims priority under 35 U.S.C. 119(e) to U.S. Provisional Patent Application No. 61/974,968, entitled "FIREARM ACCESSORY MOUNTING INTERFACE," and filed Apr. 3, 2014, and the entirety of these applications is incorporated herein by reference.

FIELD OF THE DISCLOSURE

The present invention relates to the field of firearms and more particularly relates to an improved firearm accessory mounting interface.

BACKGROUND

Modem firearms, in particular, military assault rifles, can be deployed for a number of combat missions such as sniper weapons and in close combat. They are commonly used for nighttime combat. All of these applications can require fitting a variety of telescopic sights, infrared sights, tactical lights, laser sighting modules, grenade launchers, bipods, grips and other accessories to the firearm. For mounting purposes, standardized mounting platforms have been developed, such as the Picatinny rail platform (MIL-STD-1913 or STANAG 2324). The Picatinny rail is a cross-section shaped roughly like a wide T with the top of the T corresponding to the top of the rail. The rail has a number of evenly spaced transverse slots in the top spanning the width of the T-shaped cross-section.

Such rails are often placed directly on the weapon's receiver, in the position normally occupied by the rear sights. The rail may also extend over the rifle handguard associated with the rifle barrel. In addition to top mounting rails, firearms may now include rails fastened to guns in various locations. In some cases, grips are surrounded with top, bottom and side rails. Mounting rails are also appearing on shotguns and pistols.

While the mounting rails have obvious utilitarian benefits, they are not without some shortcomings. Most notably, they can be uncomfortable when grasped by a user's hands, they can snag on clothing, barbed wire, and other objects, they add weight to a weapon system, and under certain field conditions they may become clogged with dirt and other debris that make it difficult to install one of the many accessories receivable on the rails.

Other systems have detachable rails that allow the user to install rails only where they are needed, and only of the length needed. While this decreases weight (and the discomfort and other disadvantages) of having needless rails where the hand is to grip, it suffers from other disadvantages. First, such systems may be difficult or complex to install. Second, they may require custom modification of parts, such as drilling and tapping holes where needed. Third, the attachment locations may be in limited locations due to the need to relocate fasteners such as threaded inserts (or may increase cost and weight by using an excessive number of fasteners).

A further significant disadvantage of systems having modular rails that may be mounted in various locations on the forearm or handguard of a rifle stock is the susceptibility to loosening. If the mount for a rifle scope becomes loose, this can cause significant aiming errors.

One solution to the disadvantages of Picatinny rail systems is the KEYMOD system introduced by VLTOR Weapon Systems. The KEYMOD system consists of two parts: the KEYMOD slot; and the KEYMOD nut. The slot is distinctive with a larger diameter through-hole combined with a narrow slot. The slot is chamfered on the backside while the through-hole is sized for clearance of a quick-detach sling swivel (approximately ⅜" diameter).

However, the KEYMOD specifications also suffer from several disadvantages including more complex manufacturing. The KEYMOD specification is also harder to implement in polymeric materials since it typically requires complex secondary machining operations rather than standard molding processes to form the keyhole apertures. Therefore, there is a need in the art for a firearm accessory mounting interface that adds minimal or no weight to a weapon system, is unlikely to snag, is unlikely to clog with mud and debris, and is comfortable to hold.

SUMMARY OF THE DISCLOSURE

Many objects of this disclosure will appear from the following description and appended claims, reference being made to the accompanying drawings forming a part of this specification wherein like reference characters designate corresponding parts in the several views.

An exemplary accessory mounting interface for a firearm is provided. The exemplary interface has a firearm accessory, a first elongated fastener, a second fastener, and an elongated slot in a firearm. The firearm accessory has a first side and a second side, with the second side configured to engage a firearm. The firearm accessory has at least one through hole extending from the first side through the second side, and first and second halves of a first slot protrusion positioned about the through hole. The first elongated fastener has right-handed threading and is arranged through the through hole, with a first end extending below the first and second halves of the first slot protrusion of the firearm accessory. The second fastener is rotationally mated to the first elongated fastener and has a length greater than a width, the length measured along a longitudinal axis of the second fastener. The second fastener has a plurality of straight edges. The elongated slot has a length greater than a width. The width is between the length and width of the second fastener, such that the second fastener can pass through the elongated slot when the longitudinal axis of the second fastener is arranged parallel to a longitudinal axis of the elongated slot, but abuts a sidewall of the elongated slot when the longitudinal axis of the second fastener is arranged obliquely to the longitudinal axis of the elongated slot. At least one of the plurality of straight edges prevents the second fastener from rotating further than a closed position when the at least one of the straight edges abuts the sidewall of the elongated slot.

Another exemplary accessory mounting interface for a firearm is provided. The exemplary interface has a firearm accessory, a first fastener, a second fastener, and an elongated slot in a firearm. The firearm accessory has a first side and a second side, the second side configured to engage a firearm. The firearm accessory has at least one through hole extending from the first side through the second surface. The firearm accessory has a first slot protrusion having first and second halves with inner arcs partially surrounding the through hole. The second fastener has right-handing threading, and is rotationally mated to the first fastener. The second fastener has at least one straight edge and first and second curved edges having a first radius and third and fourth curved edges having a second radius greater than the first radius. The inner arcs of the first slot protrusion have a radius of curvature greater than or equal to the second radius. The elongated slot in a firearm has a length greater than a width, such that the second fastener can pass through the elongated slot when the longitudinal axis of the second fastener is arranged parallel to a longitudinal axis of the elongated slot, but abuts a sidewall of the elongated slot when the longitudinal axis of the second fastener is arranged obliquely to the longitudinal axis of the elongated slot. At least one of the first fastener or the second fastener is arranged through the through hole. The second fastener has a closed position and an open position relative to the first fastener, wherein the longitudinal axis of the second fastener is parallel to the longitudinal axis of the elongated slot when the second fastener is in the open position, and the closed position is rotated between 45° and 135° from the open position. The at least one straight edge prevents the second fastener from rotating further than the closed position when the second fastener abuts the sidewall of the elongated slot.

An exemplary method of mounting an accessory to a firearm is provided. The interface has a firearm accessory having a first side and a second side, a first elongated fastener, a second fastener rotationally mated to the first elongated fastener, and an elongated slot in a firearm. The exemplary method includes causing the second side of the firearm accessory to engage a firearm, and passing the first elongated fastener through a through hole in the firearm accessory, the through hole extending from the first side through the second side of the firearm accessory. The method also includes positioning a first slot protrusion of the firearm accessory in the elongated slot, the first slot protrusion having first and second halves positioned about the through hole. The method also includes causing a first end of the first elongated fastener to extend below the first and second halves of the first slot protrusion of the firearm accessory. The method also includes rotating the first elongated fastener clockwise when viewed from the first side to cause the second fastener to move from an open position wherein the second fastener can pass through the elongated slot to a closed position wherein the second fastener abuts a sidewall of the elongated slot and at least one of a plurality of straight edges in the second fastener prevents the second fastener from rotating further than the closed position when the at least one of the straight edges abuts the sidewall of the elongated slot.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

With reference now to the drawings, the preferred embodiment of the firearm accessory mounting interface is herein described. It should be noted that the articles "a", "an" and "the", as used in this specification, include plural referents unless the content clearly dictates otherwise.

The improved firearm accessory mounting interface comprises three parts: a first elongated fastener (e.g., a screw or first cammed fastener), second fastener (e.g., a nut or a second cammed fastener), and an elongated slot. Embodiments of the entire interface as used on handguards can be seen in FIGS. 1-6. Embodiments of the interface as used on a portion of a firearm can be seen in FIGS. 7-14B. Embodiments of the second fastener can be seen in FIGS. 15-19, and 23A-33 and 48-55. Embodiments of the first elongated fastener and the second fastener can be seen in FIG. 28. Embodiments of the elongated slot as used in a handguard can be seen in FIGS. 1-6 and 20-21. Embodiments of a firearm accessory adapted for use with the improved firearm accessory mounting interface can be seen in FIGS. 1-14B and 22-23B.

FIGS. 1-6 show embodiments of portions of firearms having accessories mounted thereto via embodiments of the firearm accessory mounting interface described herein (e.g., at least one elongated fastener, at least one fastener, and at least one elongated slot).

Figure 1:
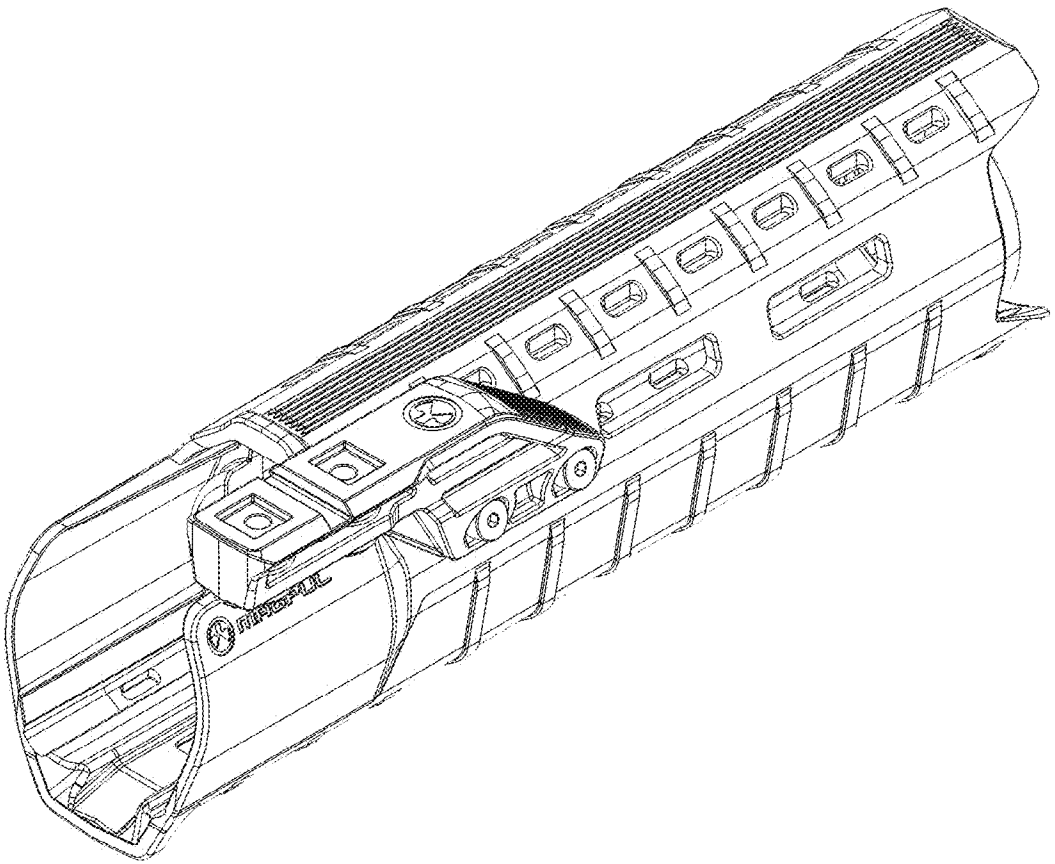
FIG. 1 is a perspective view of a handguard of a firearm removably coupled to a firearm accessory via an embodiment of a firearm accessory interface of this disclosure.
Figure 2:
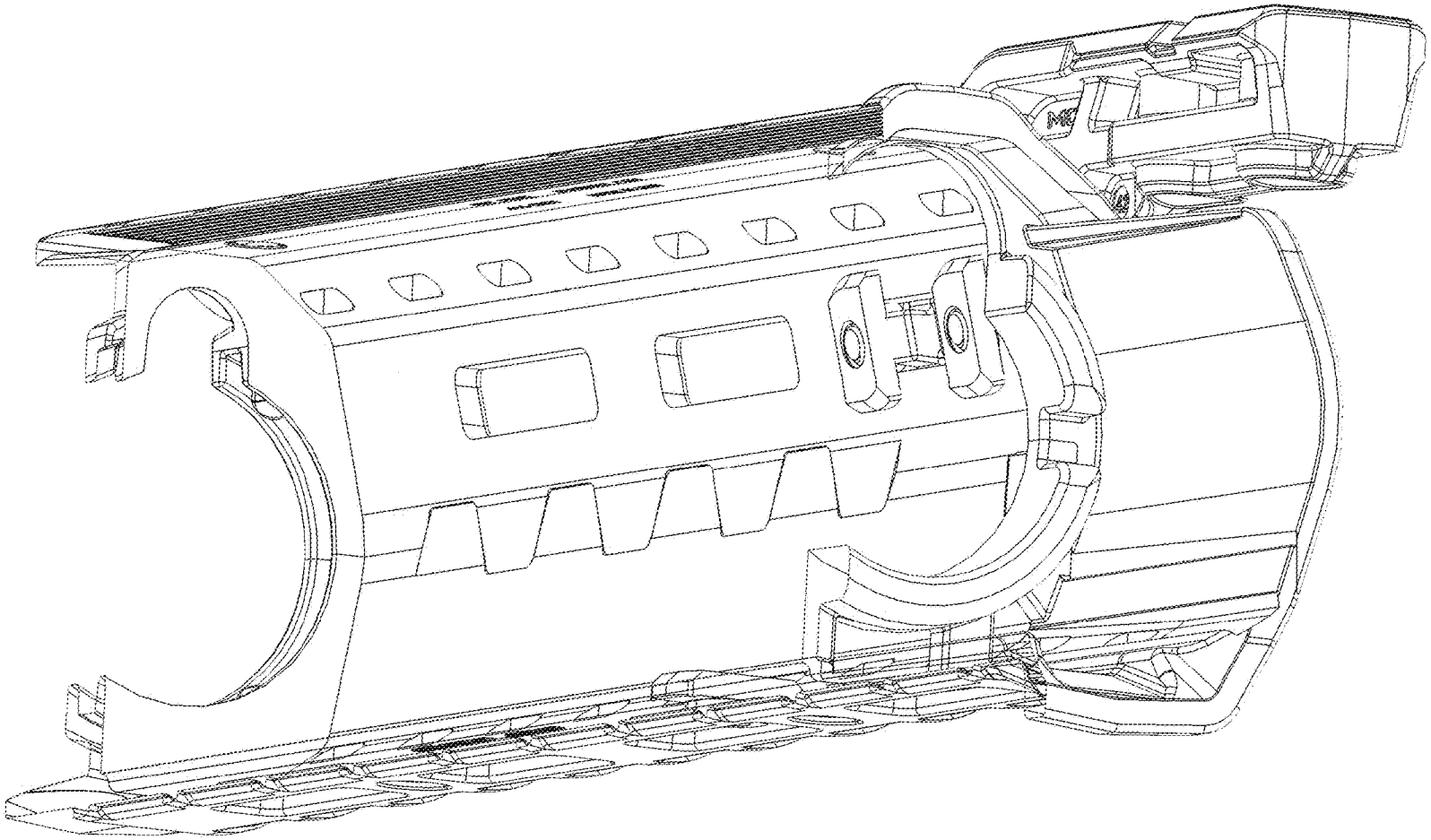
FIG. 2 is a cutaway view of a handguard of a firearm removably coupled to a firearm accessory via an embodiment of a firearm accessory interface of this disclosure.
Figure 3:
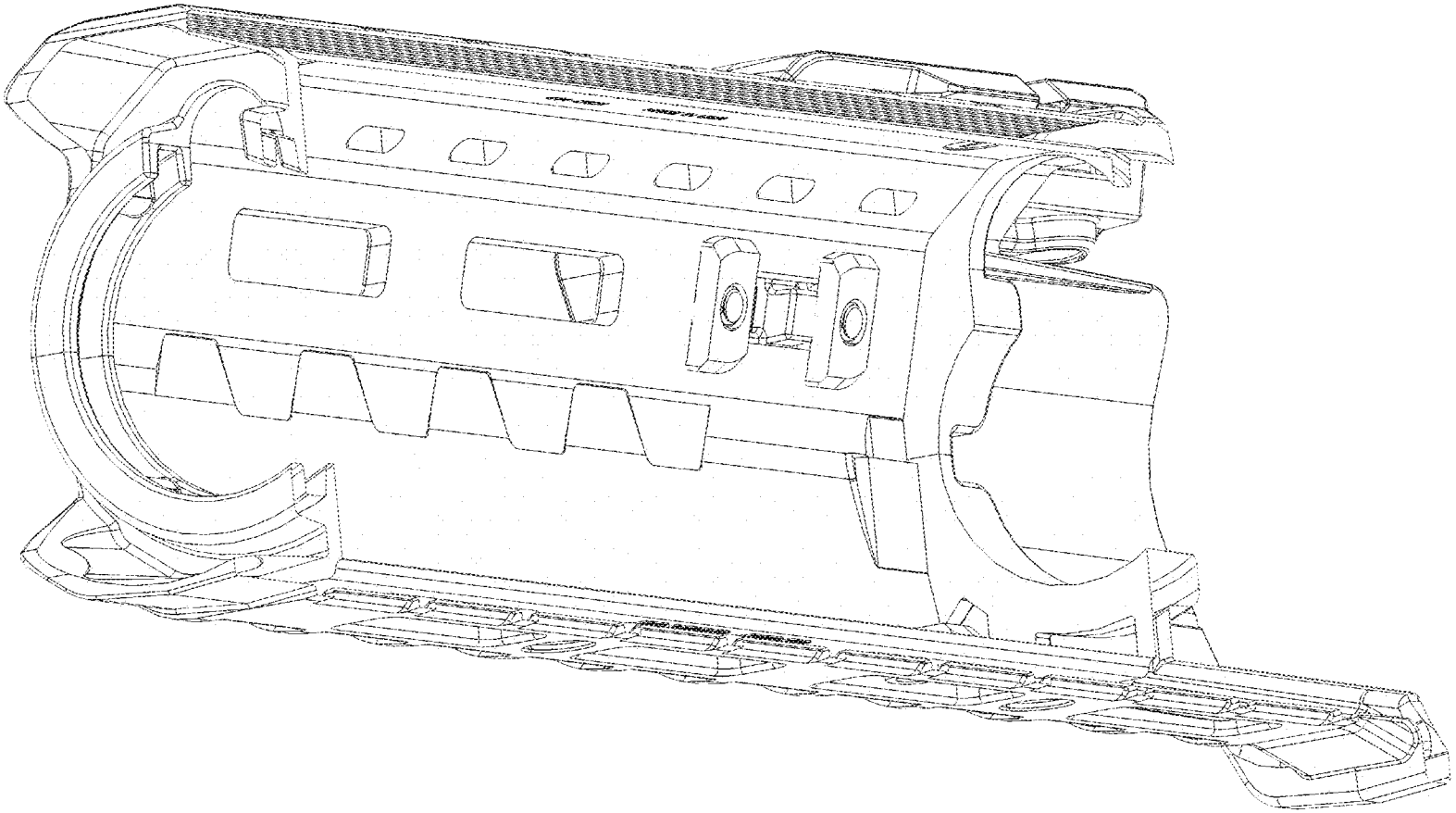
FIG. 3 is another cutaway view of a portion of the firearm illustrated in FIGS. 1 and 2.

FIGS. 1-3 show a light mount affixed to a side of a handguard via an embodiment of the firearm accessory mounting interface. Here the accessory mounting interface includes one of three elongated slots on a left side of a handguard as well as a pair of first elongated fasteners (e.g., screws) and second fasteners (e.g., nuts) that couple the light mount to the elongated slot. In FIGS. 2-3 the second fasteners can be seen in a "locked" position, or turned 90° to a position where the second fasteners can clear the elongated slot (or have a length parallel to a longitudinal axis of the elongated slots). To remove the light mount the second fasteners can be turned 90° and the firearm accessory can be removed with the second fasteners passing at least partially through the elongated slot.

Figure 4:
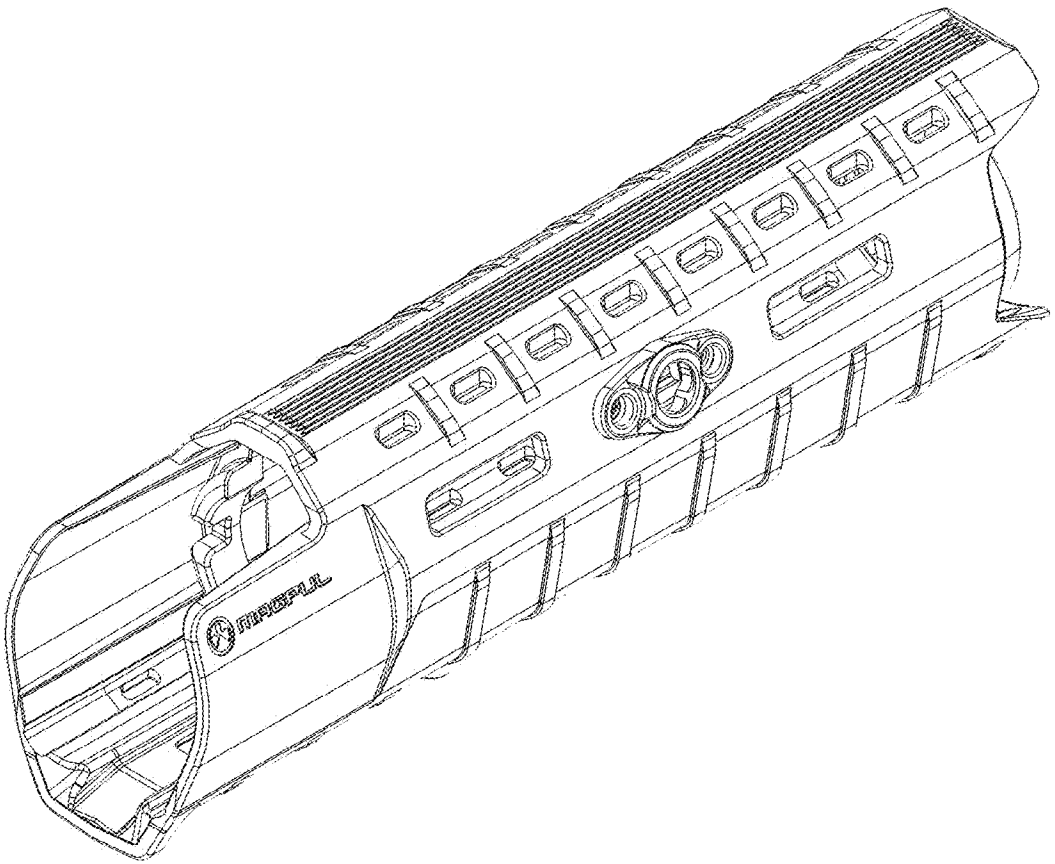
FIG. 4 is a perspective view of another firearm accessory removably coupled to a handguard.

FIG. 4 shows a quick detach (QD) female portion mounted to a handguard via an embodiment of the firearm accessory mounting interface of this disclosure. In this case the QD female portion is aligned with a middle of three elongated slots on a left side of the handguard, but is not shown with the first elongated fasteners or the second fasteners that would be used to mount the QD female portion to the handguard.

Figure 5:
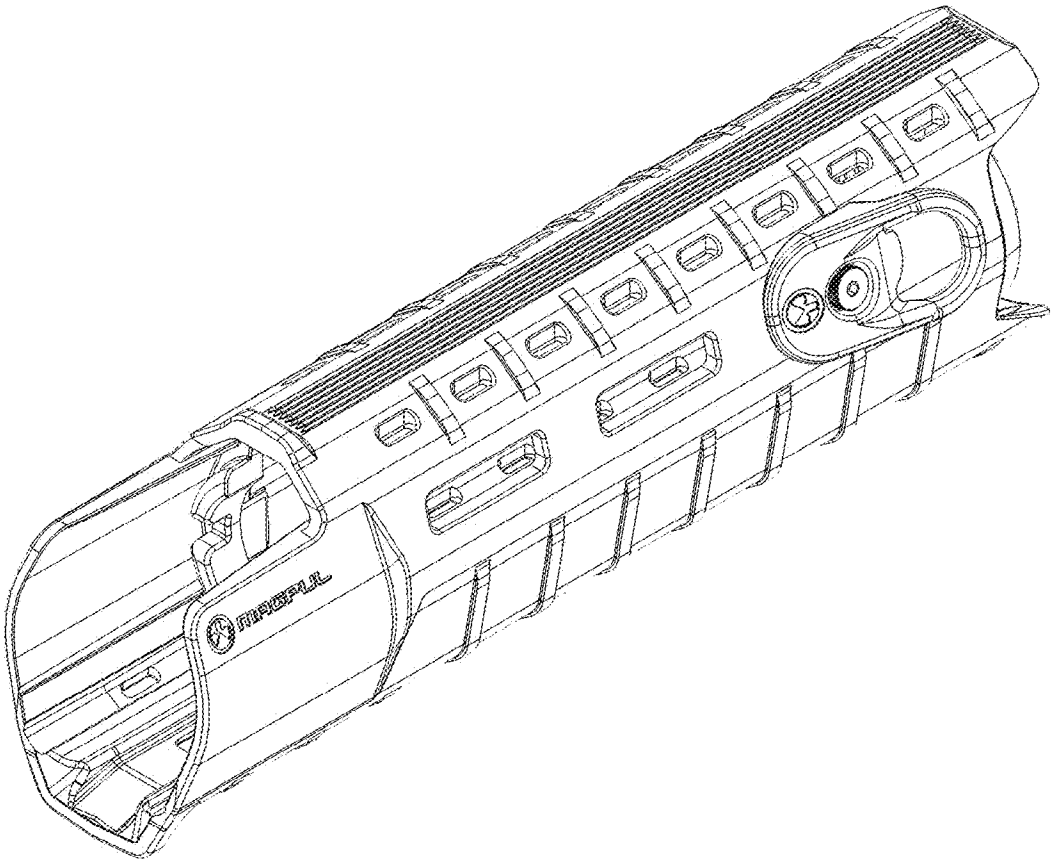
FIG. 5 is a perspective view of another firearm accessory removably coupled to a handguard.

FIG. 5 shows a sling mount coupled to a handguard via an embodiment of the firearm accessory mounting interface of this disclosure. Here, the firearm accessory mounting interface includes one of three elongated slots on a left side of a handguard as well as a first elongated fastener that passes through a through-hole of the sling mount and threads into a threaded portion of a second fastener arranged to pass at least partially through the elongated slot and pivot so as to lock against an inner surface of the handguard.

Figure 6:
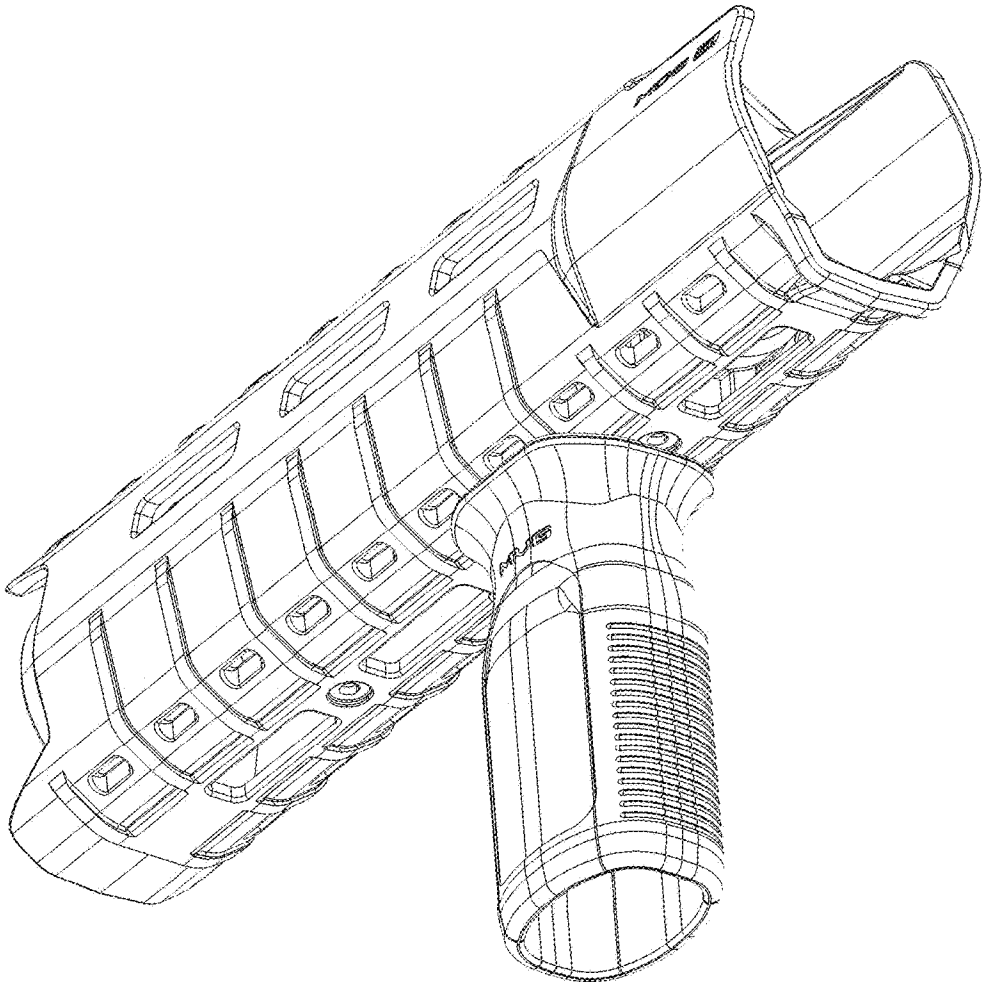
FIG. 6 is a perspective view of another firearm accessory removably coupled to a handguard.
Figure 7:
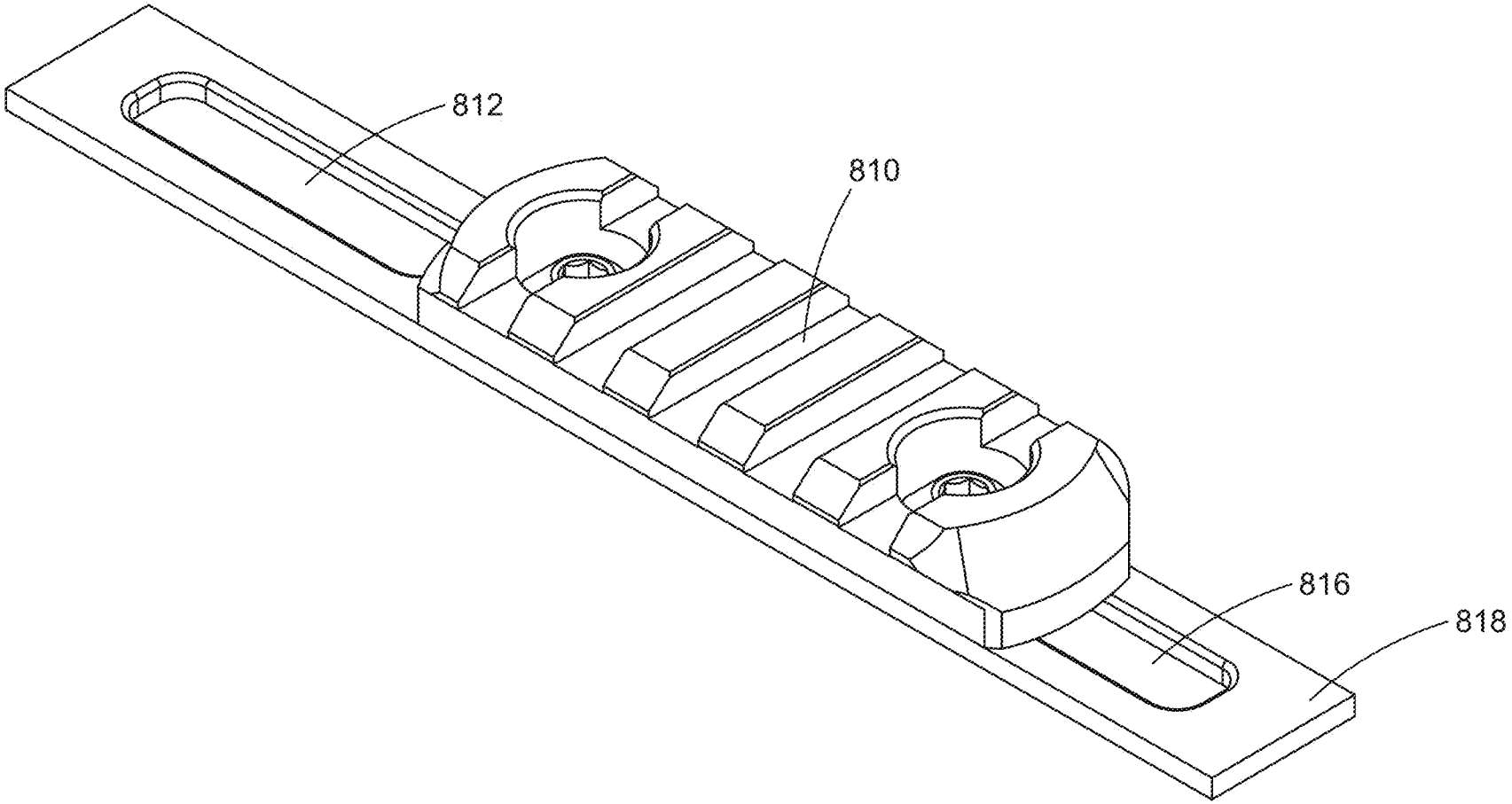
FIG. 7 is a perspective view of an embodiment of a firearm accessory mounting interface including a firearm accessory mounted to a portion of a firearm via one or more pairs of first and second mated fasteners.
Figure 46A:
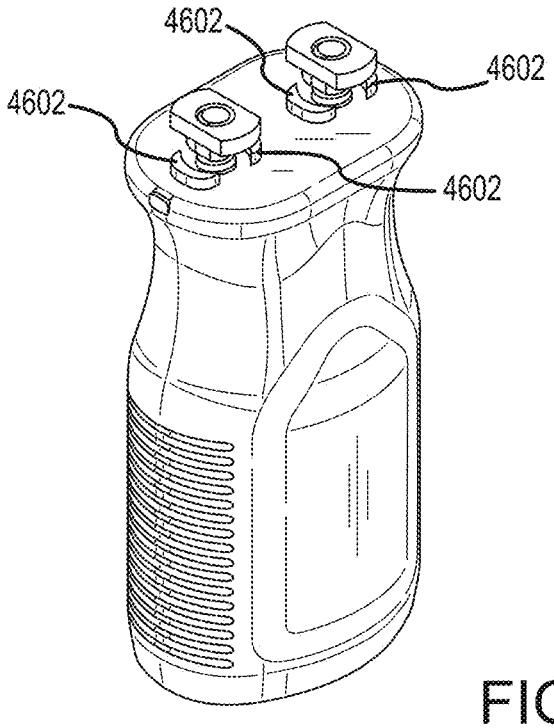
FIG. 46A shows a perspective view of another firearm accessory that can be mated to a firearm via the fasteners disclosed herein.
Figure 46B:
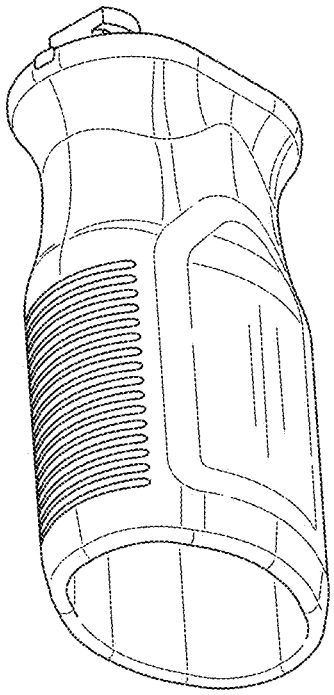
FIG. 46B shows another perspective view of the embodiment illustrated in FIG. 46A.

FIG. 6 shows a vertical grip coupled to a handguard via an embodiment of the firearm accessory mounting interface of this disclosure. Here, the firearm accessory mounting interface includes one of four elongated slots on a bottom of a handguard as well as one or two pairs of first elongated fasteners and second fasteners that are used to couple the vertical grip to the handguard. Further views of the grip along with the first and second fasteners, but detached from the handguard, can be seen in FIGS. 46A and 46B. The illustrated grip includes slot protrusions 4602 surrounding first fasteners, although this is not required. The first fastener is threaded and mates with a second fastener, also threaded, and the first fastener can be rotated via a tool passed through a bottom of the grip, which is open as seen in FIG. 46B. For instance, an Allen wrench can be passed through this opening and inserted into an Allen wrench interface of the first fastener.

Figure 8:
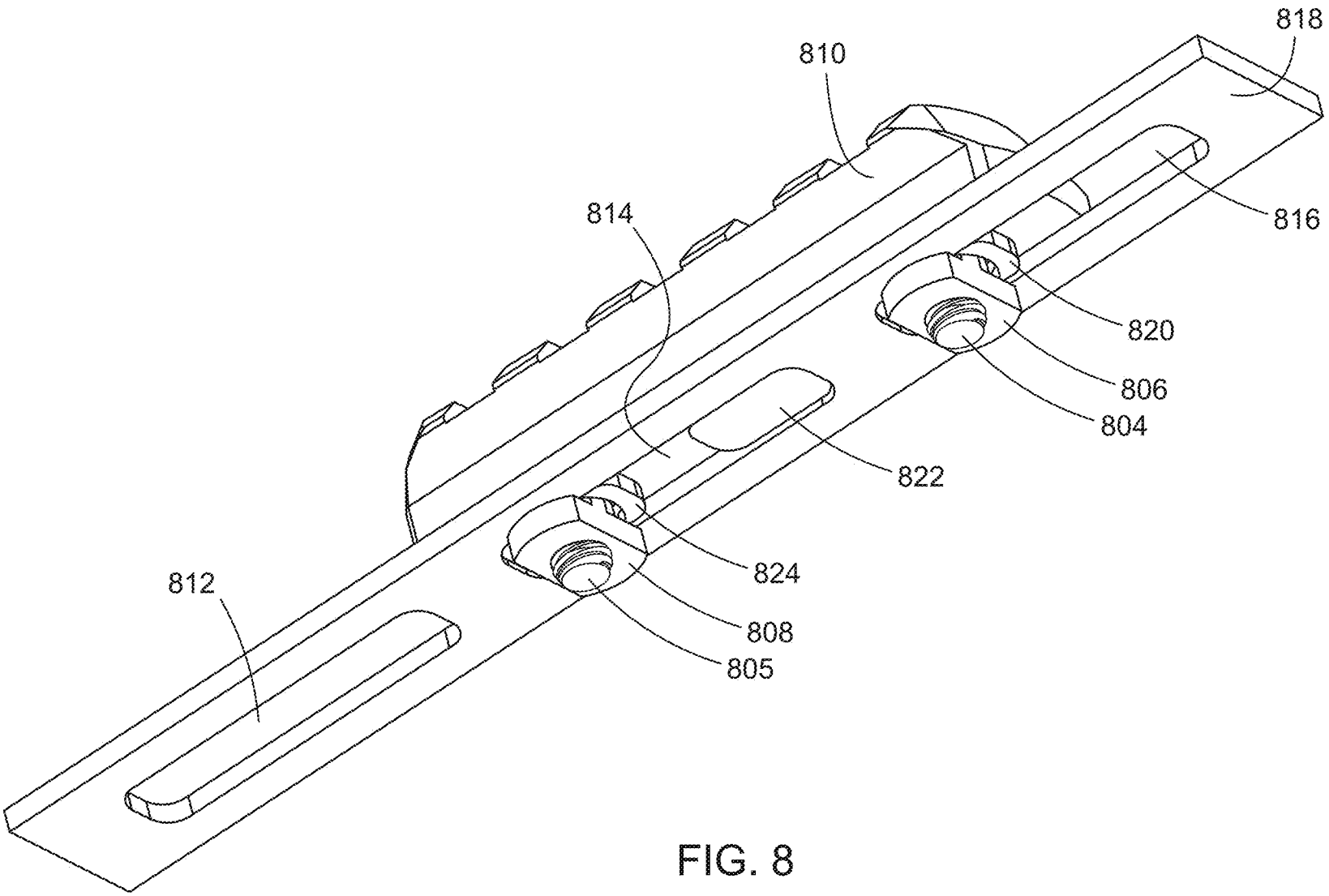
FIG. 8 is a bottom perspective view of an embodiment of a firearm accessory mounting interface including a firearm accessory mounted to a portion of a firearm via one or more pairs of first and second mated fasteners.
Figure 9:
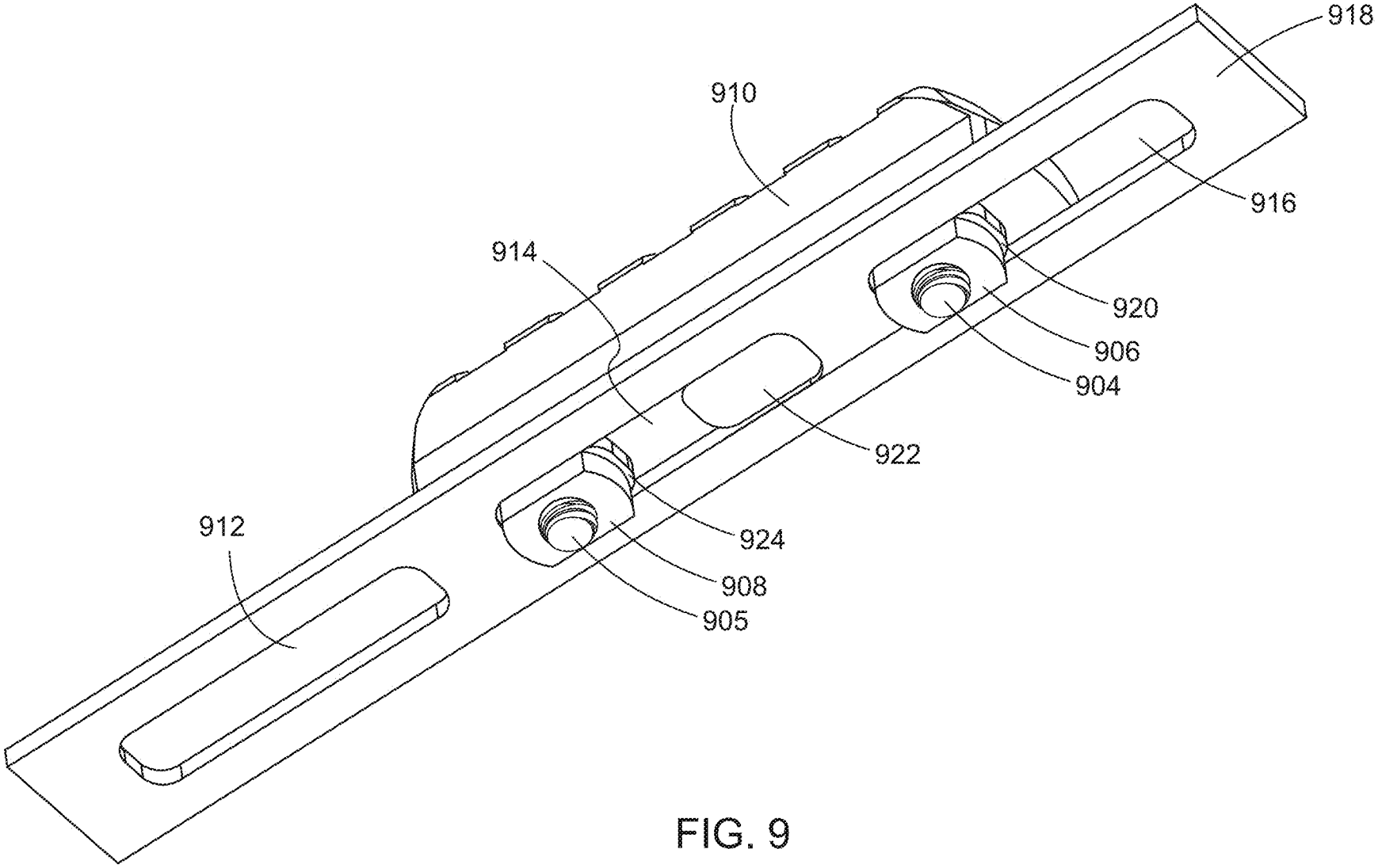
FIG. 9 is a bottom perspective view of the firearm accessory mounting interface of FIG. 8, but where the second fasteners are in an open position.
Figure 10:
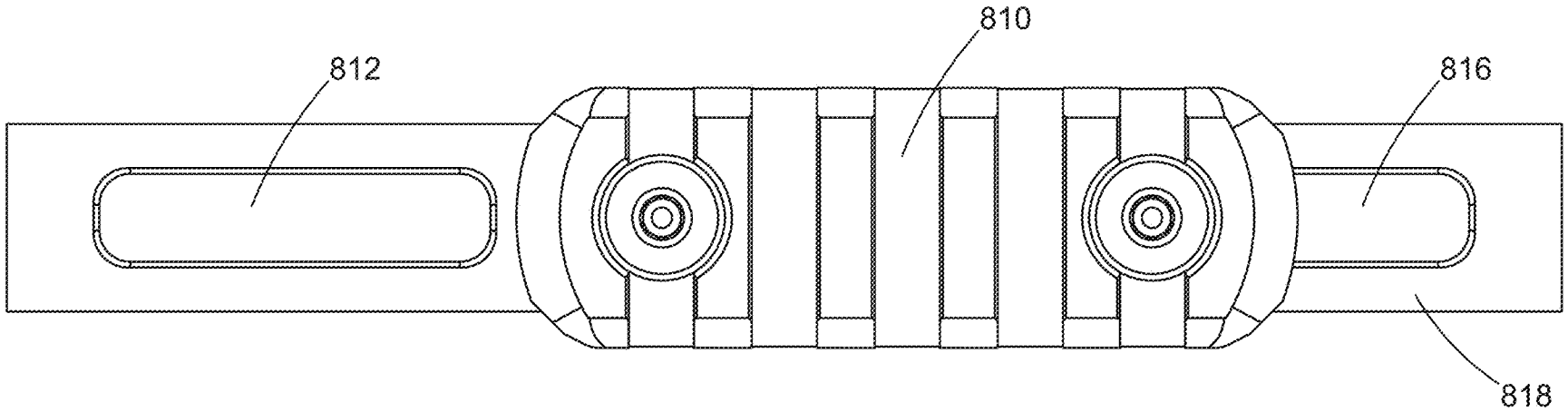
FIG. 10 is a top view of an embodiment of a firearm accessory mounting interface including a firearm accessory mounted to a portion of a firearm via one or more pairs of first and second mated fasteners.
Figure 11:
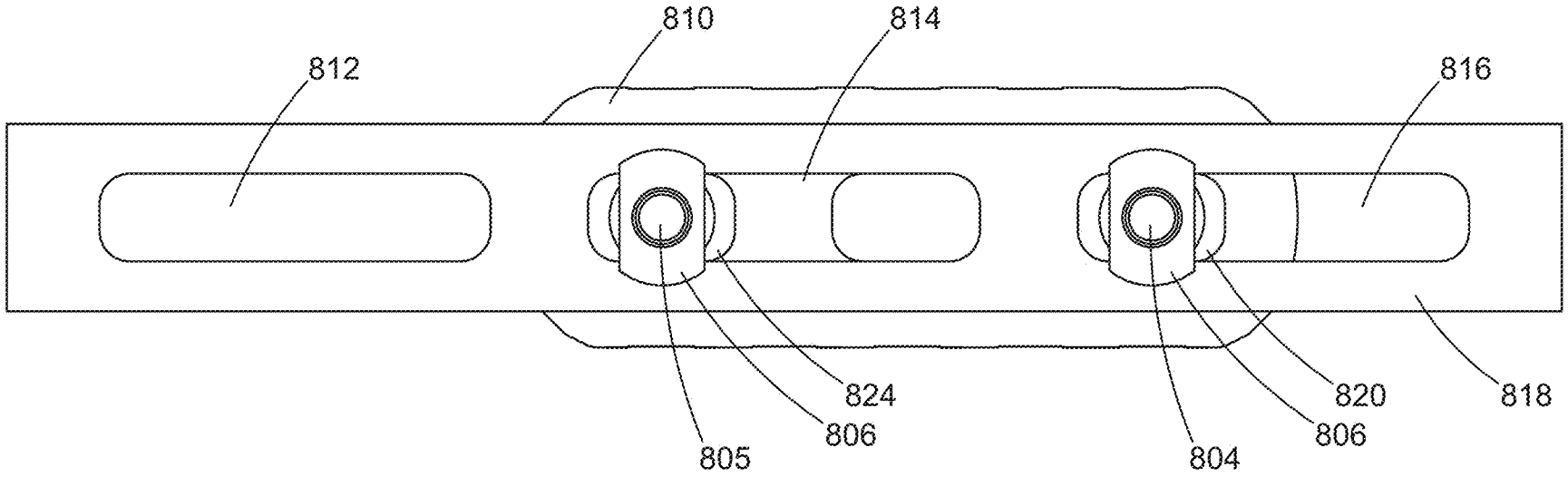
FIG. 11 is a bottom view of an embodiment of a firearm accessory mounting interface including a firearm accessory mounted to a portion of a firearm via one or more pairs of first and second mated fasteners.
Figure 12:
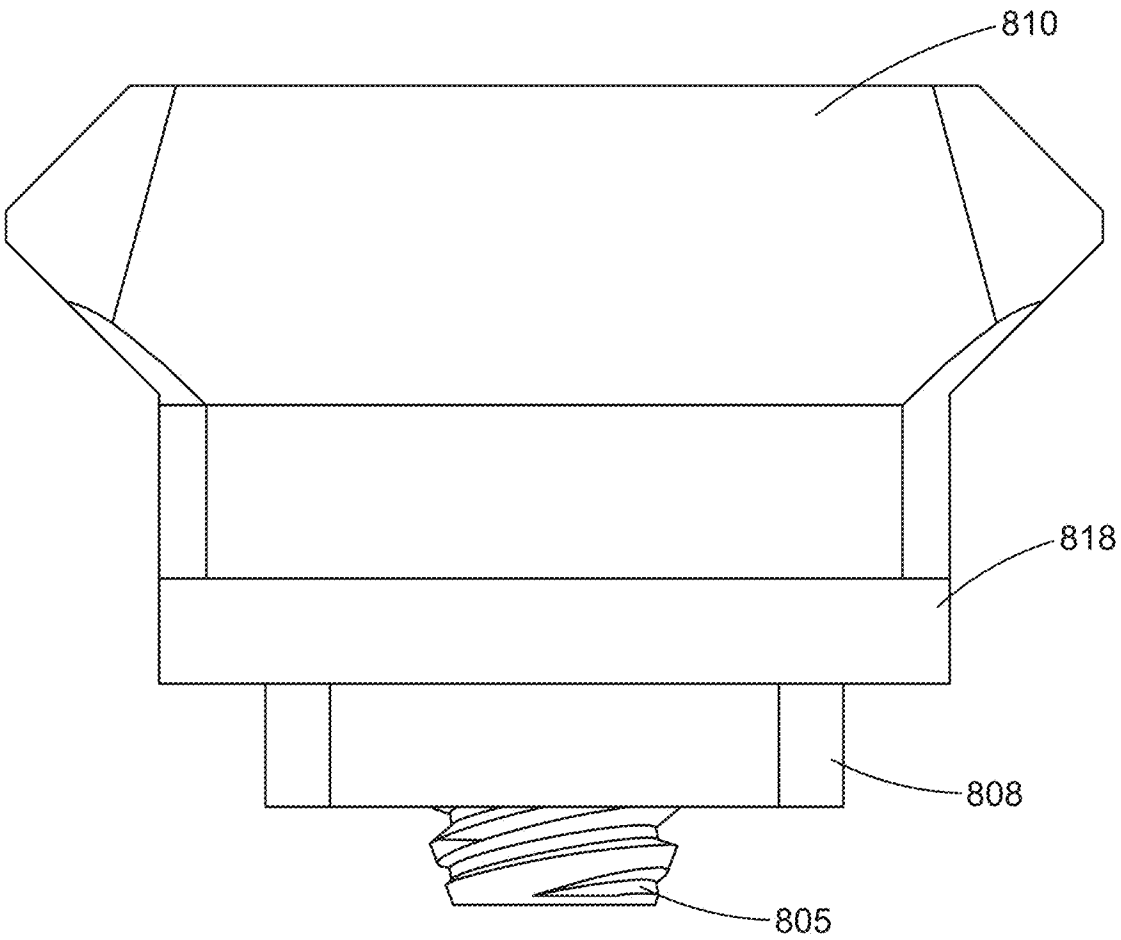
FIG. 12 is a front view of an embodiment of a firearm accessory mounting interface including a firearm accessory mounted to a portion of a firearm via one or more pairs of first and second mated fasteners.
Figure 13:
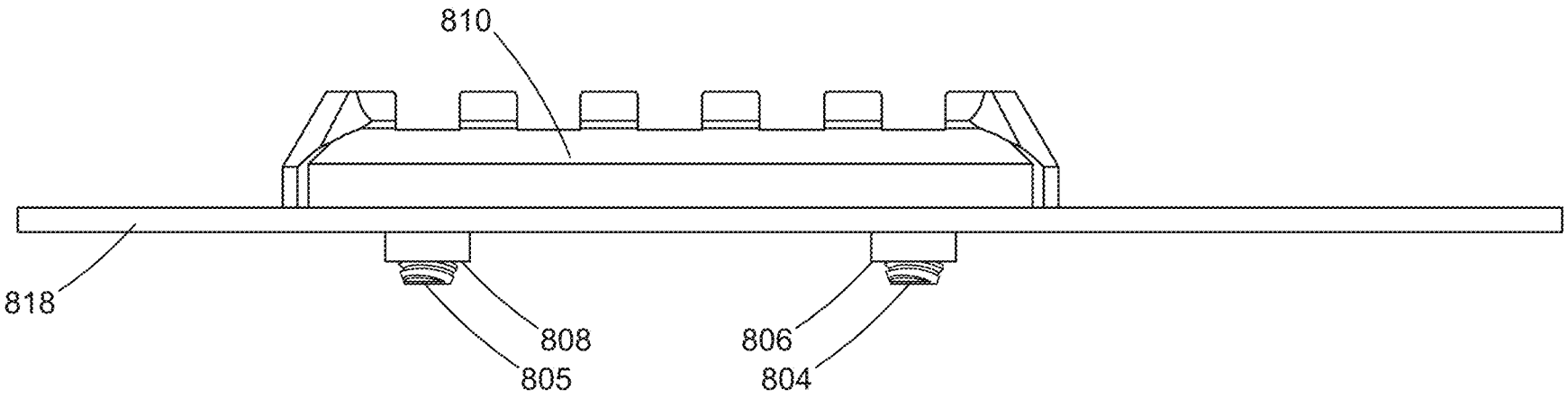
FIG. 13 is a side view of an embodiment of a firearm accessory mounting interface including a firearm accessory mounted to a portion of a firearm via one or more pairs of first and second mated fasteners.

FIGS. 7-13 show an embodiment of the firearm accessory mounting interface including a first elongated fastener, a second fastener, and three elongated slots in a portion of the firearm for mounting a firearm accessory to the firearm. To affix the firearm accessory 810 to the portion of the firearm 818, one or more first elongated fasteners 804, 805 can each be inserted through a respective through-hole of the firearm accessory 810 (a modular Picatinny rail) and threaded through at least a portion of a respective second fastener 806, 808. Each of the one or more second fasteners 806, 808 can start in an "open" position as illustrated in FIG. 9, such that the firearm accessory 810 can be pressed against the portion of the firearm 818 and the second fasteners 806, 808 can clear one or more elongated slots 812, 814, 816. Here, the second fasteners 806, 808 clear the second and third elongated slots 814, 816. The second fasteners 806, 808 are then tightened resulting in a 45°-135° rotation of each second fastener 806, 808 (e.g., via a 90° turn into a "locked" or "closed" position) and a pinching or squeezing of the portion of the firearm 818 between the second fasteners 806, 808 and the firearm accessory 810 thereby locking the firearm accessory 810 to the firearm (as seen in FIG. 8).

The illustrated embodiment is designed so that the firearm accessory 810 is unable to slide along the elongated slots 812, 814, 816 before the second fasteners 806, 808 are tightened. This is achieved via use of optional slot protrusions 820, 822, 824 spaced such that the firearm accessory 810 is unable to move side to side once the slot protrusions 820, 822, 824 are inserted partially into the elongated slots 812, 814, 816. For instance, a distance between opposing ends of the second and third slot protrusions 822, 824 is equal to or slightly less than a length of the second elongated slot 814. Similarly, a distance between adjacent ends of the first and second slot protrusions 820, 822 is equal to or slightly greater than a distance between the second and third elongated slots 814, 816. Said another way, the slot protrusions 820, 822, 824 can be positioned so that one edge of two or more of the slot protrusions 820, 822, 824 coincides with an end of one or more elongated slots 812, 814, 816. These slot protrusions 820, 822, 824 can be more readily seen in FIG. 22.

Without slot protrusions 820, 822, 824, the one or more second fasteners 806, 808 the firearm accessory 818 can be slid along a long dimension of the elongated slots 812, 814, 816 until a desired position is achieved, and then the second fasteners 806, 808 can be tightened into a locked position.

One of skill in the art will recognize the portion of the firearm 818 as a cutaway of a firearm (e.g., a handguard or stock) and thus does not show the entire firearm nor give any indication as to what firearm or what portion of the firearm the portion of the firearm 818 belongs to. This is intended so that the herein disclosed firearm accessory mounting interface can be envisioned in a variety of different places throughout a firearm.

Figure 14A:
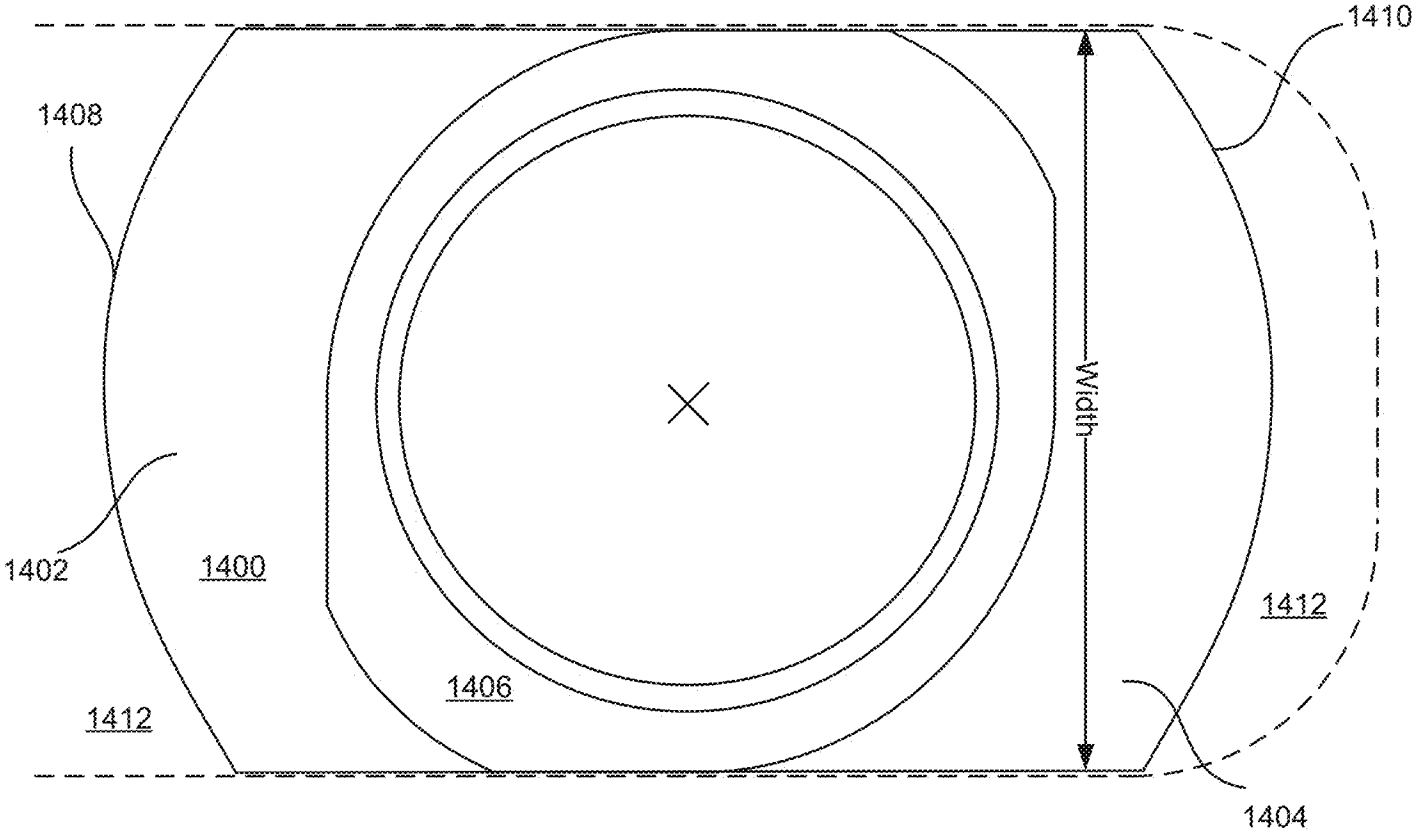
FIGS. 14A and B show two top views of an embodiment of a second fastener relative to an elongated slot for an open and closed position of the second fastener.
Figure 14B:
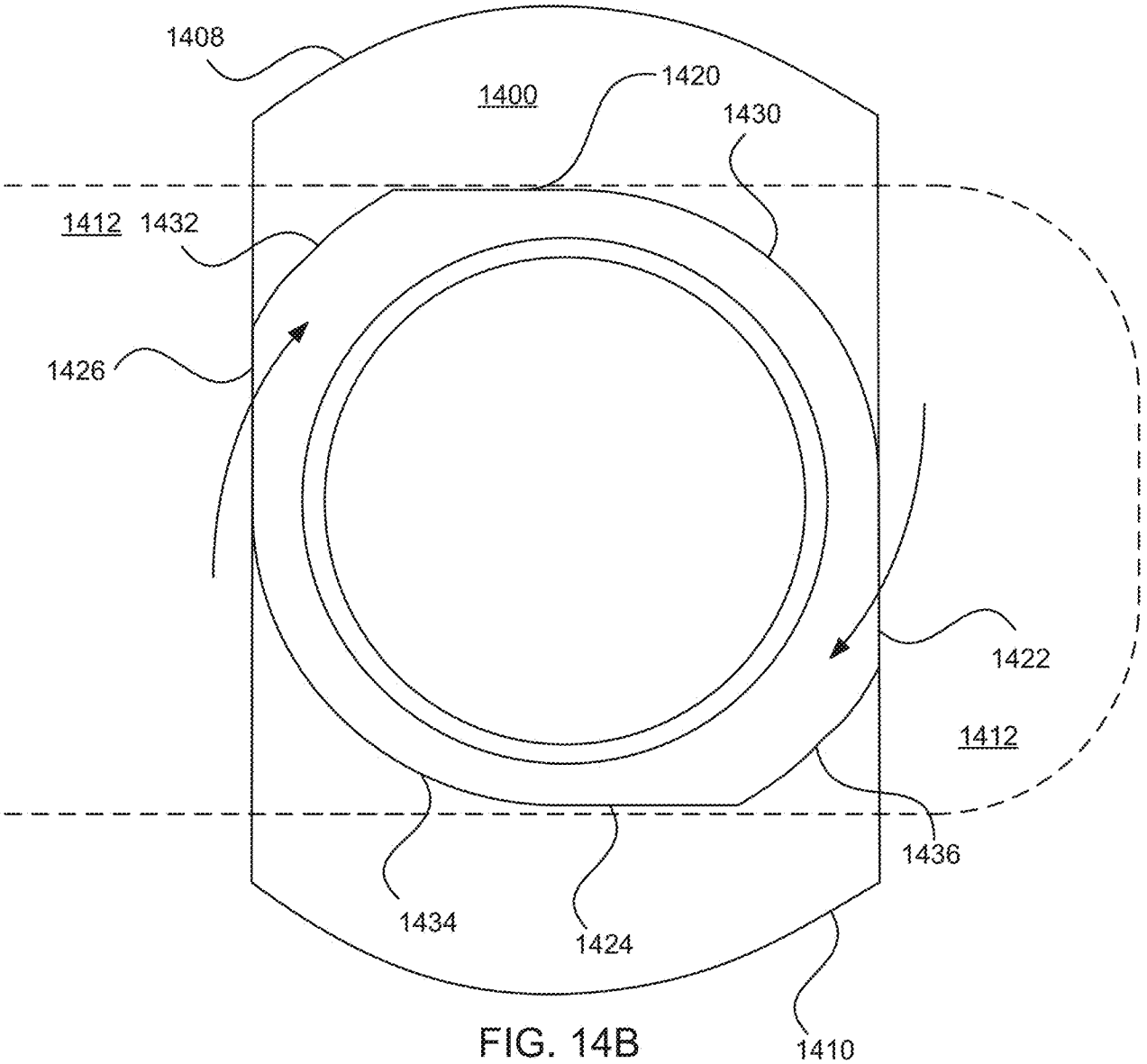
Figure 15:
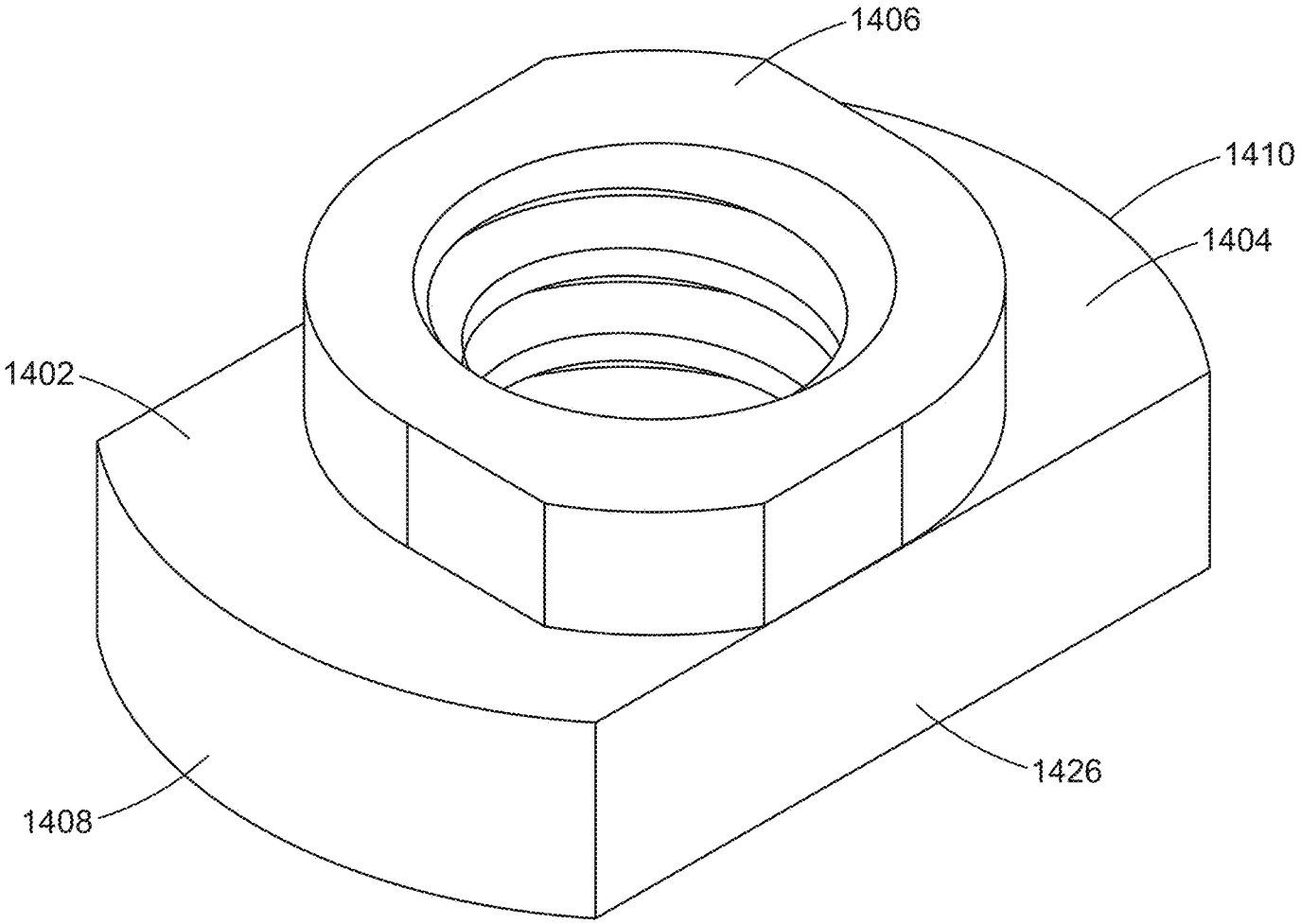
FIG. 15 is a perspective view of a second fastener according to an embodiment of this disclosure.
Figure 16:
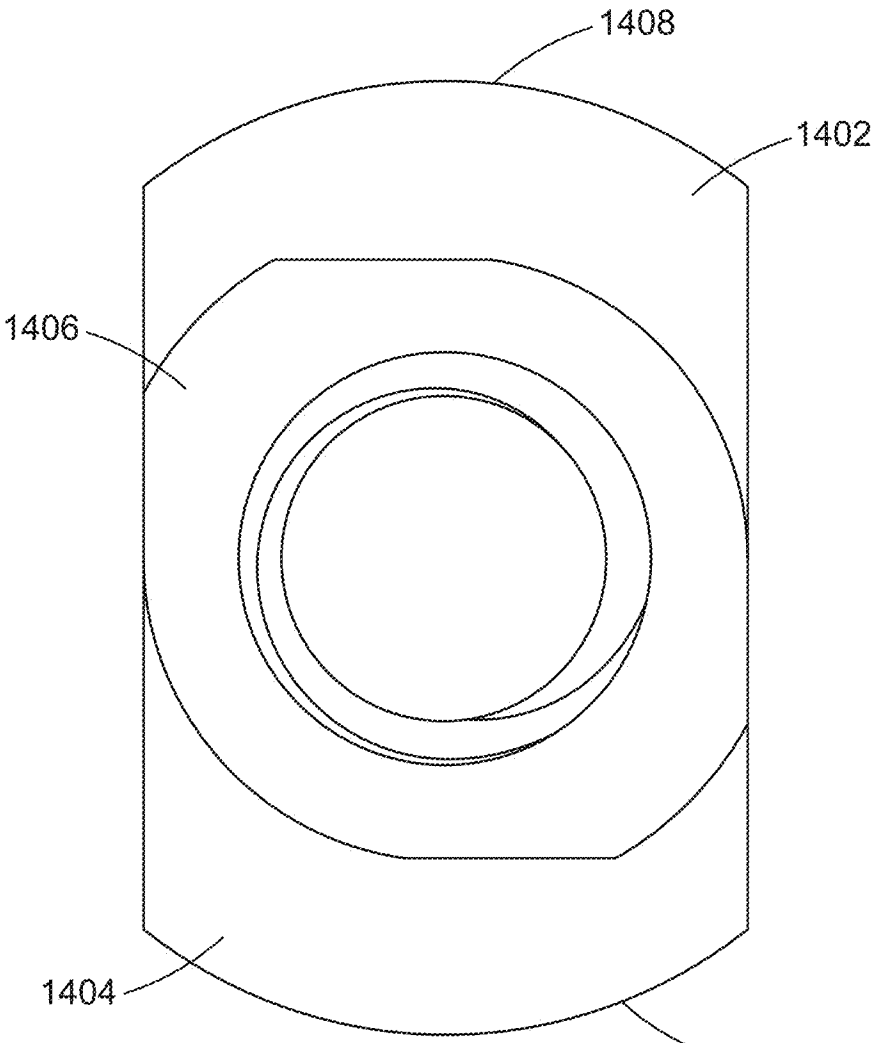
FIG. 16 is a top plan view of the second fastener according to an embodiment of this disclosure.
Figure 17:
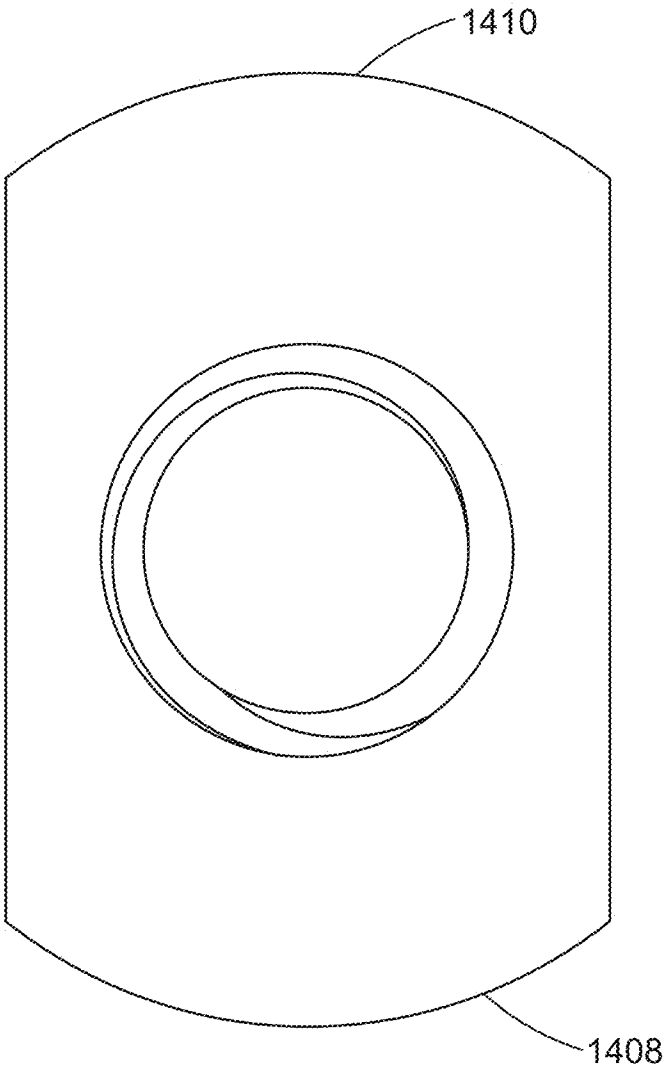
FIG. 17 is a bottom plan view of the second fastener according to an embodiment of this disclosure.
Figure 18:
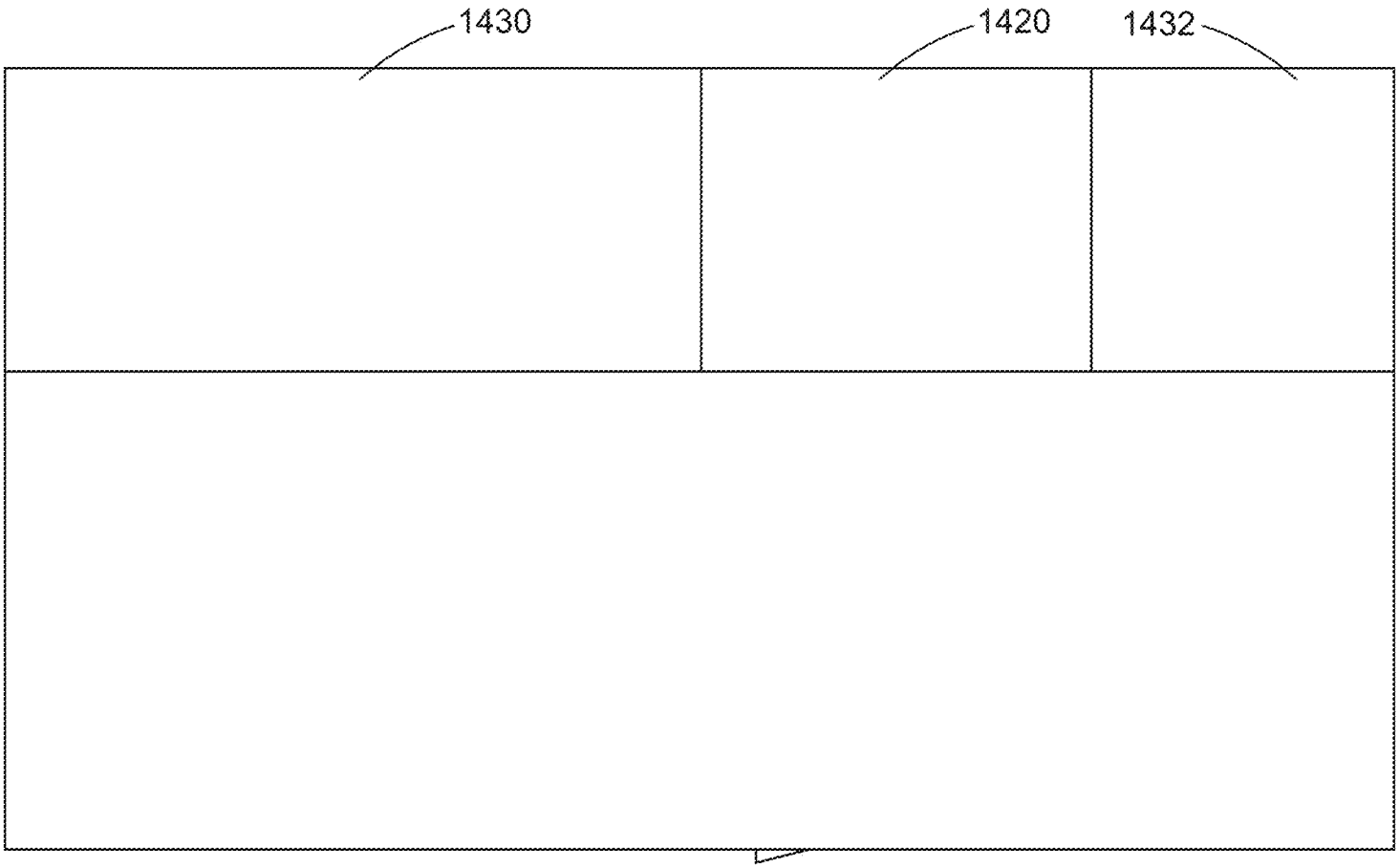
FIG. 18 is a front elevation view of the second fastener according to an embodiment of this disclosure.
Figure 19:
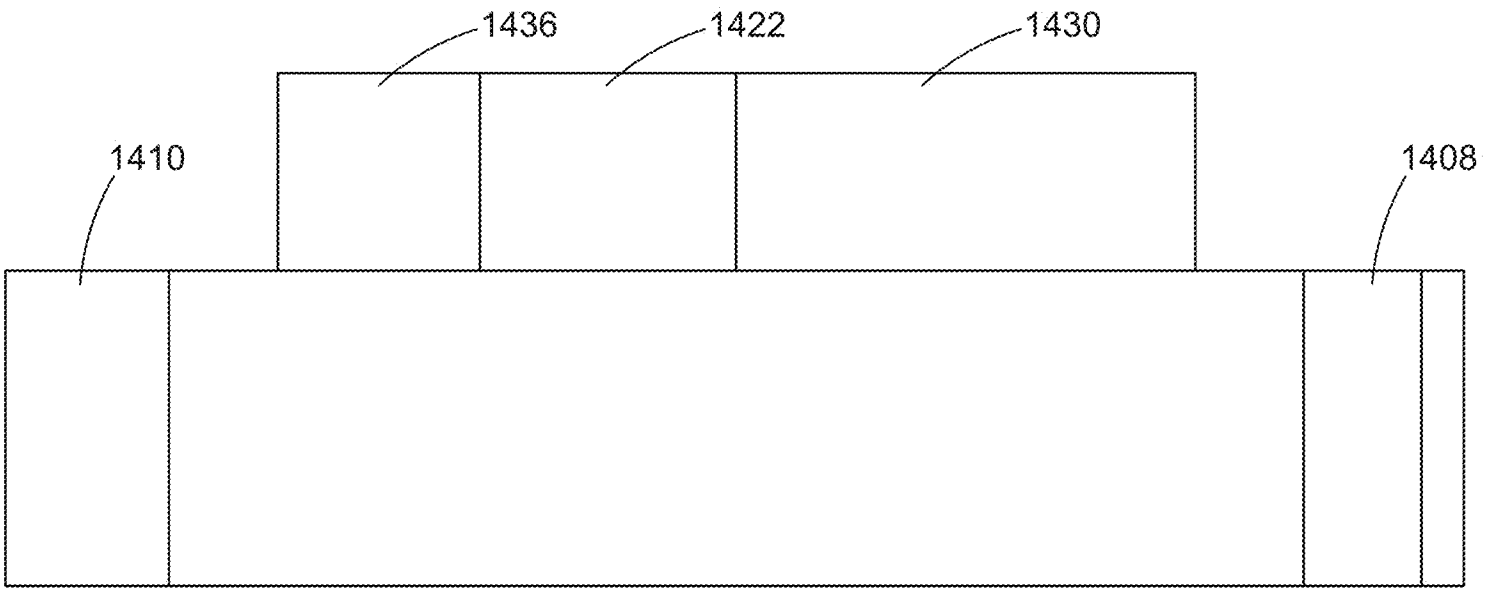
FIG. 19 is a side elevation view of the second fastener according to an embodiment of this disclosure.
Figure 20:
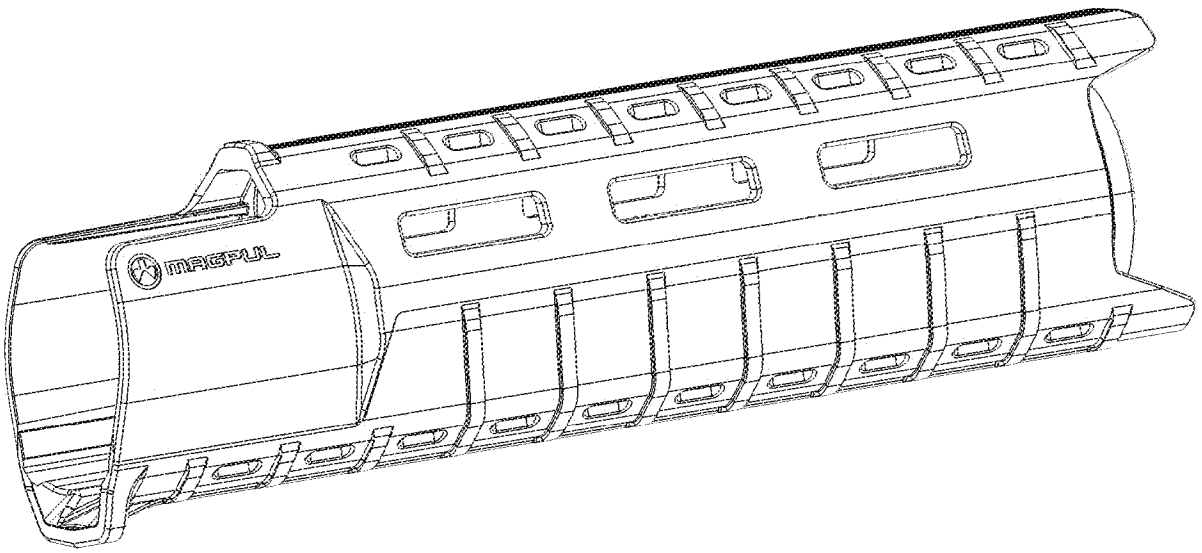
FIG. 20 is a perspective view of an embodiment of a handguard having three rows of elongated slots, one row on each side, and one row on the bottom.
Figure 21:
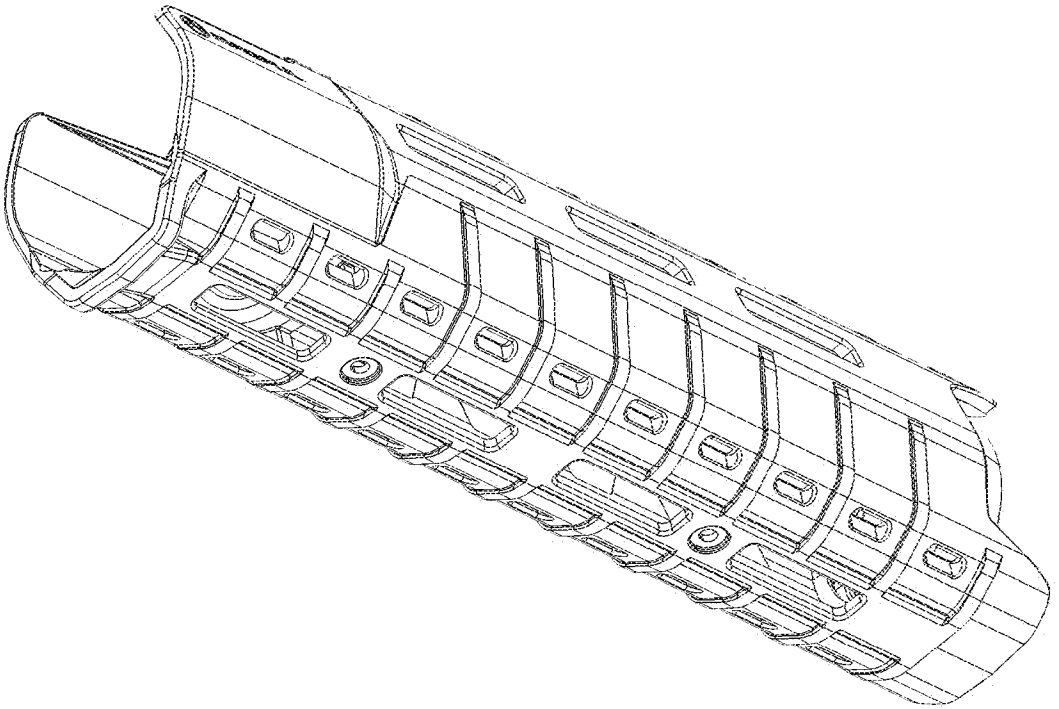
FIG. 21 is a perspective view of the handguard of FIG. 20 having three rows of elongated slots, one row on each side, and one row on the bottom.

FIGS. 14A and 14B show an embodiment of a second fastener (e.g., a nut) and an elongated slot where the second fastener is in an open position (top figure) and a closed or locked position (bottom figure). In an embodiment, the second fastener can be referred to as a T-nut due to its profile. FIGS. 15-19 illustrate further views of the second fastener seen in FIGS. 14A and 14B. The second fastener 1400 can include a first flange 1402, a second flange 1404 (that together can be referred to as an elongated lug), and an upper locking portion 1406. In an embodiment, the second fastener 1400 can be threaded so as to form a female half of a threaded screw-nut interface. The threading can define a central axis of the second fastener (identified with an "x" in a center of the second fastener 1400). The first and second flanges 1402, 1404 can extend away from the central axis in two directions where each flange 1402, 1404 can be symmetric to the other flange 1402, 1404. However, and as seen in subsequent embodiments (e.g., FIGS. 29-33), the flanges 1402, 1404 need not be symmetric. In some cases, the second fastener 1400 may only include a single flange. Each of the first and second flanges 1402, 1404 can have curved ends 1408, 1410, and in the illustrated embodiment, the curved ends 1408, 1410 are centered on the axis of the second fastener 1400. However, in other embodiments, the ends can include straight and curved portions (e.g., 24-33 and 48-55) or angled and curved portions.

A width of the second fastener 1400 is equal to or slightly smaller than a width of the elongated slot 1412 through which the second fastener 1400 is designed to pass at least partially through when in an open position. A length of the second fastener 1400 is greater than the width of the elongated slot 1412, such that when the second fastener 1400 is turned into a locked or closed position, the second fastener 1400 cannot be retracted through the elongated slot 1412. Instead, tightening of a complementary first fastener that threads through the second fastener 1400 causes the second fastener 1400 and the complementary first fastener to approach each other and thereby press a portion of a firearm accessory therebetween and lock a firearm accessory onto a firearm.

Figure 28:
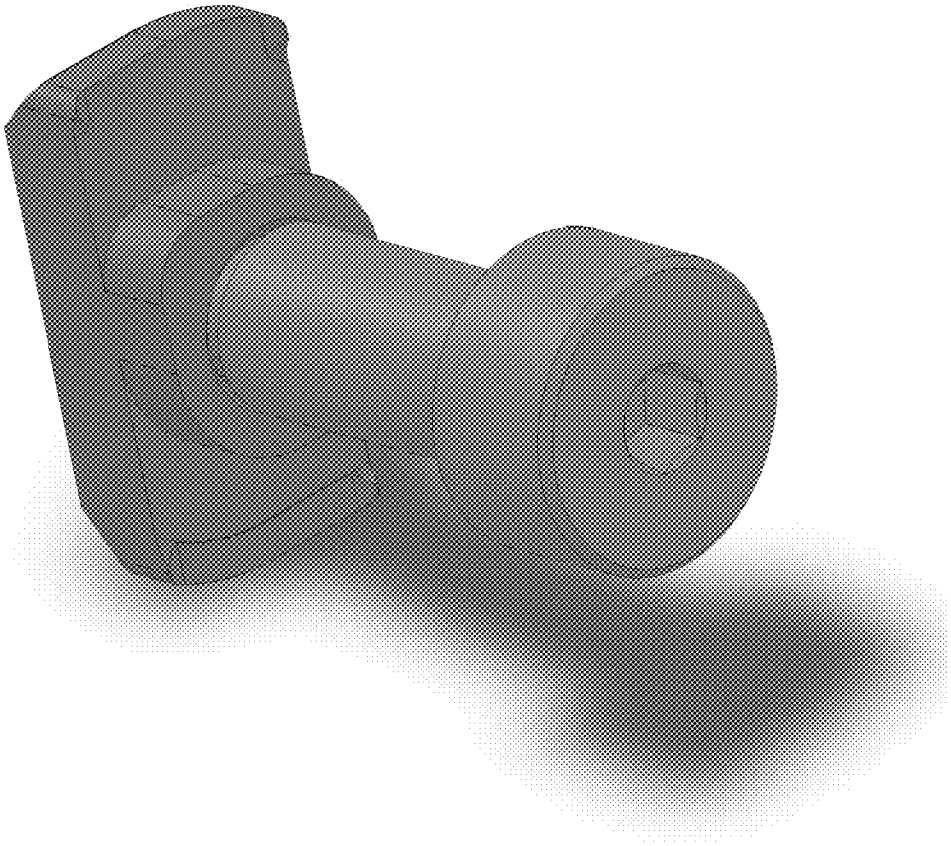
FIG. 28 is a perspective view of a first fastener partially threaded into the second fastener of FIG. 24.

The upper locking portion 1406 can surround a threaded female region that is designed to accept the threads of a complementary first fastener (see FIG. 28). When the complementary first fastener is rotated, the second fastener 1400 turns (clockwise in the illustration), but there is a preference for the second fastener 1400 to only turn between 45° and 135° since greater or lesser rotation would leave the second fastener 1400 in an unstable position where it could exit the elongated slot 1412. Thus, the upper locking portion 1406 can have up to four straight edges 1420, 1422, 1424, 1426 roughly opposing each other and each separated by one of four curved or arced edges 1430, 1432, 1434, 1436. Two of the curved or arced edges 1430, 1434 can have a first radius of curvature and two of the curved or arced edges 1432, 1436 can have a second radius. The straight edges 1420, 1422, 1424, 1426 can be arranged at 90° angles to each other, although in other configurations the straight edges 1420, 1422, 1424, 1426 could be arranged in a parallelogram with curved edges, such that angles between the straight edges 1420, 1422, 1424, 1426 are acute and oblique. In this way, the upper locking portion 1406 can pivot to a closed position (lower image) and then back to its open position (upper image), and is prevented from further rotation in either direction. In particular, the second fastener 1400 can only rotate where a curved edge 1430, 1434 is passing tangential to an edge of the elongated slot 1412. Once either of the straight edges 1420, 1422, 1424, 1426 becomes flush with an edge of the elongated slot 1412, no further rotation in the same direction is possible, thereby preventing the second fastener 1400 from rotating past an open or closed position, but enabling rotation between the open and closed positions. The curved edges 1430, 1434 can have a radius of curvature that is equal to or slightly less than half the width of the elongated slot 1412, and the radius of curvature can be centered in a center of the second fastener 1400. The radius of curvature of the curved edges 1432, 1436 can be greater than half the width of the elongated slot 1412, and greater than the radius of curvature of the arced or curved edges 1430, 1434 and this prevents the second fastener 1400 from turning past the open or closed positions shown in FIGS. 14A and 14B, respectively.

One of skill in the art will recognize that the orientation of the upper locking portion can be reversed such that rotation from an open to closed position occurs via counterclockwise pivoting of the second fastener 1400.

The various embodiments of fasteners shown throughout the figures illustrates that the effect of the two curved or arced edges 1432, 1436 can be achieved with various radii of curvature, even those so small that they can be considered corners or sharp edges (e.g., FIG. 33-36). In some cases a single curved or arced edge can achieve the same effect as both of the curved or arced edges 1432, 1436 (e.g., FIGS. 29-33).

Returning to FIGS. 7-14B, the firearm accessory 810 is a modular Picatinny rail section that can be mounted to a firearm and then used to mount other accessories that can couple to the Picatinny rail section. Other firearm accessories, such as lights, scopes, laser sights, vertical grips, grenade launchers, and others can be mounted in similar fashion.

One or more second fasteners can be inserted and locked through a single elongated slot. When two or more complementary fasteners are inserted and mated through a single elongated slot, any number of the two or more complementary fasteners can be coupled to a single firearm accessory, or alternatively, multiple firearm accessories can be coupled to at least one of the two or more complementary fasteners that are inserted at least partially through a single elongated slot. In some embodiments, a single firearm accessory can mount via two or more elongated slots as illustrated in FIGS. 7-13.

The firearm itself can include any number of elongated slots 812, 814, 816 arranged in various locations on the firearm. For instance, elongated slots can be arranged on a handguard of a firearm as illustrated in FIGS. 1-6 and 20-21. The handguards illustrated in FIGS. 1-6 and 20-21 include three elongated slots on an upper left side of the handguards, three elongated slots on a right side of the handguards, and four elongated slots on a bottom of the handguards. Although these elongated slots are all of similar or identical size, in other embodiments, a plurality of elongated slots on a firearm can have one or more different lengths (the longer dimension of an elongated slot). The elongated slots may have a consistent or constant width (the smaller dimension of an elongated slot) such that a consistent size of second fastener can pass at least partially through all elongated slots and lock via a rotation of between 45° and 135°.

As illustrated throughout this disclosure, elongated slots can be arranged in rows such that the longer dimension of each elongated slot is aligned with the longer dimension of at least one other elongated slot. These arrangements of elongated slots can be referred to as rows of elongated slots. FIGS. 7-13 show an embodiment of a row of elongated slots and the handguards of FIGS. 1-6 and 20-21 have three rows of elongated slots.

The elongated slots not only function as mounting points, but also aid in dissipating heat from the barrel. The use of elongated slots as compared to Picatinny rails or KEYMOD apertures enables greater flexibility in positioning the firearm accessories than is possible in the prior art and is less complex to manufacture, more amenable to polymeric material manufacturing, can be formed more consistently and with tighter tolerances, and can be manufactured in less time. The elongated slots are also less likely to snag, actually decrease a weight of a firearm, and are comfortable to grip.

Figure 34A:
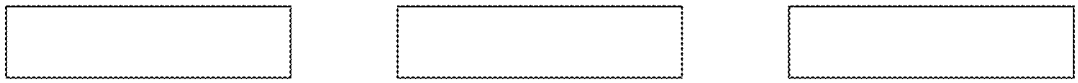
FIGS. 34A, 34B, and 34C show three different rows of elongated slots showing three different embodiments of elongated slot styles.
Figure 34B:
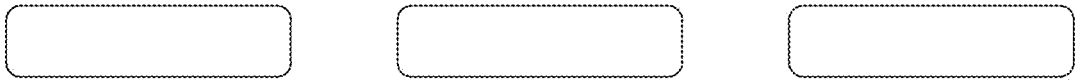
Figure 34C:
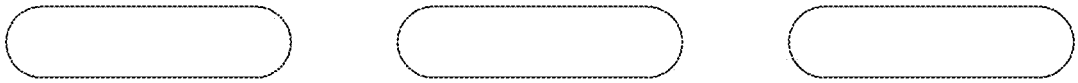

The elongated slots can take a number of different forms. For instance, FIGS. 34A, 34B, and 34C illustrate three embodiments of elongated slots. FIG. 34A shows a row of elongated slots having square corners. FIGS. 34B and 34C show a row of elongated slots having beveled corners where the radius of curvature of these bevels is greater in FIG. 34C. In FIG. 34C the radius of curvature is so great that the elongated slots can be described as each having semicircular ends. If one or more slot protrusions are used on a firearm accessory, each slot protrusion can have opposing beveled edges that are beveled or shaped to match the corners or ends of the elongated slots. For instance, if the elongated slot has beveled corners, then the slot protrusions (e.g., 820, 822, 824) may also have the same or a slightly smaller beveled radius. This can be seen in FIGS. 8, 9 and 23A and 23B where the slot protrusions 820, 824, 920, 924, 2300 appear to fit flush with beveled corners of an elongated slot 2320 or elongated slots 814, 816, 914, 916.

Figure 22:
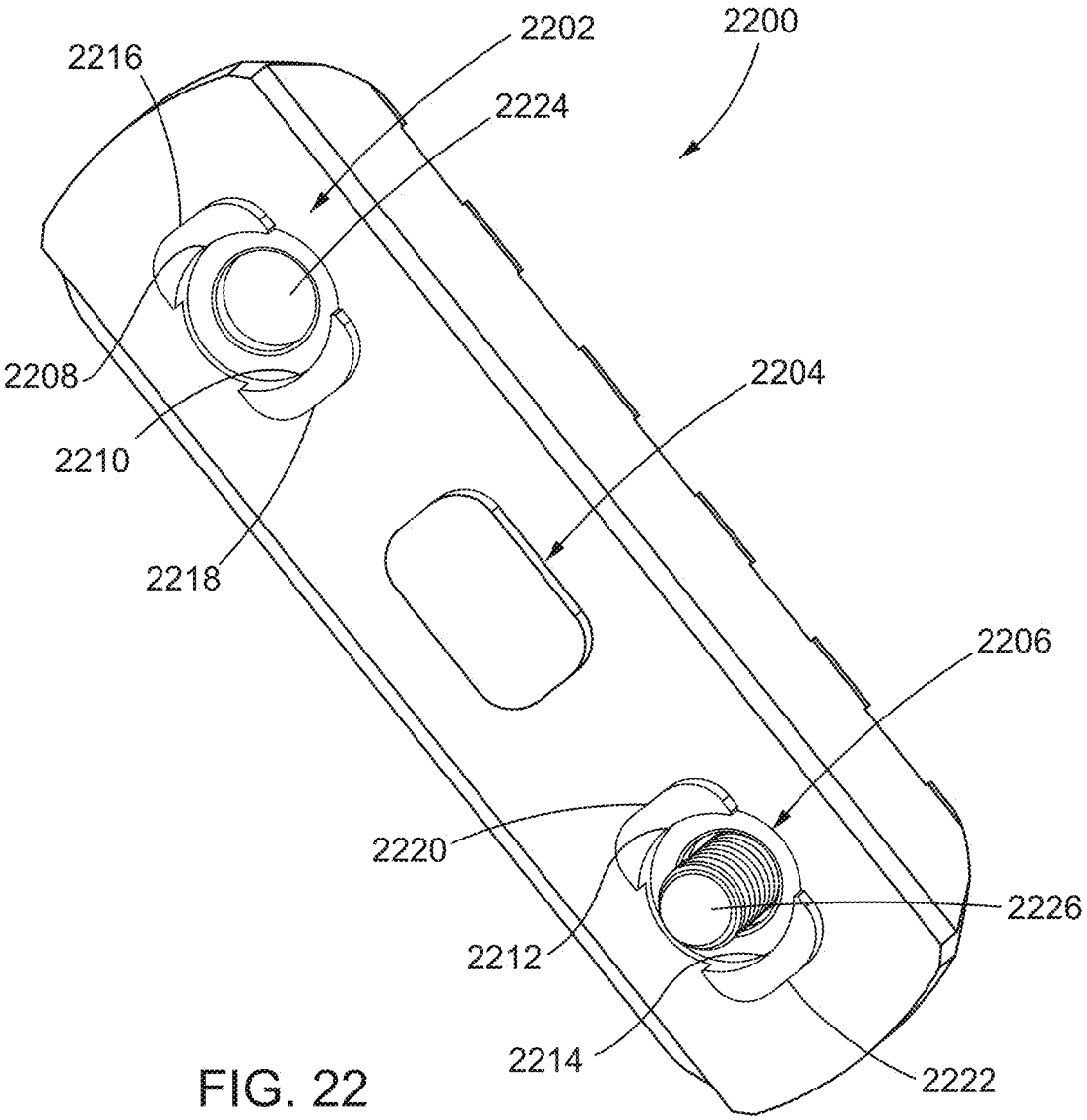
FIG. 22 is a bottom perspective view of a firearm accessory having three slot protrusions.
Figure 23A:
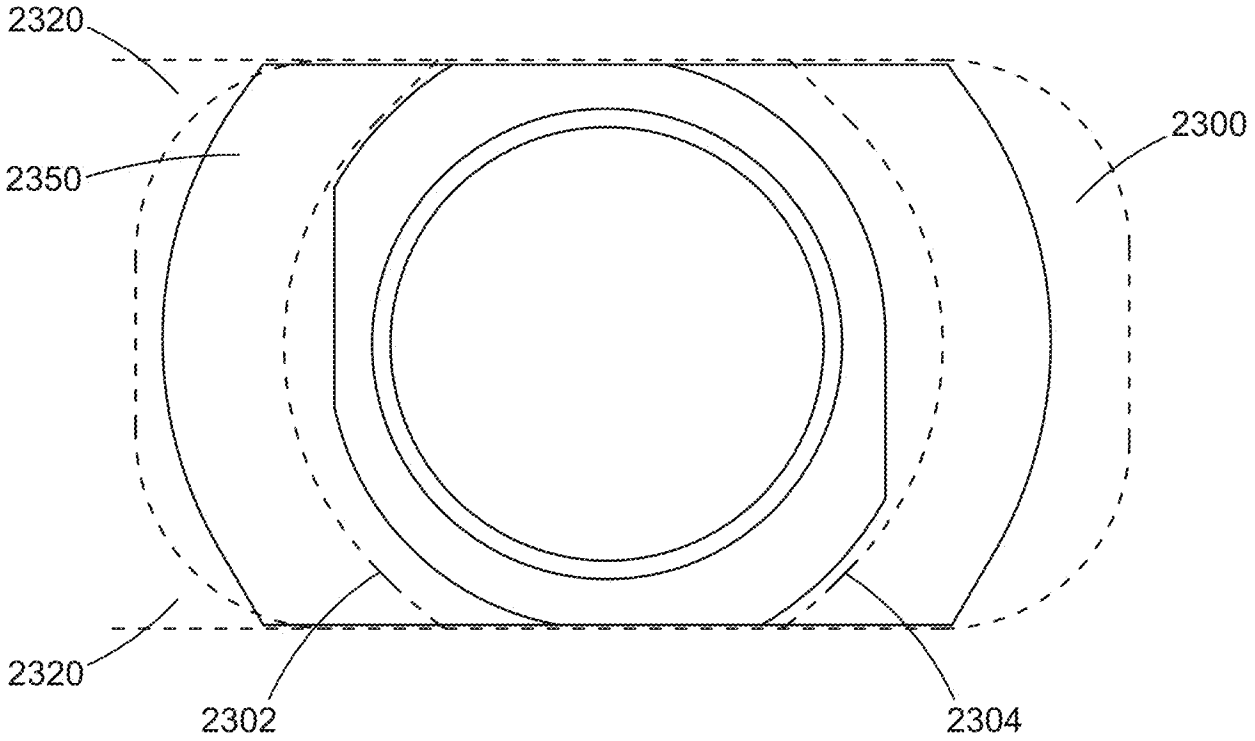
FIGS. 23A and B show two top views of an embodiment of a second fastener relative to an elongated slot and further relative to a slot protrusion, for an open and closed position of the second fastener.
Figure 23B:
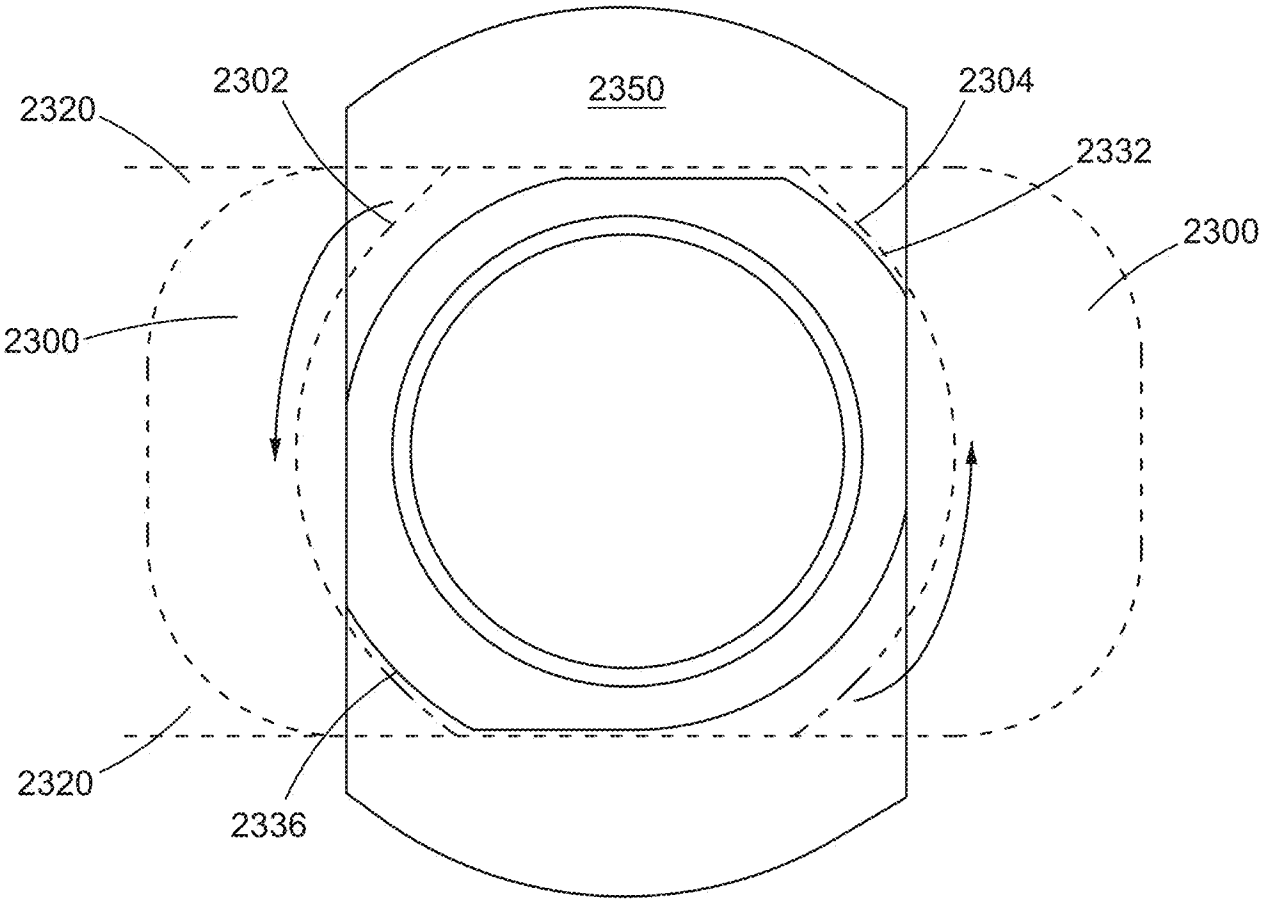
Figure 24:
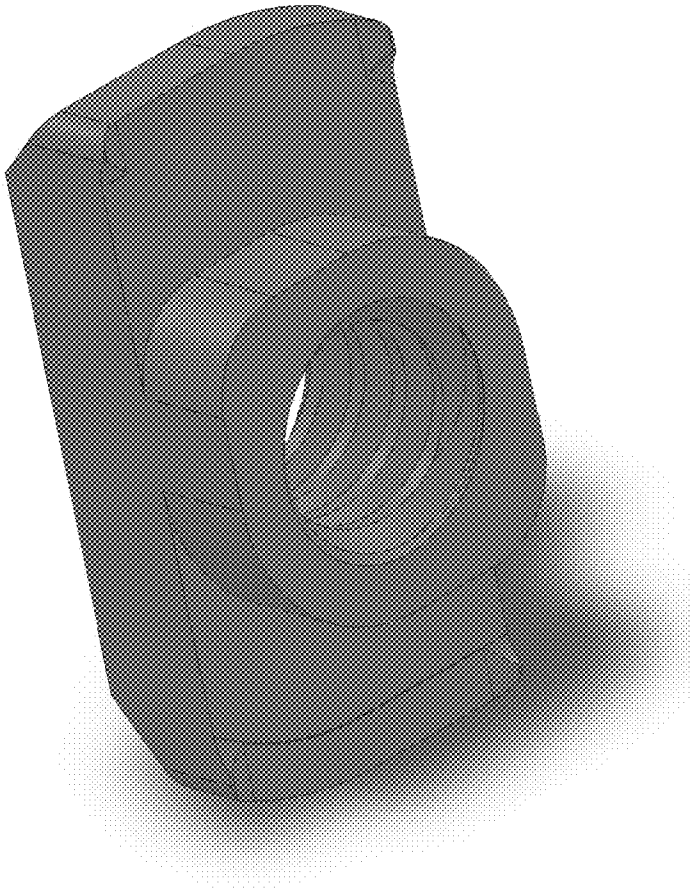
FIG. 24 is a perspective view of a second fastener according to an embodiment of this disclosure.
Figure 25:
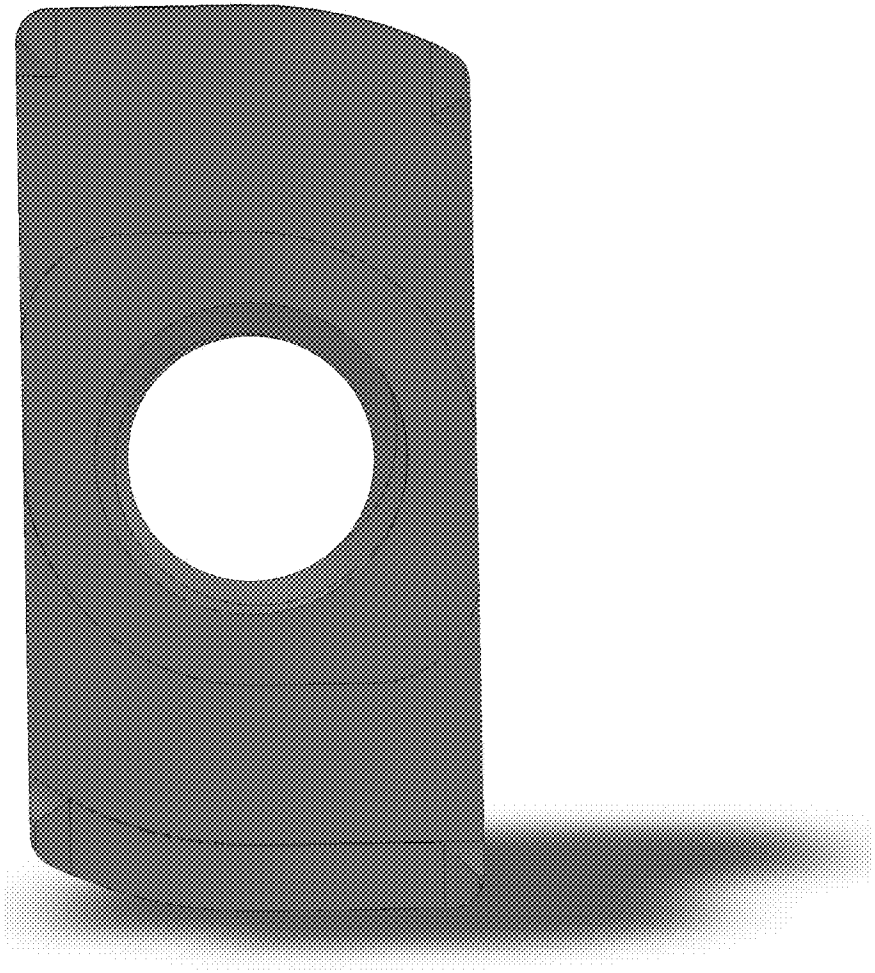
FIG. 25 is a top plan view of the second fastener of FIG. 24.
Figure 26:
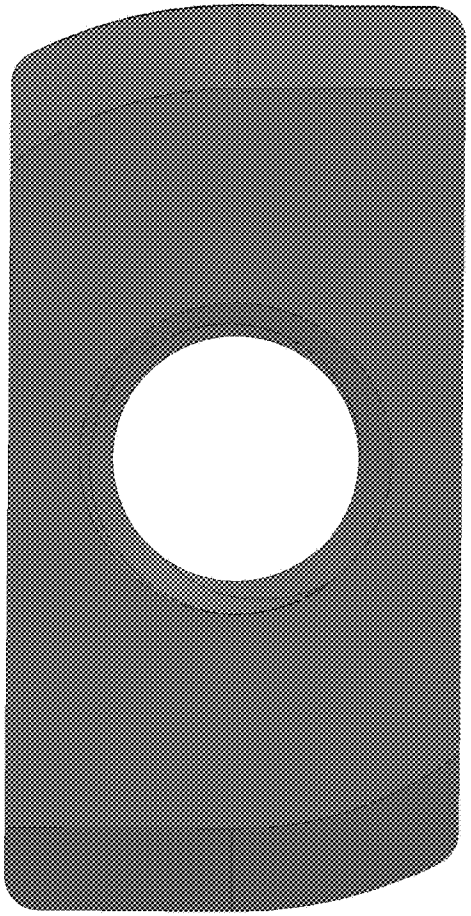
FIG. 26 is a bottom plan view of the second fastener of FIG. 24.
Figure 27:
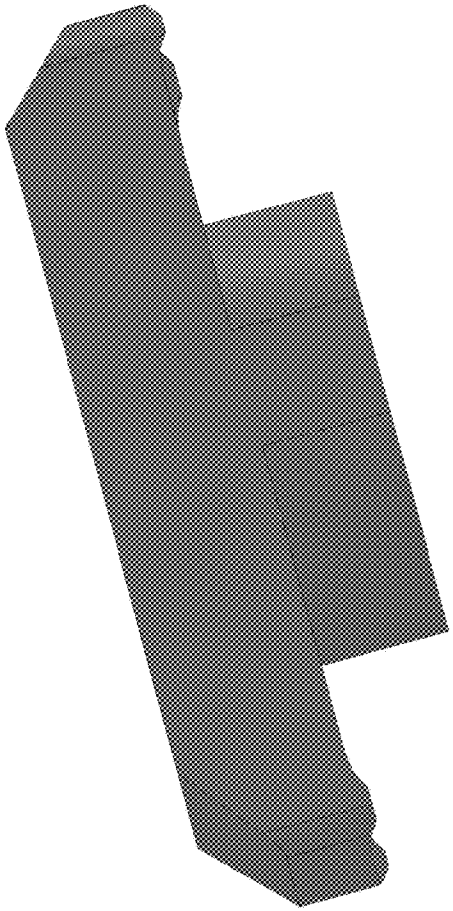
FIG. 27 is a side elevation view of the second fastener of FIG. 24.

FIG. 22 illustrates an embodiment of slot protrusions 2202, 2204, 2206 extending from a bottom of a firearm accessory 2200. Slot protrusions can also be seen in FIGS. 8, 9, 11, and 23A and 23B. A slot protrusion is an extension of the firearm accessory, sometimes surrounding a through-hole for a first elongated fastener that fits into an elongated slot and surrounds an upper locking portion of a second fastener. A slot protrusion has a width that is the same or slightly smaller than a width of an elongated slot thus enabling the slot protrusion to fit into an elongated slot but preventing the firearm accessory from rotating (even before the first elongated fastener and the second fastener are coupled, let alone tightened). A slot protrusion can have four beveled corners such that the slot protrusion can fit snuggly against an end of an elongated slot, where the elongated slot also has beveled corners. As such, the radius of curvature of the beveled corners of the slot protrusion can be the same or slightly smaller than a radius of curvature of the beveled corners of the elongated slots. The illustrated slot protrusions 2202, 2204 can each be split into a first and second half, each half having an inner arc 2208, 2210, 2212, 2214 and beveled ends 2216, 2218, 2220, 2222. Each inner arc 2208, 2210, 2212, 2214 (2302, 2304, in FIG. 23A and FIG. 23B) can be symmetric and have the same radius of curvature. As illustrated, the radius of curvature of the inner arcs 2208, 2210, 2212, 2214 is greater than half a width of the elongated slot 2620 and as seen in FIG. 23, is designed to match or create a substantially flush fit with the curved or arced edges 2332, 2336 of the upper locking portion 2350 of the second fastener 2300. Further, the radius of curvature of the inner arcs 2208, 2210, 2212, 2214 can be equal to or slightly greater than a radius of curvature of the curved or arced edges 2332, 2336 of an upper locking portion of the second fastener 2350. This enables the second fastener 2350 to rotate such that the upper locking portion does not impinge on the first and third slot protrusions 2202, 2206. The second slot protrusion 2204 does not include inner arcs and instead is a solid rectangular shape having beveled corners. The first and third slot protrusions 2202, 2206 are arranged around through-holes, such as through-hole 2224, and are sized to allow a first elongated fastener (e.g., 2226) to pass through the through-holes.

FIGS. 24-27 show various views of an embodiment of a second fastener (e.g., a nut) and FIG. 28 shows a view of the second fastener with a first elongated fastener (e.g., a screw). The second fastener includes flanges and a raised locking portion similarly to prior embodiments described herein. However, a top surface of the flanges includes sharp protrusions extending up from each of four corners of a top surface of the flanges. The two flanges are asymmetric with each having opposite ends comprising a straight edge and a curved corner. This embodiment also include chamfers on a bottom outer edge of the flanges as best seen in the side elevation of FIG. 27. Other variations of the second fastener can be seen in FIGS. 23A-33 and 48-55.

Figure 29:
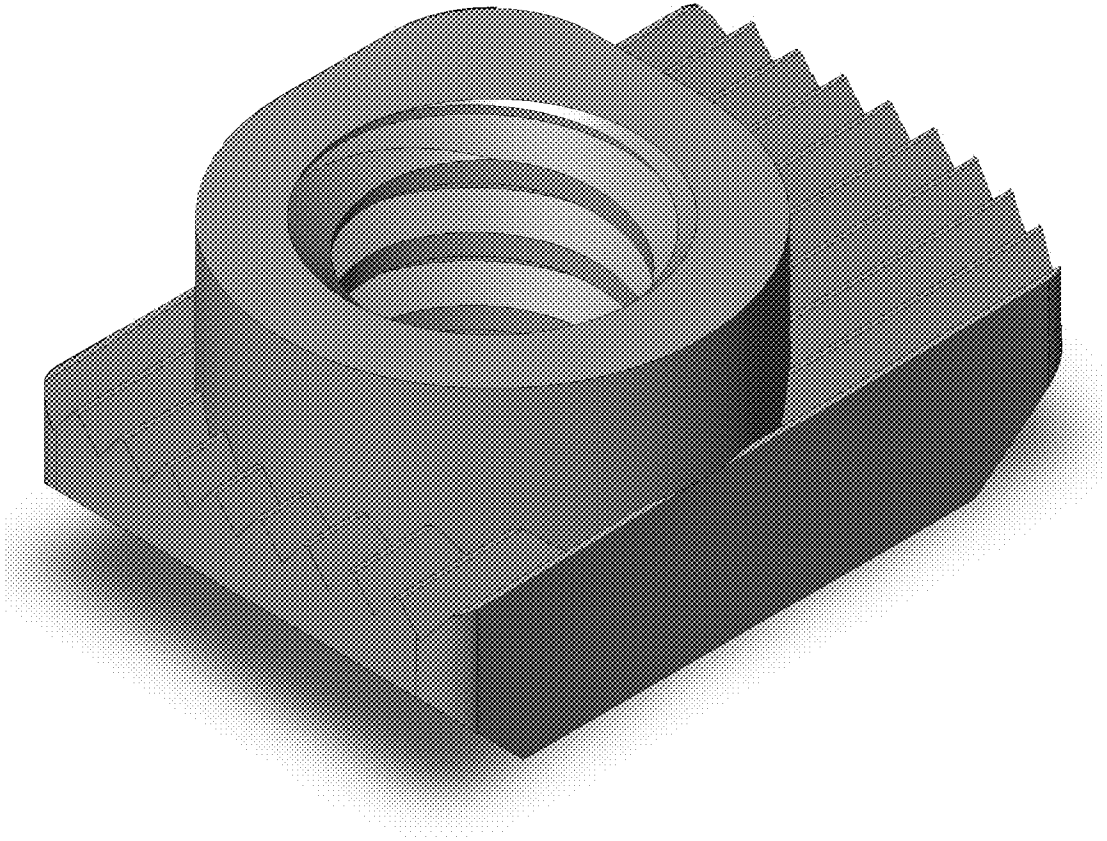
FIG. 29 is a perspective view of a second fastener according to an embodiment of this disclosure.
Figure 30:
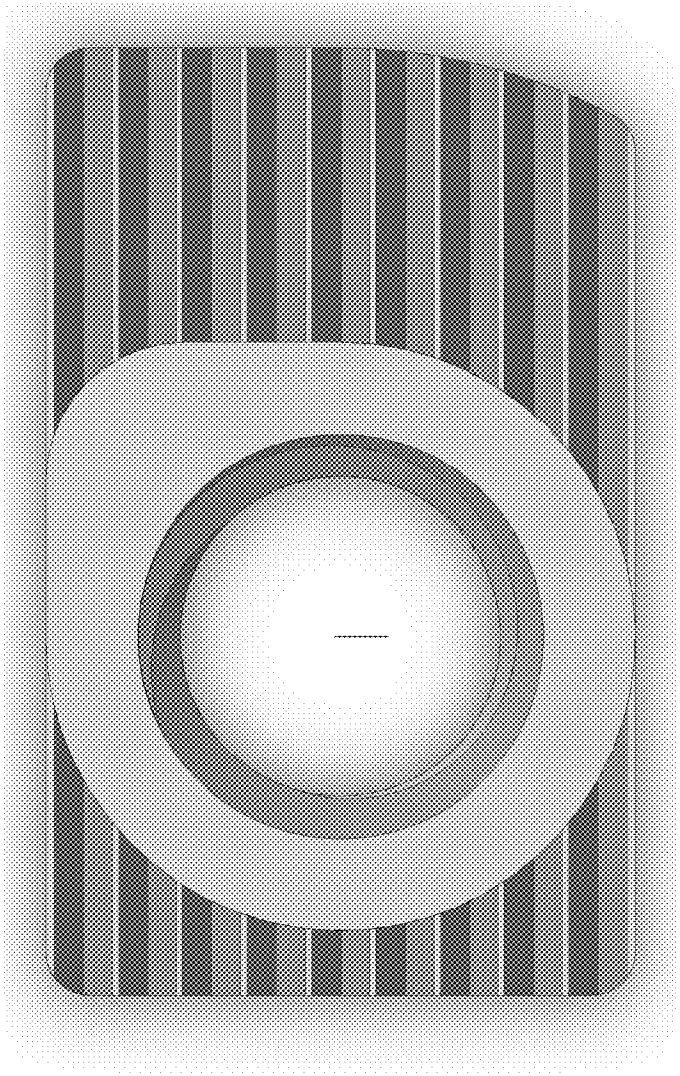
FIG. 30 is a top plan view of the second fastener of FIG. 29.
Figure 31:
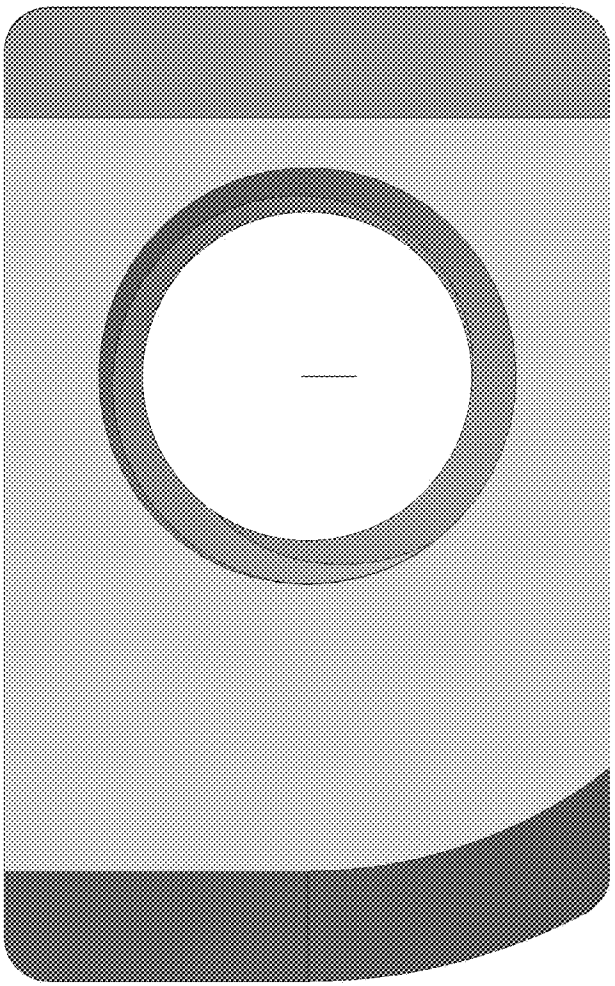
FIG. 31 is a bottom plan view of the second fastener of FIG. 29.
Figure 32:
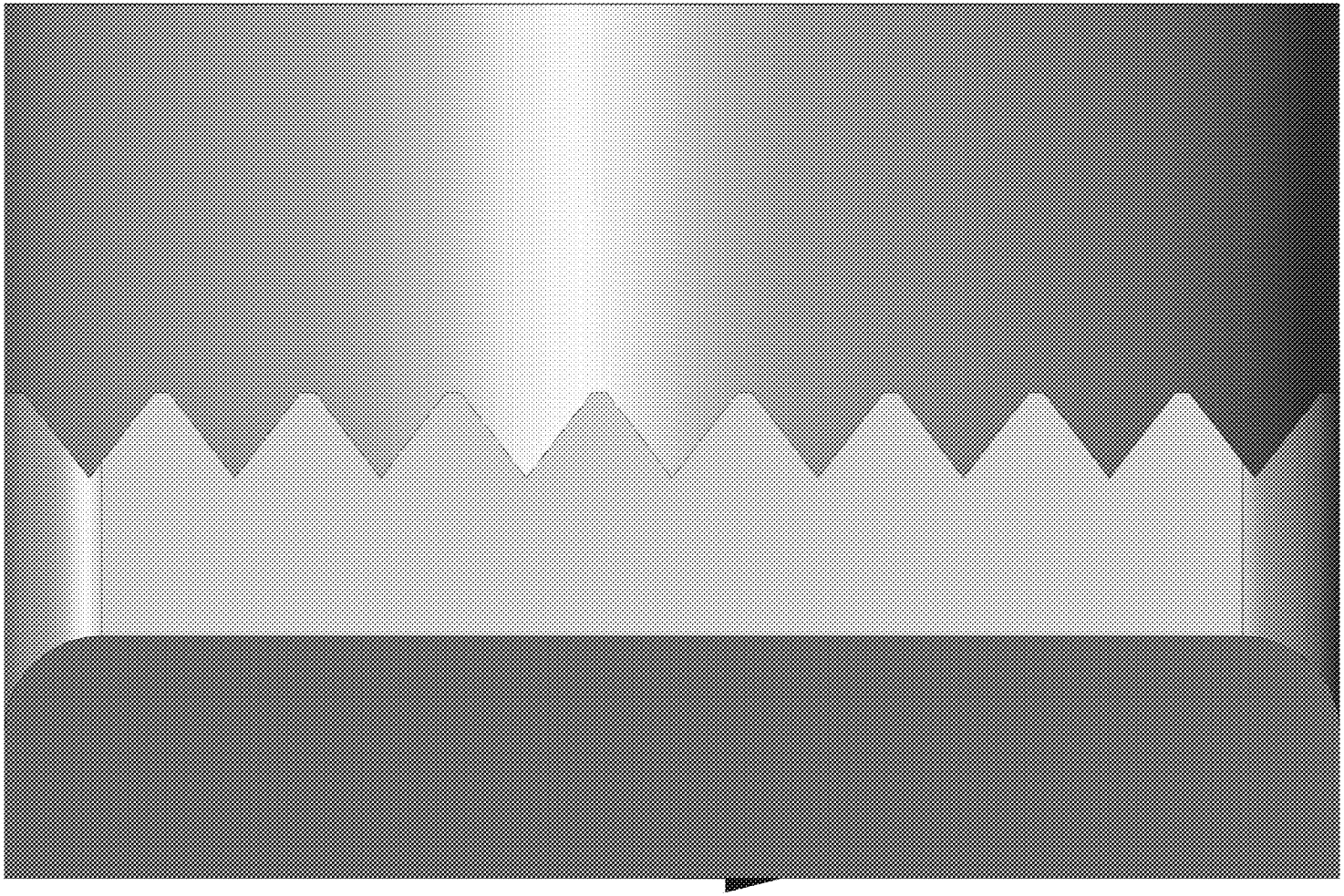
FIG. 32 is a front elevation view of the second fastener of FIG. 29.
Figure 33:
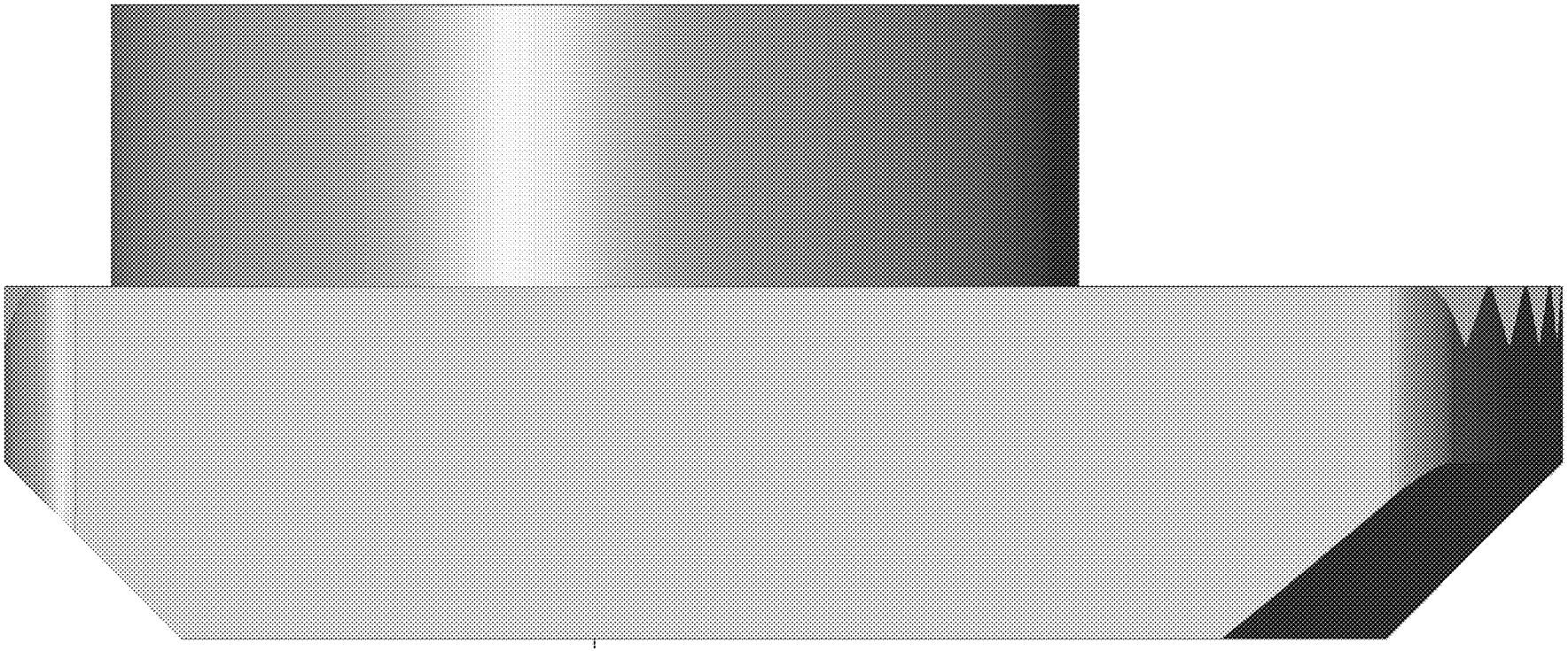
FIG. 33 is a side elevation view of the second fastener of FIG. 29.

FIG. 29 illustrates a perspective view of an embodiment of the second fastener. Here the second fastener has an upper locking portion that is primarily circular with a pair of straight edges bounding a single curved edge such that the upper locking portion includes a single portion that extends beyond a radius of the majority of the upper locking portion (where the radius is less than or equal to one half a width of the elongated slot). Typically, the second fastener includes at least two regions that extend beyond this radius (e.g., see FIGS. 14A and 14B). However, only a single such protrusion is needed in order to prevent the second fastener from rotating past a closed position, and thus FIG. 29 shows that either one or two such protrusions can be implemented.

FIGS. 30-33 show alternative views of the second fastener of FIG. 29.

Figure 35A:
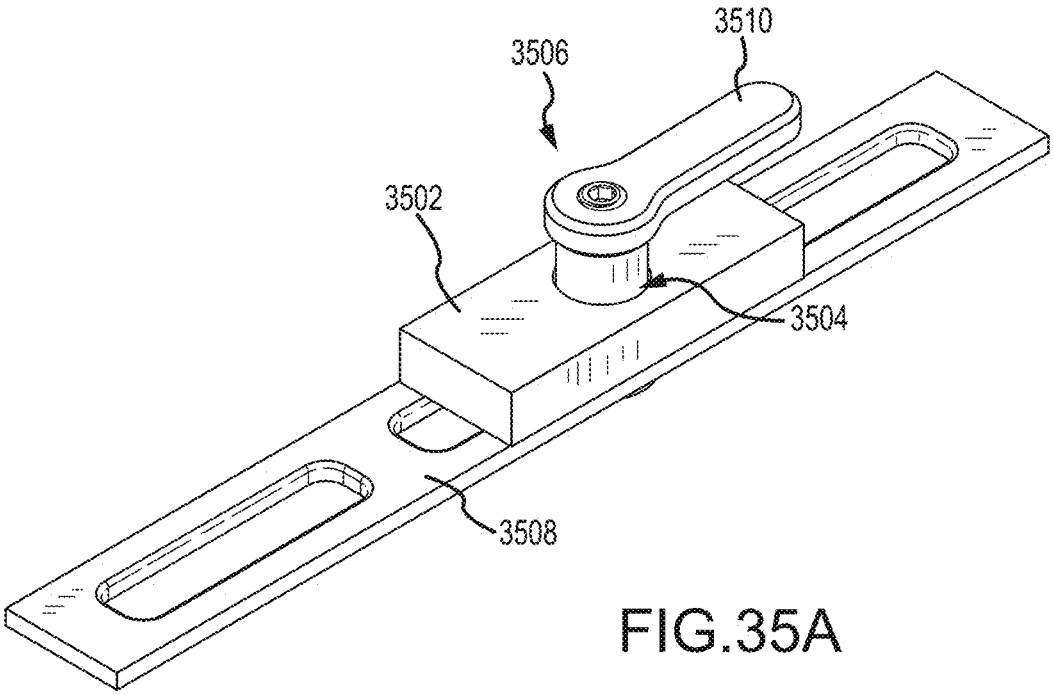
FIG. 35A shows is a perspective view of another embodiment of a firearm accessory mounting interface including a firearm accessory mounted to a portion of a firearm via one or more pairs of first and second mated fasteners.
Figure 35B:
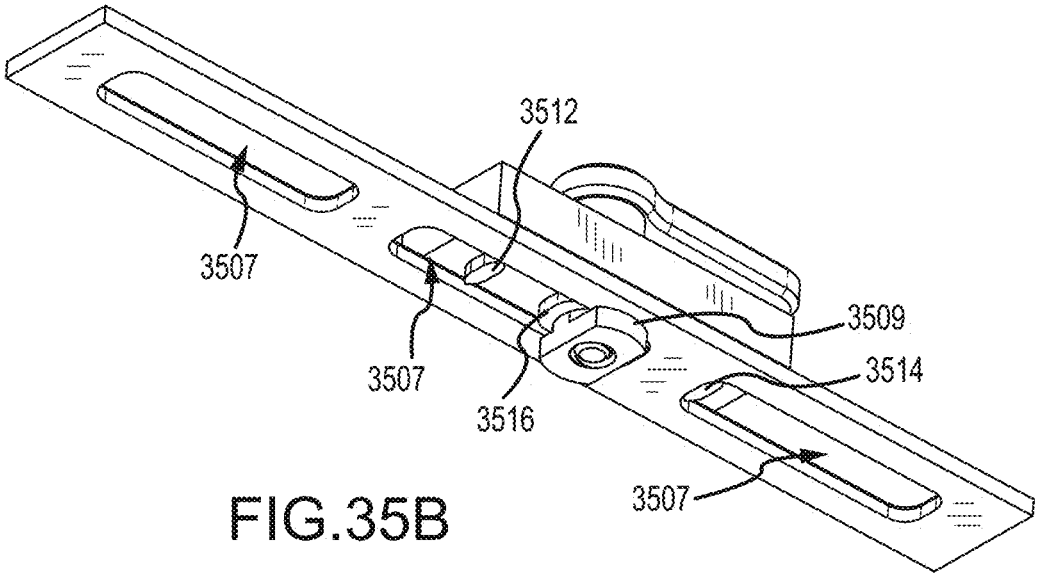
FIG. 35B shows another perspective view of the embodiment illustrated in FIG. 36A.

FIGS. 35A and 35B illustrate perspective views of an embodiment of a firearm accessory mounting interface including a firearm accessory mounted to a portion of a firearm via one or more pairs of first and second mated fasteners. The firearm accessory 3502 can include one or more through holes 3504 through which a first fastener 3506 can pass. A second fastener 3509 can mate to the first fastener 3506, and can also pass at least partially through an elongated slot 3507 of a portion of a firearm 3508. The portion of the firearm 3508 can include one or more such slots. The first fastener 3506 can include one or more means for rotating the first fastener 3506. The second fastener 3509 can be embodied as a nut as shown, or any other component that can mate to the first fastener 3506, especially via a threaded coupling. As illustrated, both the first and second fasteners 3506, 3509 are threaded and mate with each other via rotation.

The first fastener 3506 can include a handle 3510 as well as a hex-head (or Allen) aperture for receiving a male end of a hex-head wrench. The handle 3510 can be used to rotate the first fastener 3506 until the second Fastener 3509 reaches a closed position, after which point, the handle 3510 can be used to continue rotating the first fastener 3506, while the second fastener 3509 remains fixed in a closed position. In this way, the first and second fasteners 3506, 3509 can be drawn closer together thereby squeezing the firearm accessory 3502 and the portion of the firearm 3508 between the first and second fasteners 3506, 3509. After sufficient tightening via this rotation, the firearm accessory 3502 can be considered to be removably fixed to the portion of the firearm 3508.

The firearm accessory 3502 can include one or more slot protrusions 3512, 3514 that extend from a bottom of the firearm accessory 3502. In this embodiment, the slot protrusions 3512, 3514 are shaped to fit into the one or more elongated slots 3507 and can have a width less than or equal to a width of the one or more elongated slots 3507. The slot protrusions 3512, 3514 can have a length less than their width as shown. The slot protrusions 3512, 3514 can also be shaped to fit flush with ends of the one or more elongated slots 3507. For instance, each slot protrusion 3512, 3514 can have four beveled corners such that the slot protrusion 3512, 3514 can fit snuggly against an end of an elongated slot 3507, where the elongated slot 3507 also has beveled corners. The radius of curvature of the beveled corners of the slot protrusion 3512, 3514 can be the same or slightly smaller than a radius of curvature of the beveled corners of the elongated slots 3507. Where the elongated slots 3507 do not have beveled corners, for instance they can have squared corners, the edges of the slot protrusions 3512, 3514 can be shaped to fit these corners, for instance the slot protrusions 3512, 3514 can have squared edges. When the one or more slot protrusions 3507 are inserted through at least a portion of the one or more elongated slots 3507, they add stability and alignment accuracy to the interface between the firearm accessory 3502 and the portion of the firearm 3508.

An alternative form of the slot protrusion is illustrated as 3516 and surrounds the first fastener 3506 and part of the second fastener 3509 when the first and second fasteners 3506, 3509 are at least partially passed through one of the elongated slots 3507. The alternative slot protrusion 3516 has an inner diameter large enough to enable the second fastener 3509 to pass through and to rotate therein. A distance between the alternative form of the slot protrusion 3516 and any one or more of the slot protrusions 3512, 3514 can be configured such that when these slot protrusions 3512, 3514, 3516 are inserted at least partially through the one or more elongated slots 3507, the firearm accessory 3502 is prevented from rotating and also prevented from lateral movement both in a direction of a longitudinal axis of the one or more elongated slots 3507 and perpendicular to the longitudinal axis of the one or more elongated slots 3507.

The portion of the firearm 3508 can include at least a handguard, a receiver, a stock, or a buttstock, to name a few non-limiting examples. The firearm accessory 3502 can include a rail, a rail for mounting accessories, a lighting device, a sighting device (e.g., a scope), a sling mount, a grip (e.g., a pistol grip or angled grip), a handguard cover, a cover panel, a bipod mount, or an adapter (e.g., a MOE to M-LOK adapter or an M-LOK to Picatinny adapter), to name a few non-limiting examples.

Figure 36A:
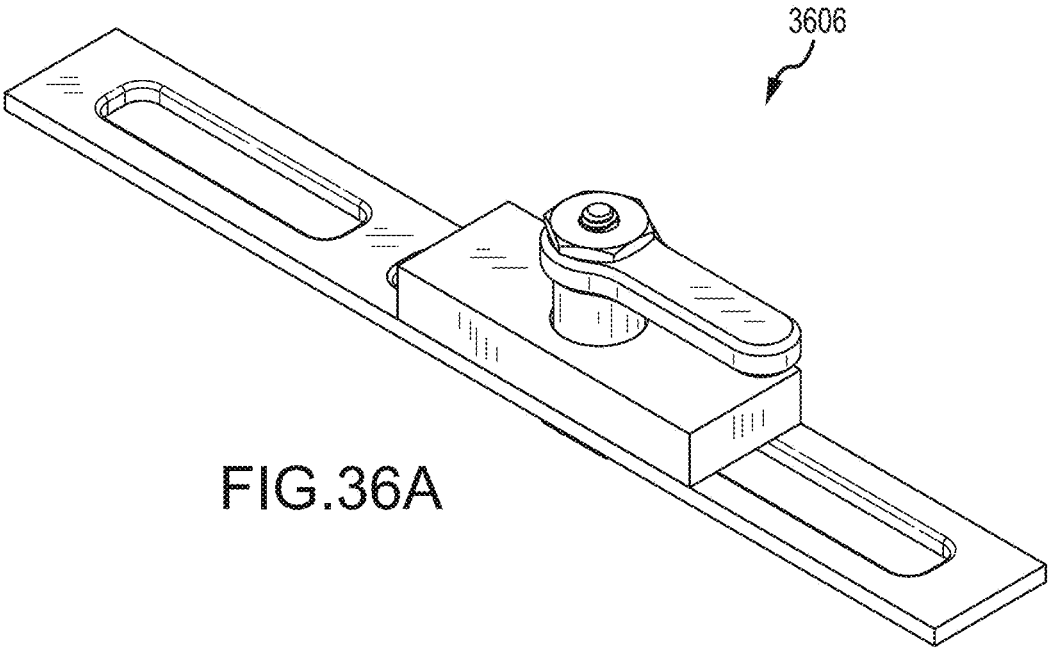
FIG. 36A shows a perspective view of another embodiment of a firearm accessory mounting interface including a firearm accessory mounted to a portion of a firearm via one or more pairs of first and second mated fasteners.
Figure 36B:
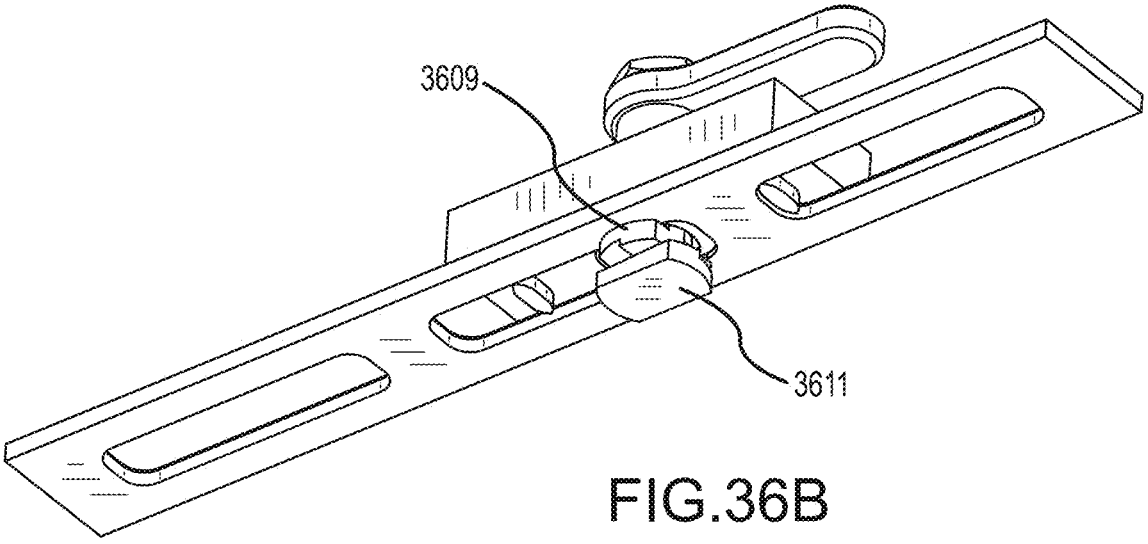
FIG. 36B shows another perspective view of the embodiment illustrated in FIG. 36A.

FIGS. 36A and 36B illustrate perspective views of another embodiment of a firearm accessory mounting interface including a firearm accessory mounted to a portion of a firearm via one or more pairs of first and second mated fasteners. In this embodiment, a first fastener 3606 extends through the second fastener 3609 and includes a flanged end 3611 rotatably arranged beneath the second fastener 3609. This flanged end 3611 and a bottom of the second fastener 3609 are notched and these notches can engage to prevent relative rotation between the flanged end 3611 and the second fastener 3609.

Figure 37A:
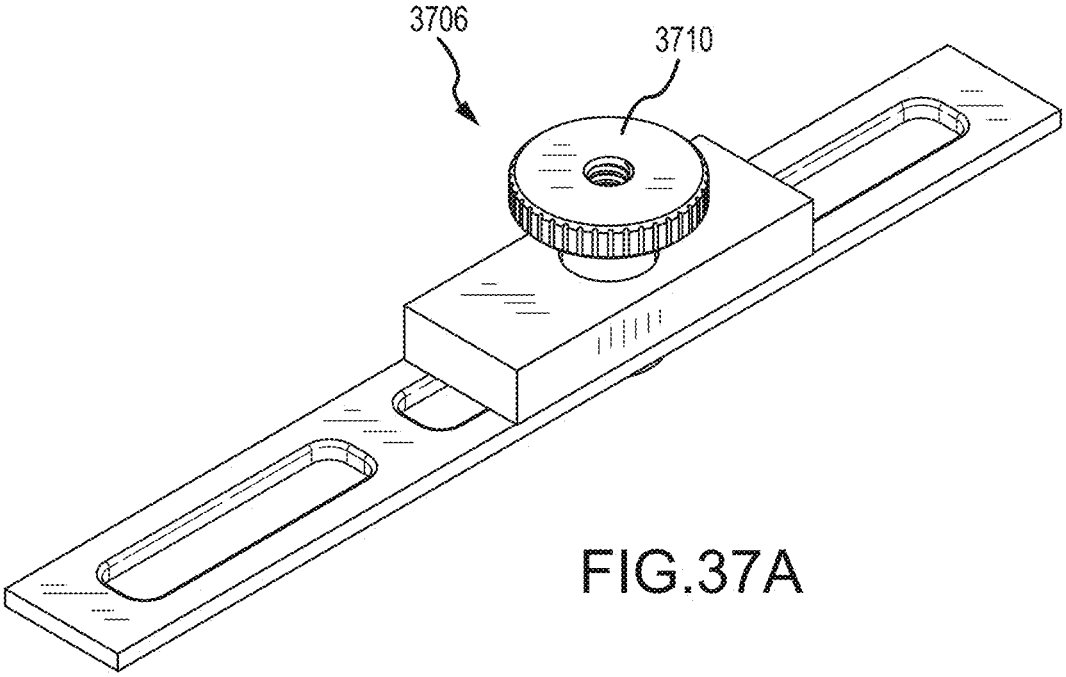
FIG. 37A shows a perspective view of another embodiment of a firearm accessory mounting interface including a firearm accessory mounted to a portion of a firearm via one or more pairs of first and second mated fasteners.
Figure 37B:
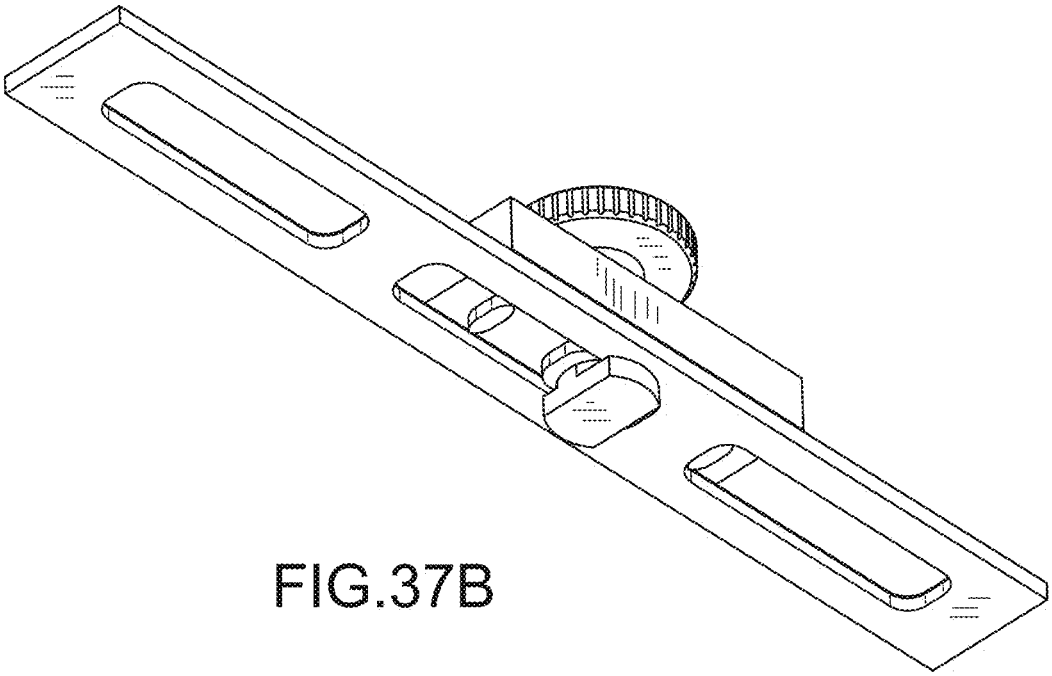
FIG. 37B shows another perspective view of the embodiment illustrated in FIG. 37A.

FIGS. 37A and 37B illustrate perspective views of another embodiment of a firearm accessory mounting interface including a firearm accessory mounted to a portion of a firearm via one or more pairs of first and second mated fasteners. This embodiment is very similar to that illustrated in FIGS. 35A and 35B, but with the handle 3510 being replaced with a disc-shaped knob 3710 that can be gripped and used to rotate the first fastener 3706. All other portions of this embodiment are the same as that illustrated in FIGS. 35A and 35B.

Figure 38A:
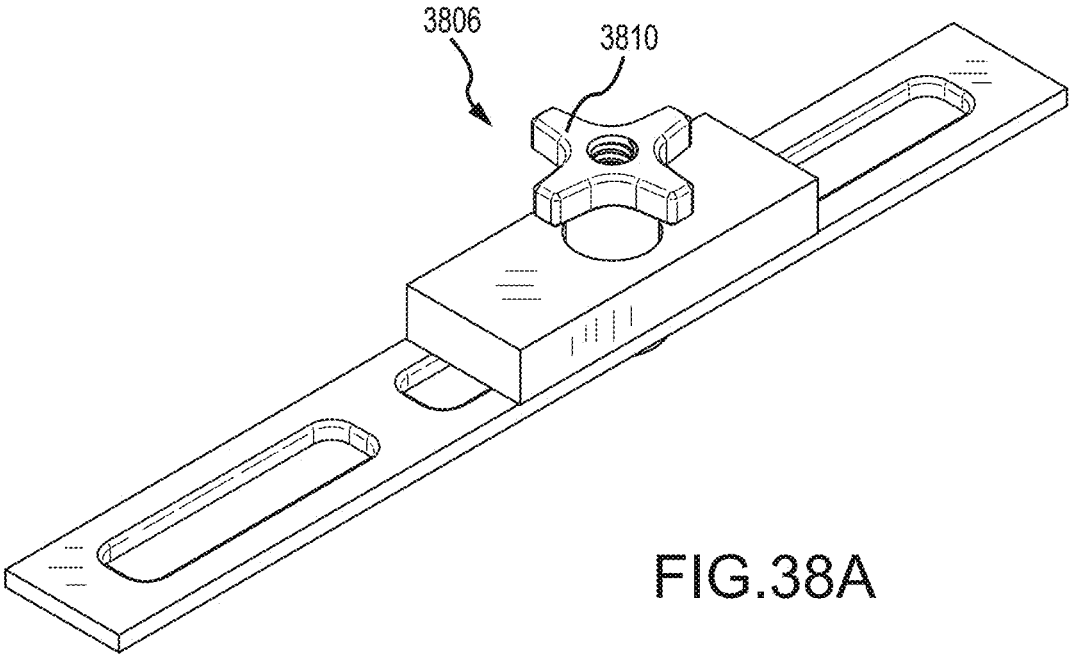
FIG. 38A shows a perspective view of another embodiment of a firearm accessory mounting interface including a firearm accessory mounted to a portion of a firearm via one or more pairs of first and second mated fasteners.
Figure 38B:
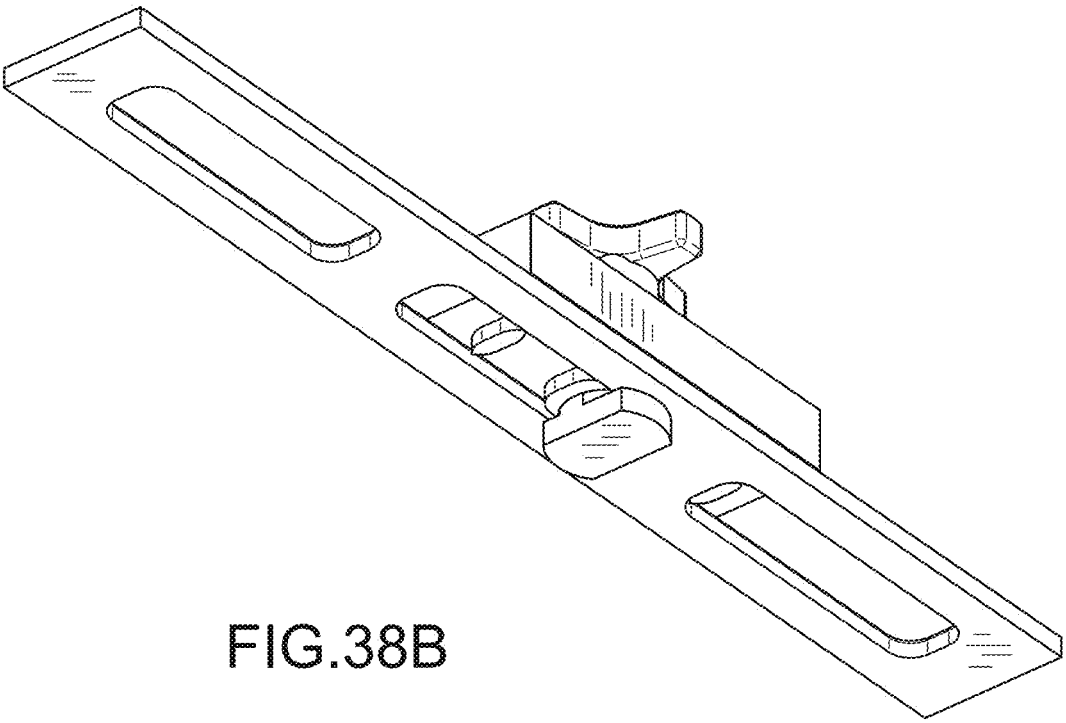
FIG. 38B shows another perspective view of the embodiment illustrated in FIG. 38A.

FIGS. 38A and 38B illustrate perspective views of another embodiment of a firearm accessory mounting interface including a firearm accessory mounted to a portion of a firearm via one or more pairs of first and second mated fasteners. This embodiment is very similar to that illustrated in FIGS. 35A, 35B, 37A, and 37B, but with the handle 3510, or the disc-shaped knob 3710 being replaced with a spoked handle 3810 that can be gripped and used to rotate the first fastener 3806. All other portions of this embodiment are the same as that illustrated in FIGS. 35A, 35B, 37A, and 37B.

Figure 39A:
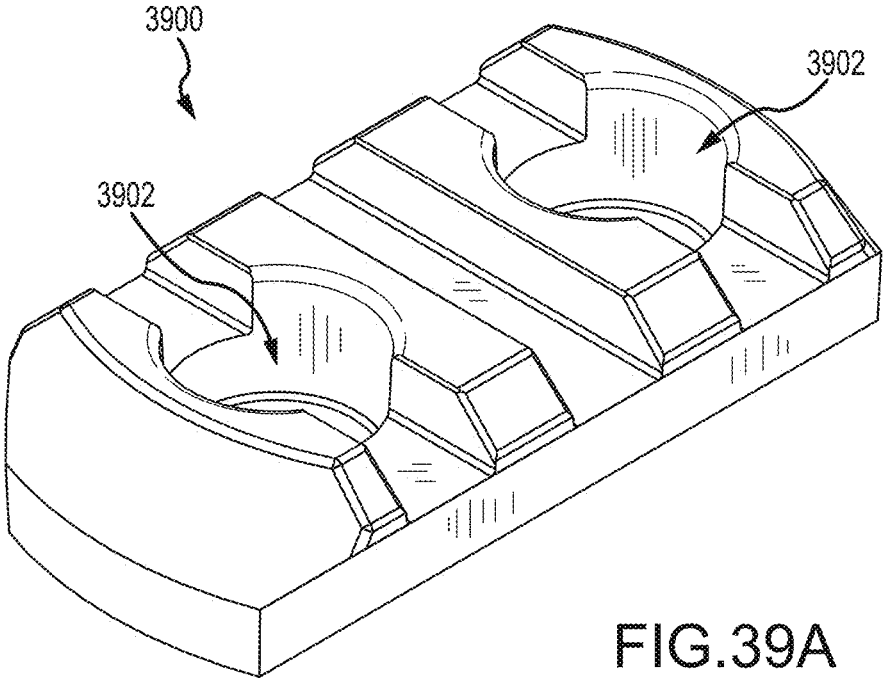
FIG. 39A shows a perspective view of a firearm accessory that can be mated to a firearm via the fasteners disclosed herein.
Figure 39B:
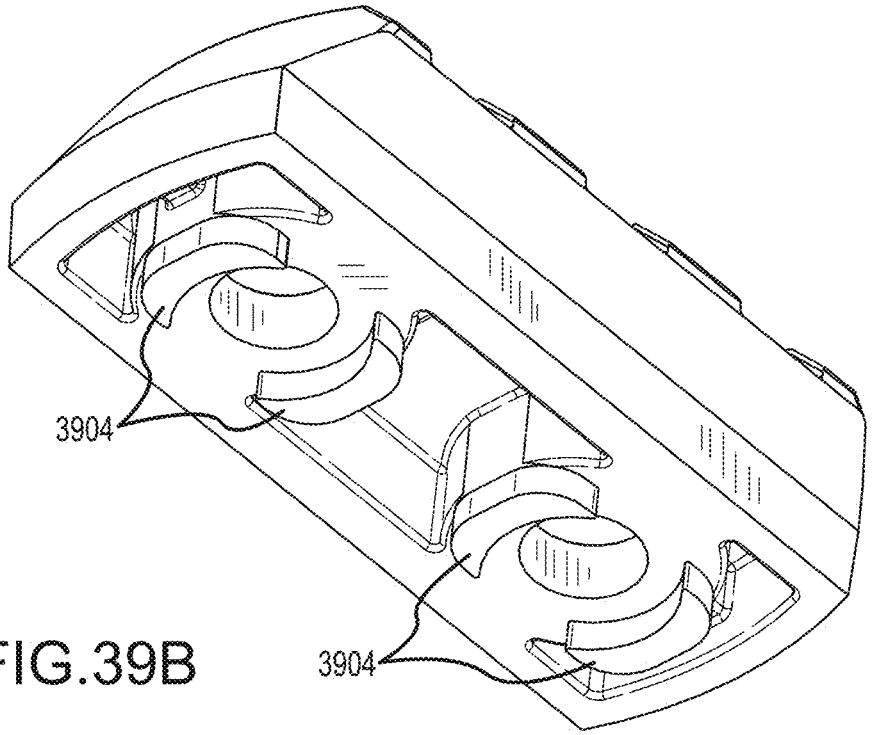
FIG. 39B shows another perspective view of the embodiment illustrated in FIG. 39A.

FIGS. 39A and 39B illustrate perspective views of a firearm accessory that can be coupled to a portion of a firearm using any of the fasteners herein disclosed. The firearm accessory 3900 includes two through holes 3902 each shaped to accept a first fastener (e.g., 804, 805, 904, 905. 2226, 3506, 3506, 3606, 3706). Around a bottom of each through hole 3902 is a pair of slot protrusions 3904. The firearm accessory 3900 is shaped like a Picatinny Rail (or according to the Picatinny Rail specification) and can therefore accept any number of accessories well-known to those of skill in the art. This particular embodiment is a shorter rail section including only a pair of through holes. However, other embodiments can be longer or shorter than the illustrated example.

Figure 40A:
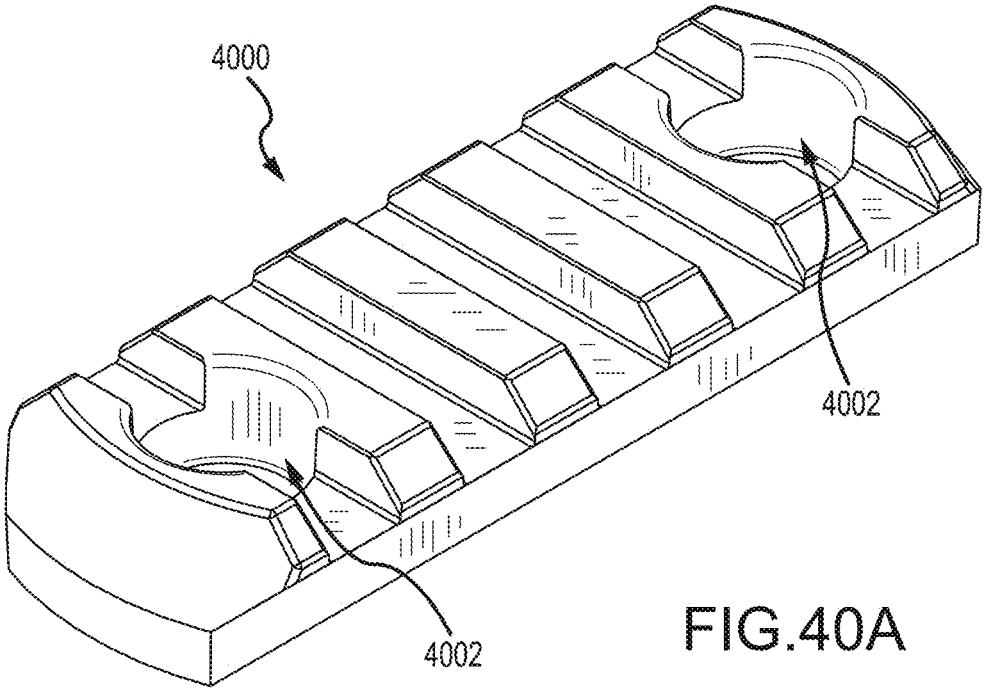
FIG. 40A shows a perspective view of another firearm accessory that can be mated to a firearm via the fasteners disclosed herein.
Figure 40B:
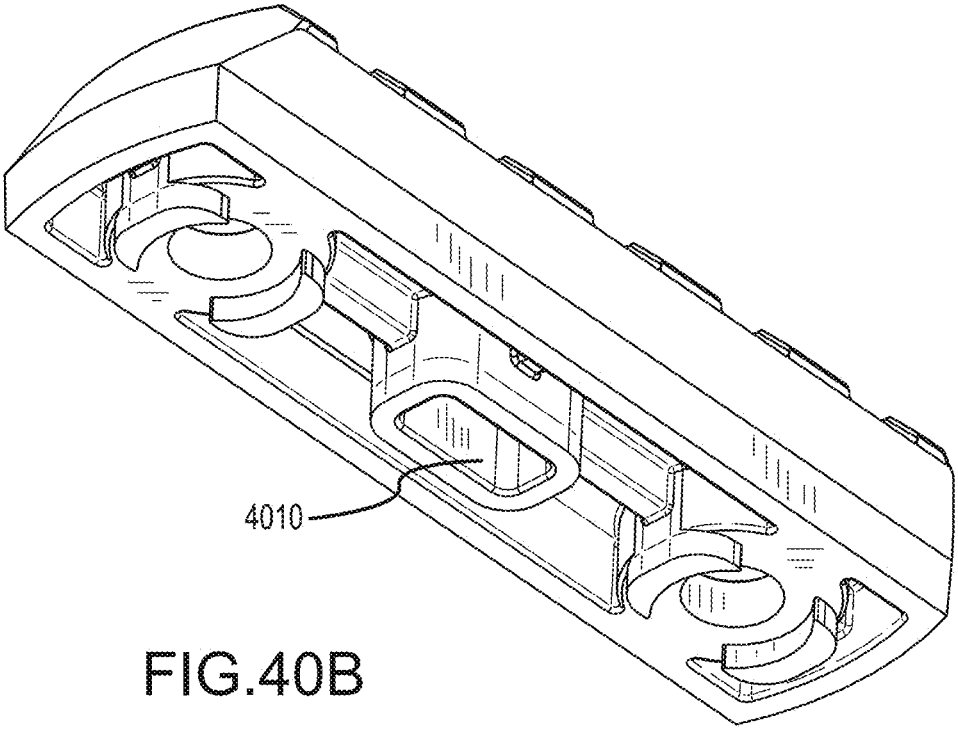
FIG. 40B shows another perspective view of the embodiment illustrated in FIG. 40A.

For instance, FIGS. 40A and 40B illustrate perspective views of another firearm accessory similar to that of FIGS. 39A and 39B, but having a longer longitudinal axis. This firearm accessory 4000 also includes two through holes 4002 and slot protrusions 4004 surrounding a bottom of each through hole 4002. However, with the added length, this firearm accessory 4000 also includes a rectangular slot protrusion 4010 having beveled edges. This slot protrusion 4010 has a similar shape to the slot protrusions 5804 and therefore can fit flush with one or more ends of an elongated slot in a portion of a firearm to add stability and alignment, much like the slot protrusions 822 and 922 accomplish.

Figure 41A:
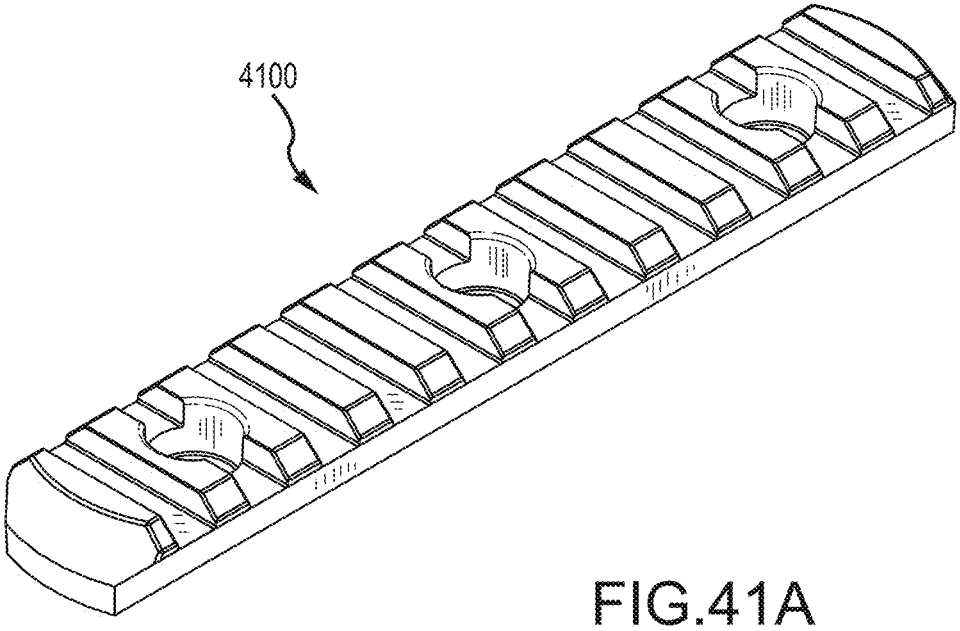
FIG. 41A shows a perspective view of another firearm accessory that can be mated to a firearm via the fasteners disclosed herein.
Figure 41B:
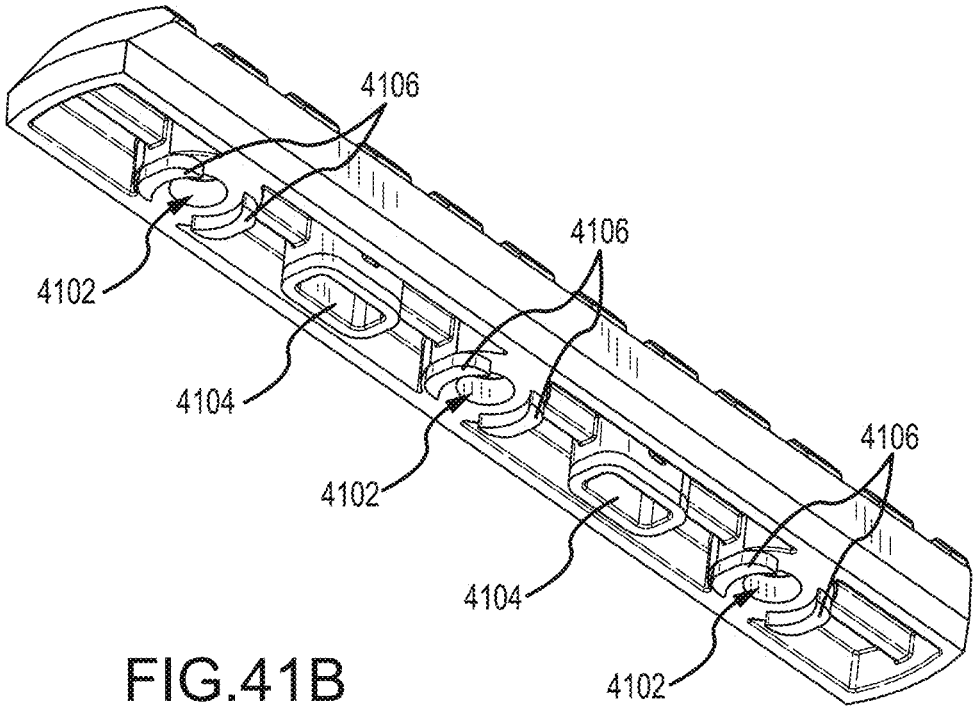
FIG. 41B shows another perspective view of the embodiment illustrated in FIG. 41A.

FIGS. 41A and 41B illustrate perspective views of another firearm accessory similar to that of FIGS. 39A, 39B, 40A, and 40B, but having an even longer longitudinal axis. In particular, one sees that as the longitudinal axis lengthens additional through holes may be added (e.g., the illustrated embodiment has three through holes 4102). Also, additional slot protrusions may be added (e.g., the illustrated embodiment has two rectangular slot protrusions 4104 and one slot protrusion 4106 around each of the three through holes 4102).

Figure 42A:
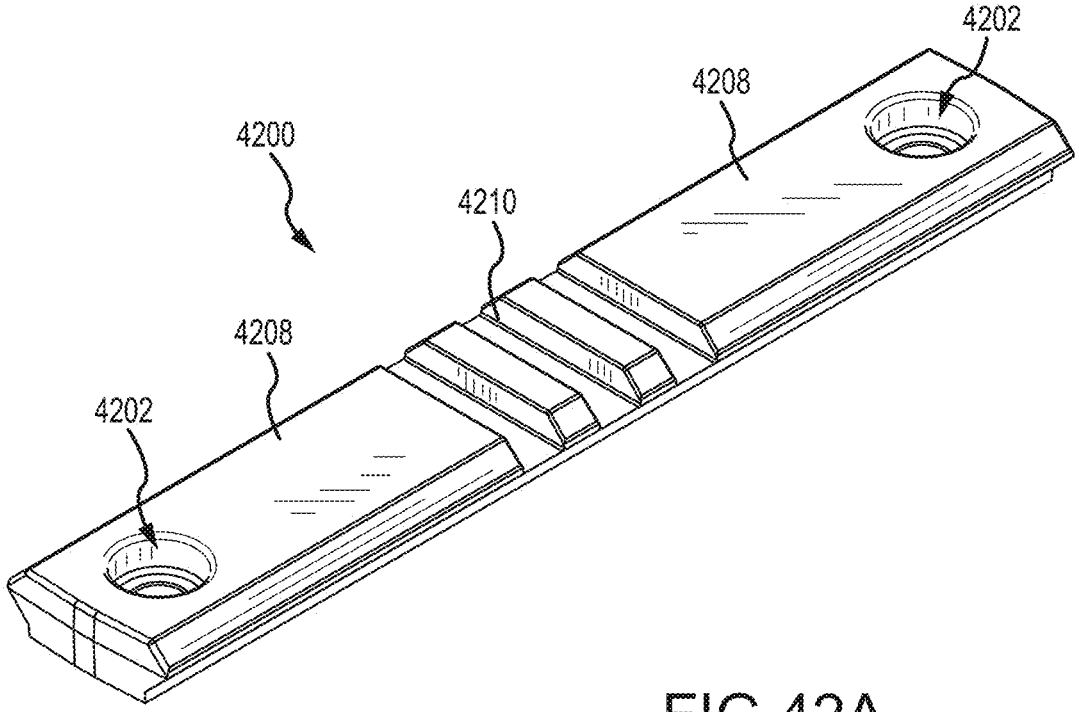
FIG. 42A shows a perspective view of yet another firearm accessory that can be mated to a firearm via the fasteners disclosed herein.
Figure 42B:
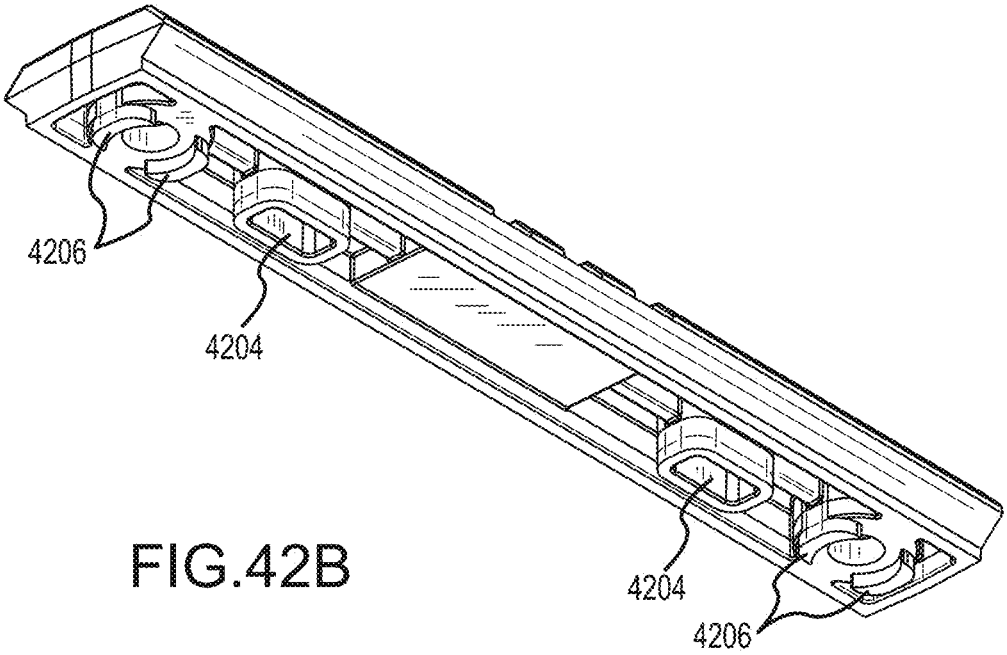
FIG. 42B shows another perspective view of the embodiment illustrated in FIG. 42A.

In some embodiments, the firearm accessory can include a Picatinny rail having flat top portions mixed with a ribbed section. FIGS. 42A and 42B illustrate one such example. The firearm accessory 4200 includes two through holes 4202, two rectangular slot protrusions 4204, and two further slot protrusions 4206 surrounding each of the through holes 4202. Additionally, the firearm accessory 4200 includes two flat portions 4208 on a top surface and a ribbed portion 4210.

Figure 43A:
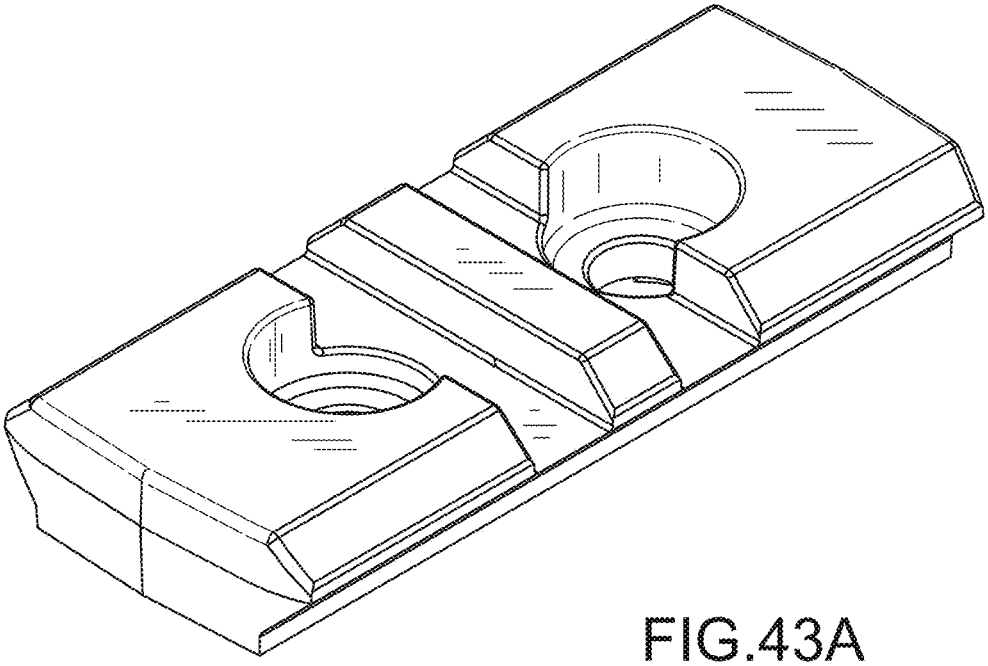
FIG. 43A shows a perspective view of another firearm accessory that can be mated to a firearm via the fasteners disclosed herein.
Figure 43B:
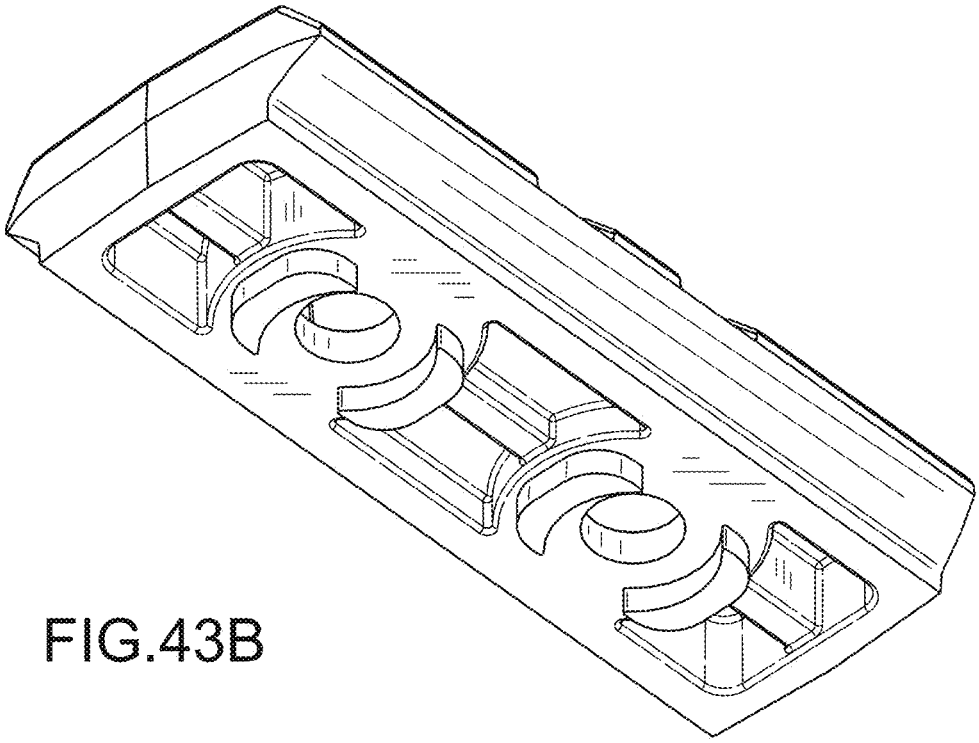
FIG. 43B shows another perspective view of the embodiment illustrated in FIG. 43A.

FIGS. 43A and 43B illustrate a further example of a firearm accessory having a Picatinny rail with both flat and ribbed sections.

Figure 44A:
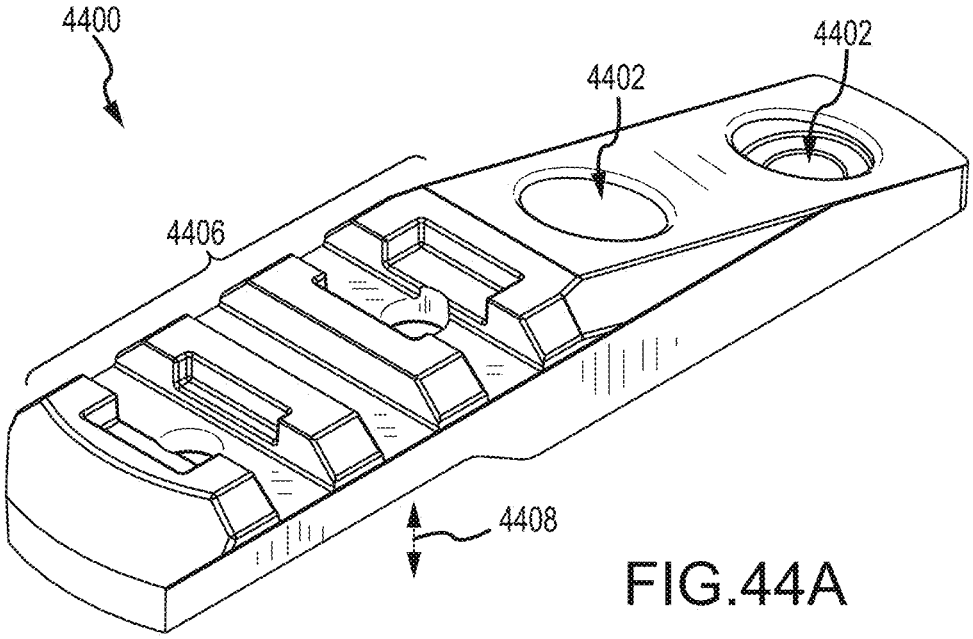
FIG. 44A shows a perspective view of another firearm accessory that can be mated to a firearm via the fasteners disclosed herein.
Figure 44B:
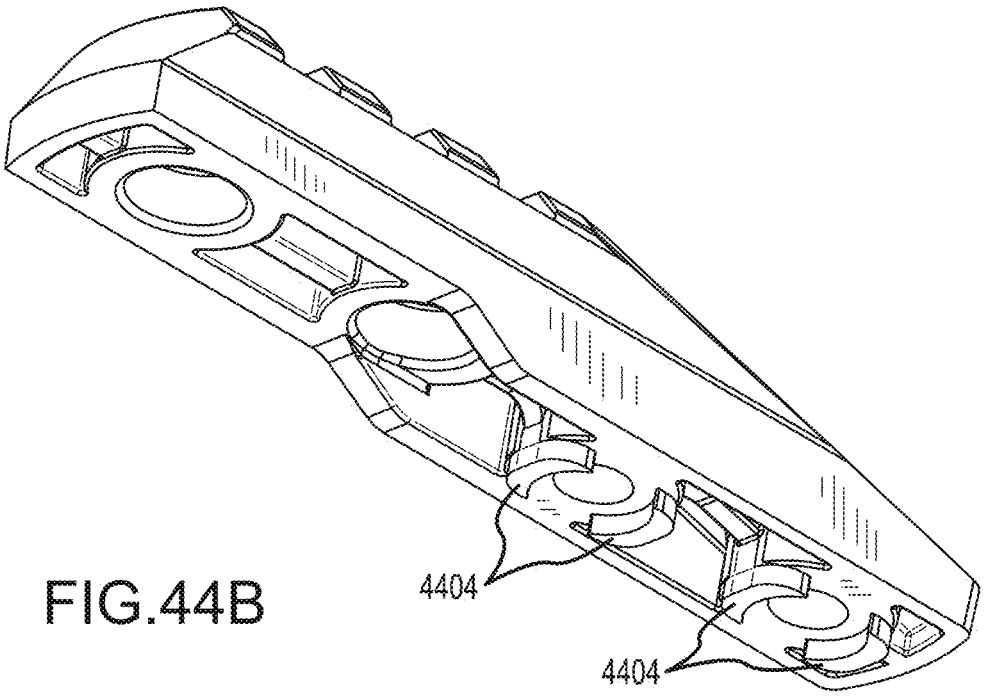
FIG. 44B shows another perspective view of the embodiment illustrated in FIG. 44A.

FIGS. 44A and 44B illustrate an embodiment of a cantilevered Picatinny rail firearm accessory that can be mounted to a firearm using the first and second fasteners discussed earlier in this application. The firearm accessory 4400 includes two through holes 4402 along with slot protrusions 4404 around each of the through holes 4402. A first fastener can be passed through each of these through holes and mated with a second fastener. The combined first and second fasteners can then be passed through an elongated slot of a firearm and tightened in order to cinch the firearm accessory 4400 against the firearm. When fixed to a firearm in this manner, the Picatinny rail portion 4406 of the firearm accessory 4400 includes a gap 4408 between the firearm and a bottom of the rail portion 4406.

Figure 45A:
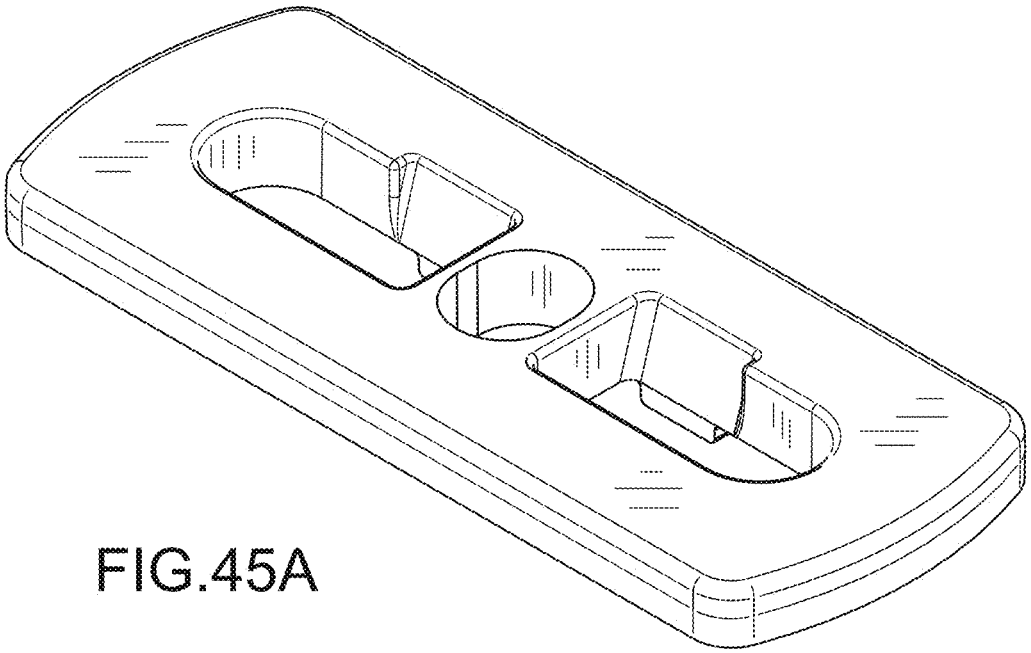
FIG. 45A shows a perspective view of another firearm accessory that can be mated to a firearm via the fasteners disclosed herein.
Figure 45B:
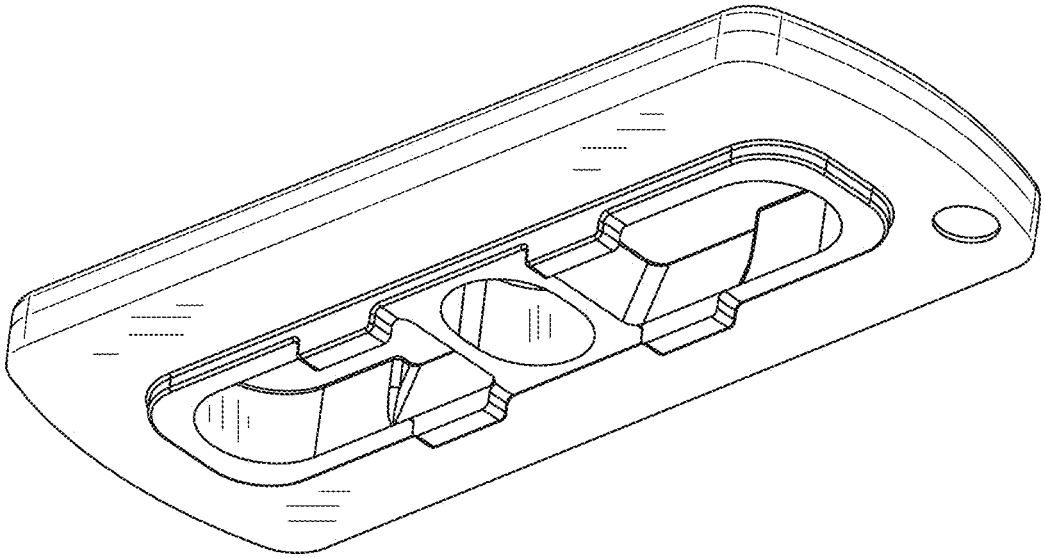
FIG. 45B shows another perspective view of the embodiment illustrated in FIG. 45A.

In some embodiments, there may be a desire to adapt the interface of this disclosure with other accessory interfaces, such as the MOE slots used on many accessories manufactured by MAGPUL INDUSTRIES, Boulder, CO. FIGS. 45A and 45B illustrate perspective views of one adapter that can fit an elongated slot sized to interface with the accessories and fasteners herein disclosed, and can further interface with accessories that fit a smaller elongated slot (such as the MOE slot). To do this, the illustrated adapter includes four elongated nubs on a bottom of the adapter that are spread from each other a width of an elongated slot as herein disclosed. The two slots that pass through the adapter are of a smaller width and can accept accessories and fasteners designed to fit this smaller slot width. In this way, the illustrated adapter fits between a first elongated slot having a first width and an accessory shaped to interface with a second, but not present, elongated slot, having a second width less than the first width. While the illustrated variation includes two slots, an ovular slot, and specific proportions, these can all be varied without departing from the scope of this disclosure. For instance, a single smaller slot can be used, or three or more smaller slots. Further, more or less than the single ovular slot can be used. Also, the existence of the four numbs, their size, their shape, and their proportions, can all be varied. Furthermore, the adapter has a substantially rectangular shape with slightly curved ends. This too can be varied. For instance, the adapter can have an ovular shape when viewed from above, or can be completely rectangular without any curved edges. Typically the fastener has larger horizontal dimensions than a vertical dimension, as illustrated.

Figure 47A:
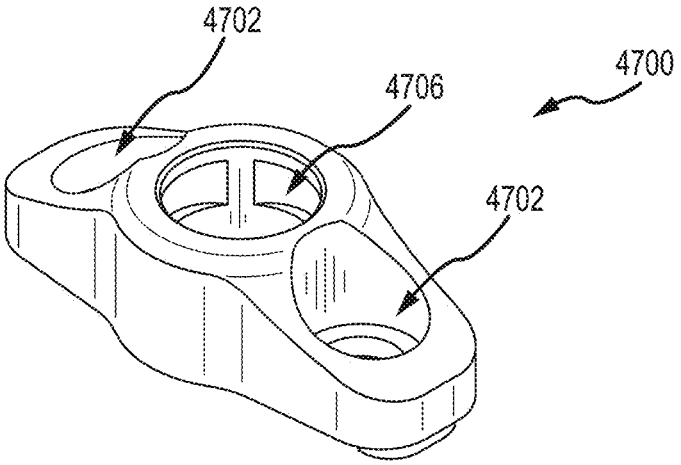
FIG. 47A shows a perspective view of another firearm accessory that can be mated to a firearm via the fasteners disclosed herein.
Figure 47B:
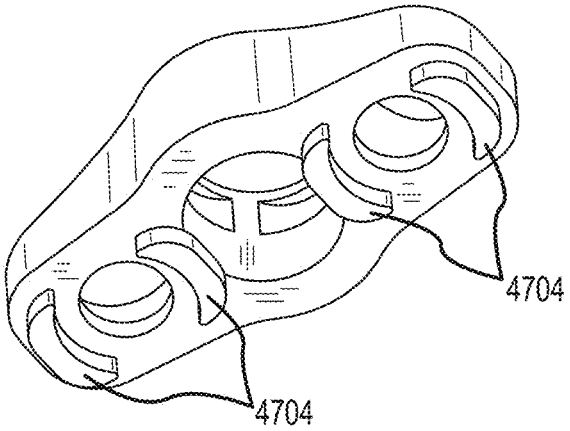
FIG. 47B shows another perspective view of the embodiment illustrated in FIG. 47A.

The firearm accessory interface herein disclosed can also be applied to quick detach interfaces. For instance, FIGS. 47A and 47B show perspective views of a female portion of a quick detach (or QD) interface that can be mounted to a firearm via two of the interfaces herein disclosed. In particular, the firearm accessory 4700 includes two through holes 4702 each configured to accept a first fastener, and when mated to a second fastener, the combined first and second fasteners can be tightened thereby squeezing the firearm accessory 4700 against the firearm. Slot protrusions 4704 are shown surrounding a bottom of each of the through holes 4702. A female QD interface 4706 is arranged between the two through holes 4702. Other arrangements of these through holes to the QD interface can also be implemented without departing from the spirit of this disclosure.

Figure 48:
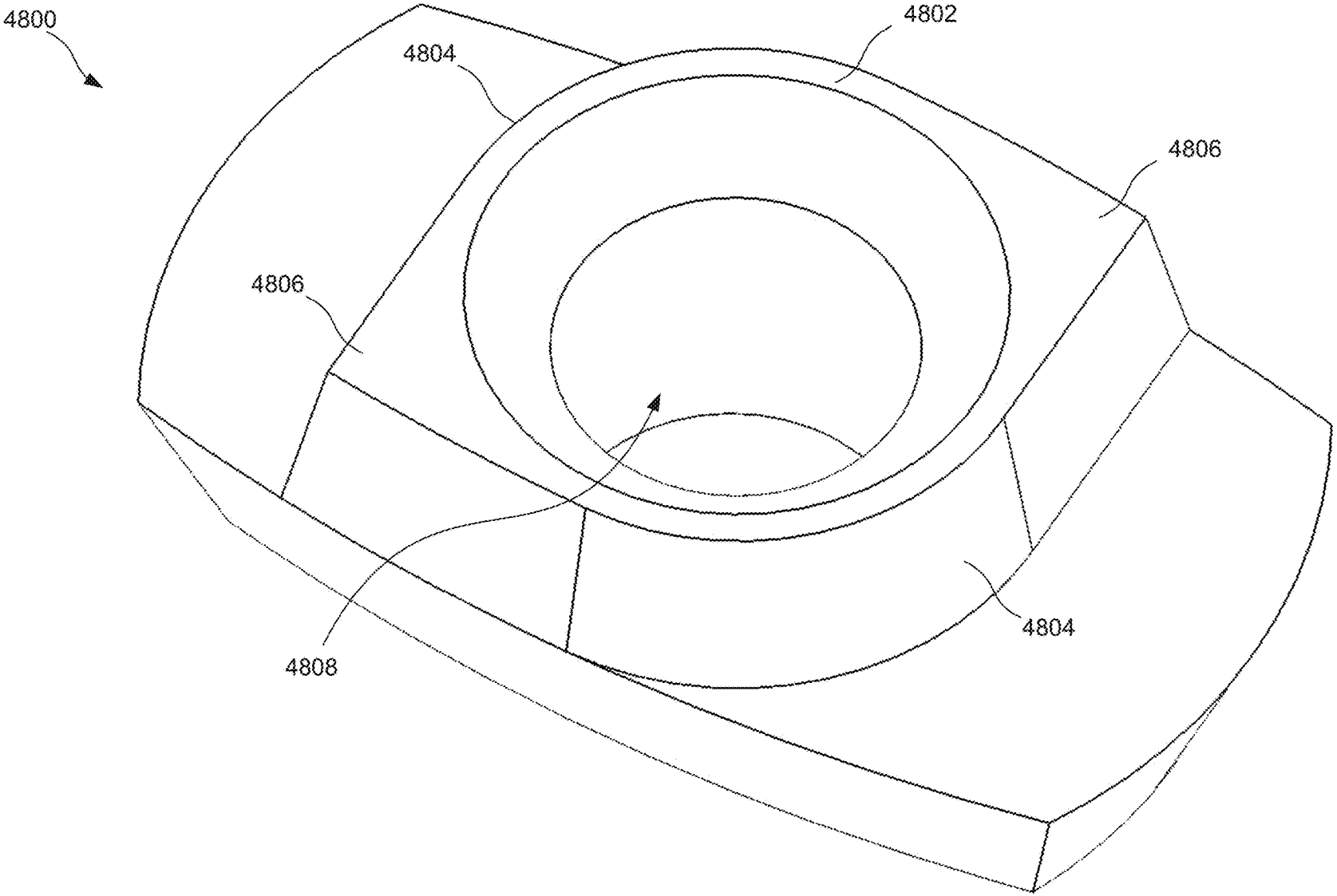
FIG. 48 shows a perspective view of one embodiment of the second fastener.

FIG. 48 shows a perspective view of one embodiment of the second fastener. Unlike previously-discussed variations of the second fastener, this one does not include a straight edge on the upper locking portion 4802. Instead there are two curved portions 4804 separated by two protrusions 4806, where the protrusions 4806 extend beyond a radius of the curved portions 4804, where a radius of the curved portions 4804 is equal to or less than half a width of an elongated slot through which the second fastener 4800 is designed to pass at least partially through. The protrusions 4806 include two edges that join at an angle. At least one of the two edges of each protrusion 4806 can be slightly arced while the other can be straight, although this is not required. These edges meet the curved portions 4804 tangentially, although an angled meeting line can also be implemented.

The second fastener 4800 includes a through hole 4808 configured to receive an end of a first fastener, and can be threaded in order to rotatably mate with the first fastener. The protrusions 4806, or at least one of them, are spaced from a center of the through hole 4808 by a distance that is greater than half a width of the elongated slot through which the second fastener 4800 is configured to pass at least partially through. This spacing can be measured from a center of the through hole 4808 to the corner where the edges of the protrusions 4806 meet at an angle. Alternatively, a distance from any exterior edge of the protrusions 4806 to the center of the through hole 4808 is larger than half a width of the elongated slot.

The result of such a shape is that the second fastener 4800 can only rotate between 45°-135° between an open and a closed position. Where only a single protrusion 4806 is used, the second fastener 4800 will be limited to rotation of less than 360° between an open and a closed position.

This embodiment shows that straight edges on sides of the upper locking portion are not required in order to achieve the effect of precluding the second fastener 4800 from rotating past a closed position. This example shows that the straight edges seen in various embodiments in this application can be replaced with other features referred to as a rotational stop and can include any straight, curved, slightly arced, or other feature that interferes with an inside of the elongated slot when the second fastener rotates so as to prevent the second fastener from rotating past a closed position.

Figure 49:
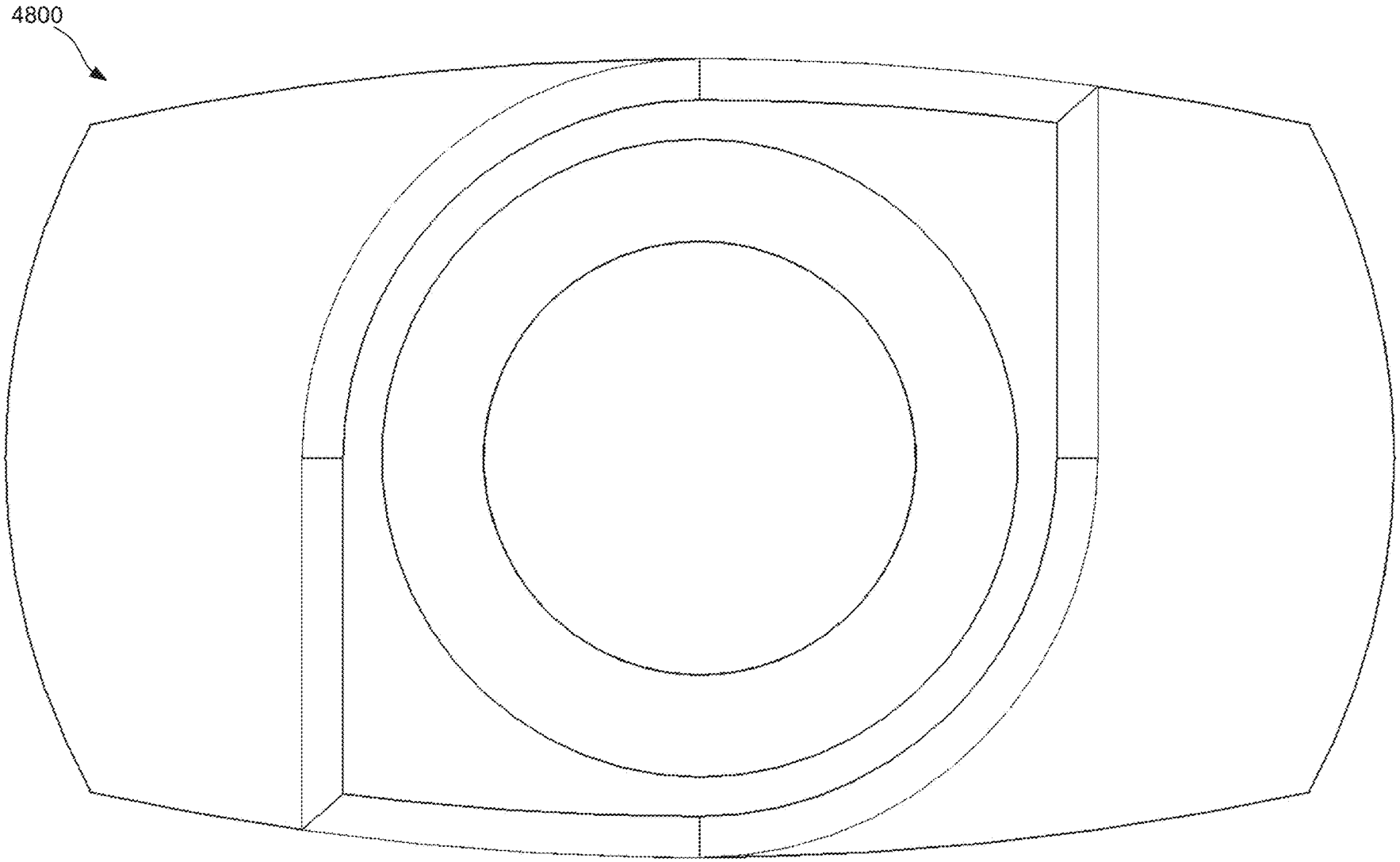
FIG. 49 shows a top view of the embodiment of the second fastener shown in FIG. 48.
Figure 50:
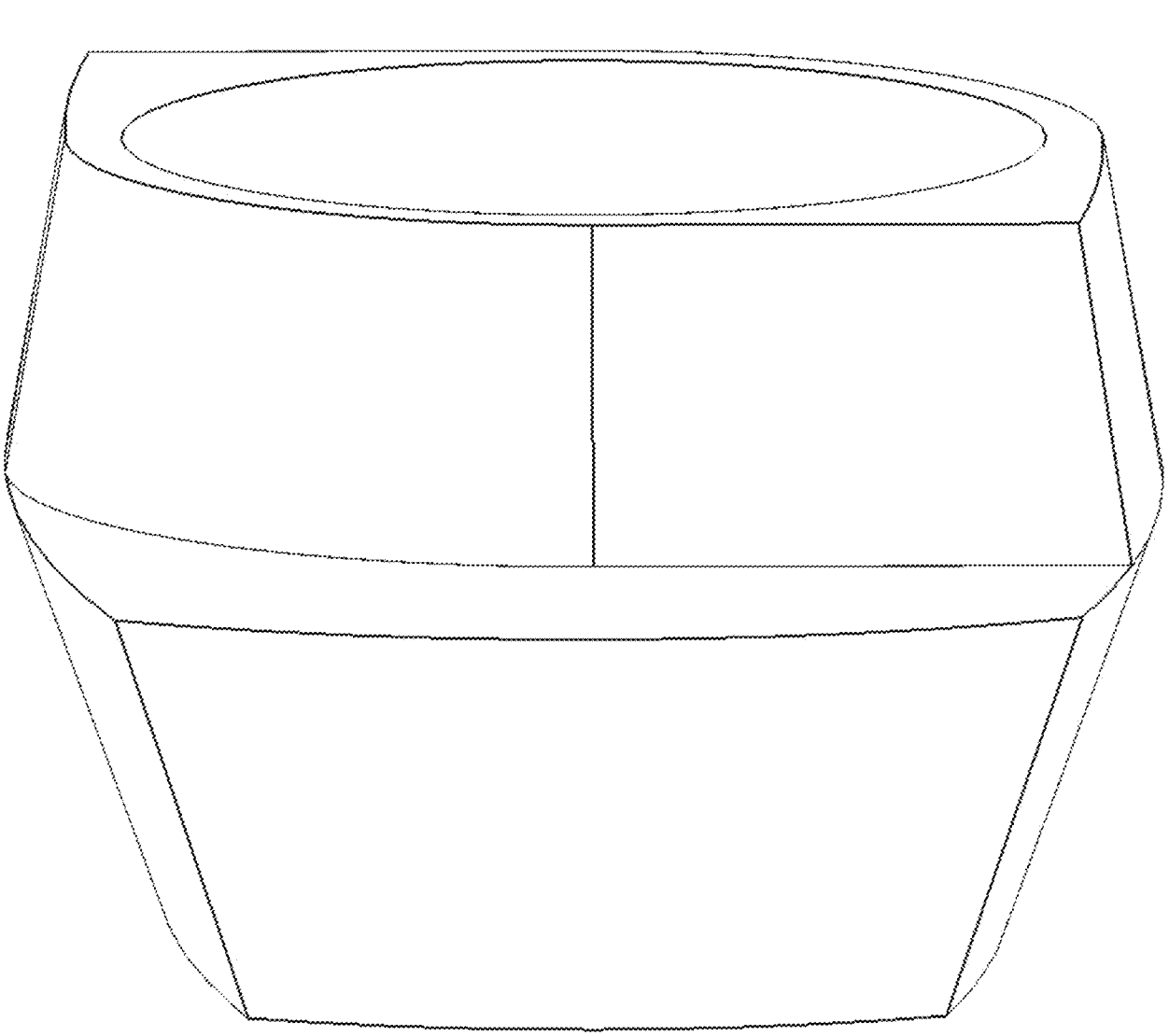
FIG. 50 shows a front perspective view of the embodiment of the second fastener shown in FIG. 48.
Figure 51:
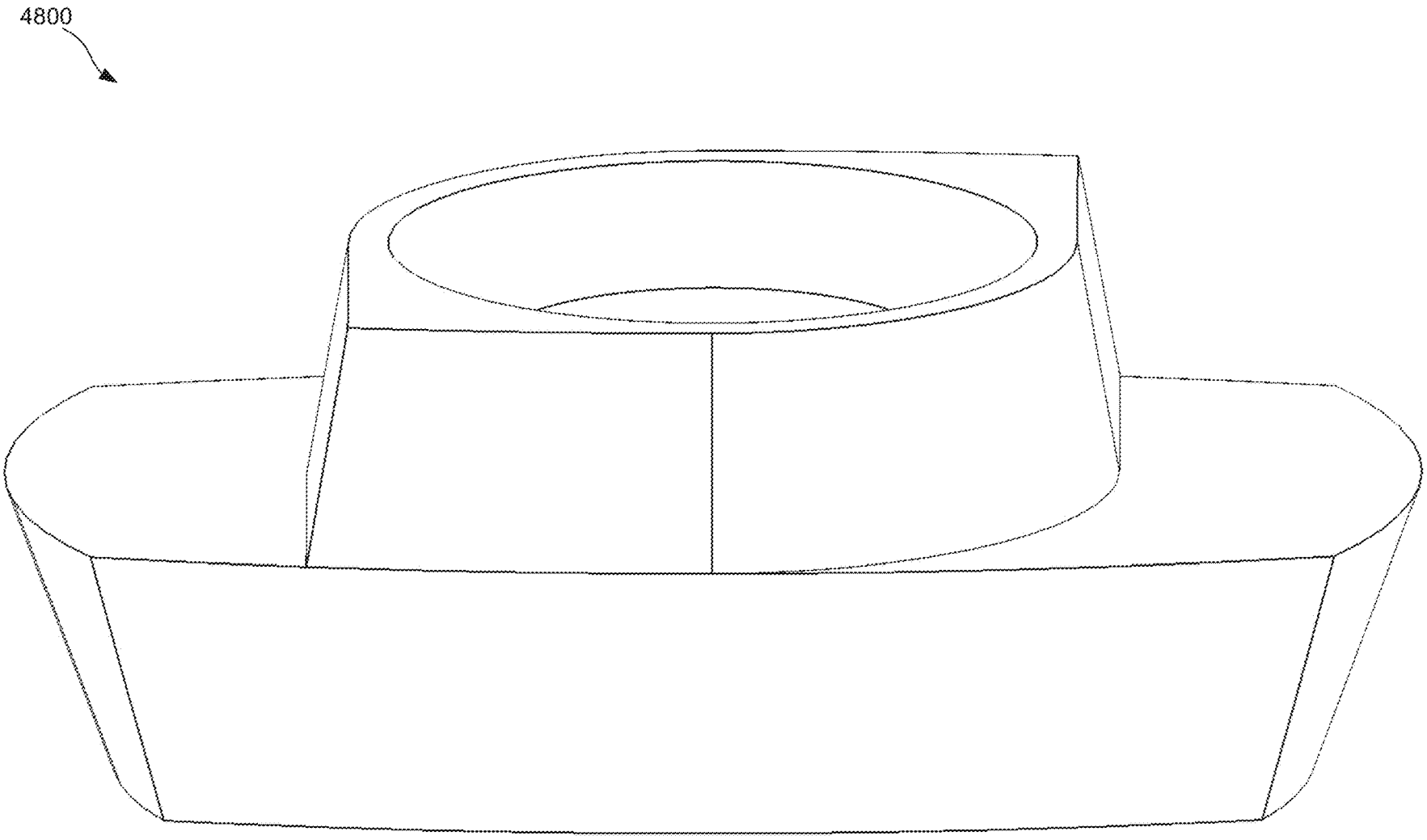
FIG. 51 shows a side perspective view of the embodiment of the second fastener shown in FIG. 48.

FIGS. 49-51 show a top view, front perspective view, and a side perspective view of the second fastener 4800 of FIG. 48.

Figure 52:
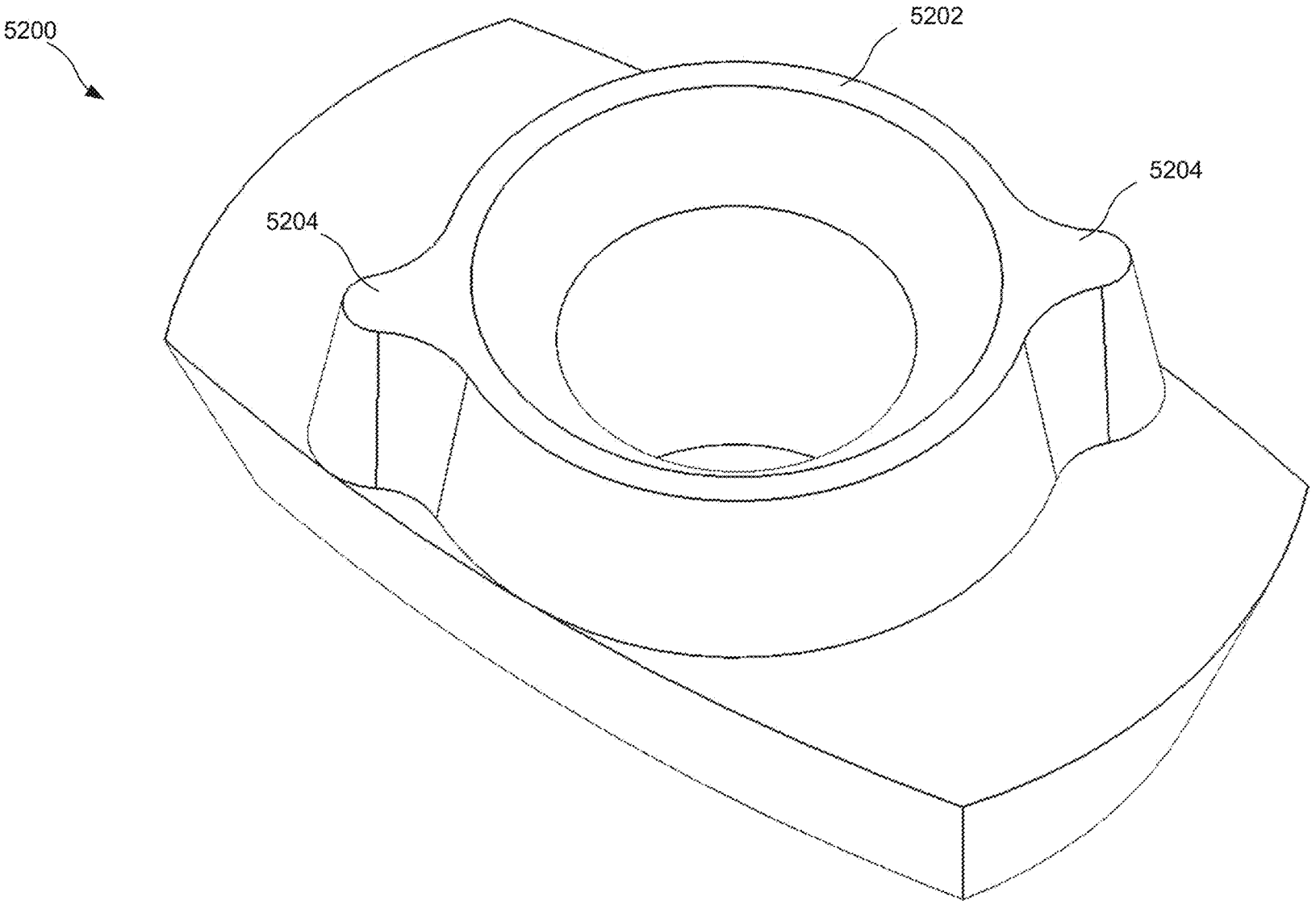
FIG. 52 shows a perspective view of another embodiment of the second fastener.

FIG. 52 shows a perspective view of another variation of the second fastener. This variation further shows that the straight edges of the upper locking portion discussed in earlier variations, can be replaced with other than straight edges. For instance, here the upper locking portion 5202 includes a mostly circular shape when viewed from above, along with two protrusions 5204 having curved shapes such that no straight edges exist on the upper locking portion 5202 when viewed from above. Said another way, the upper locking portion 5202 includes two curved protrusions 5204, although only one can be used in certain implementations. When rotated, the one or more protrusions 5204 will eventually interfere with an inside edge of an elongated slot of a firearm and prevent further rotation of the second fastener 5200.

Figure 53:
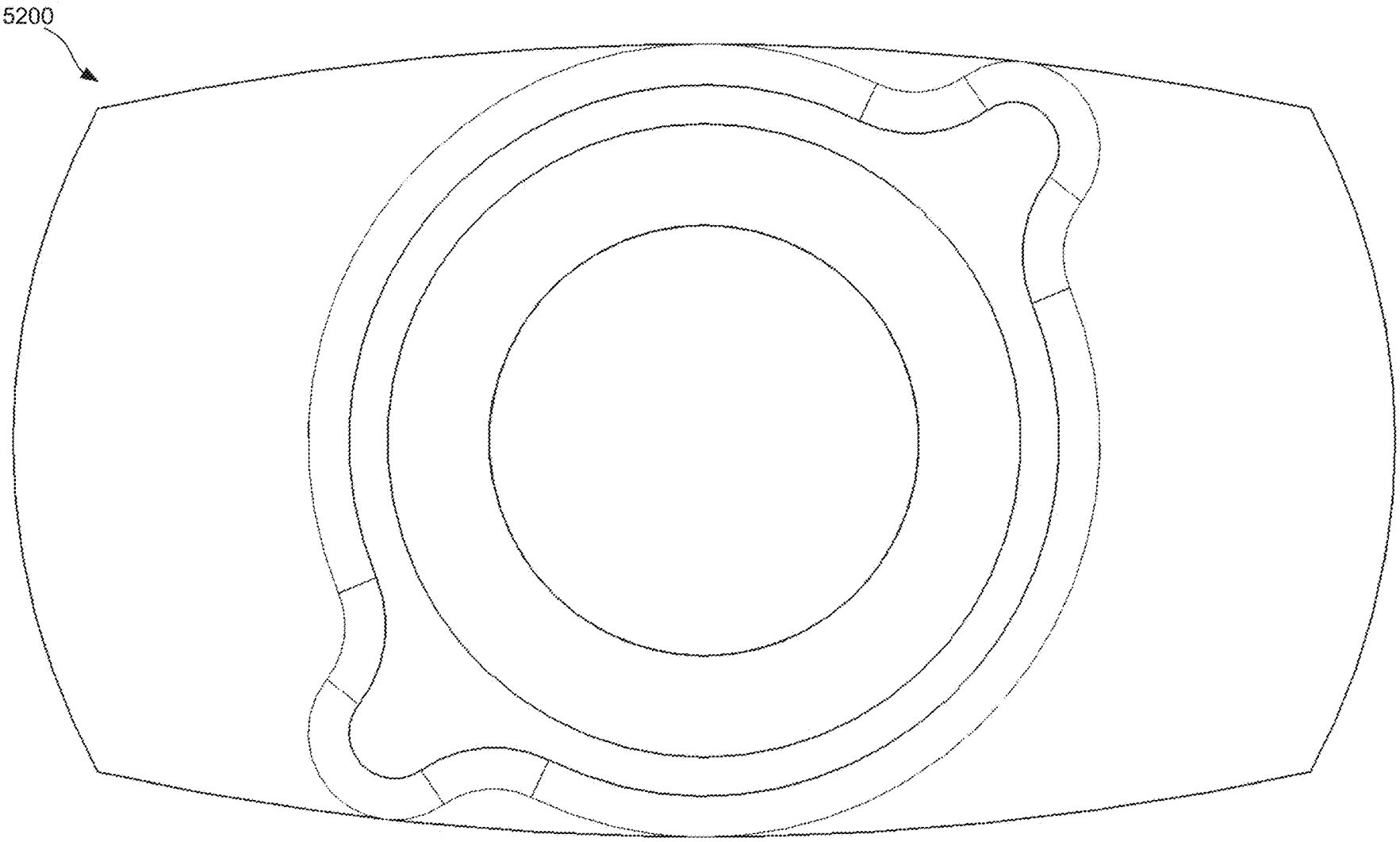
FIG. 53 shows a top view of the embodiment of the second fastener shown in FIG. 52.
Figure 54:
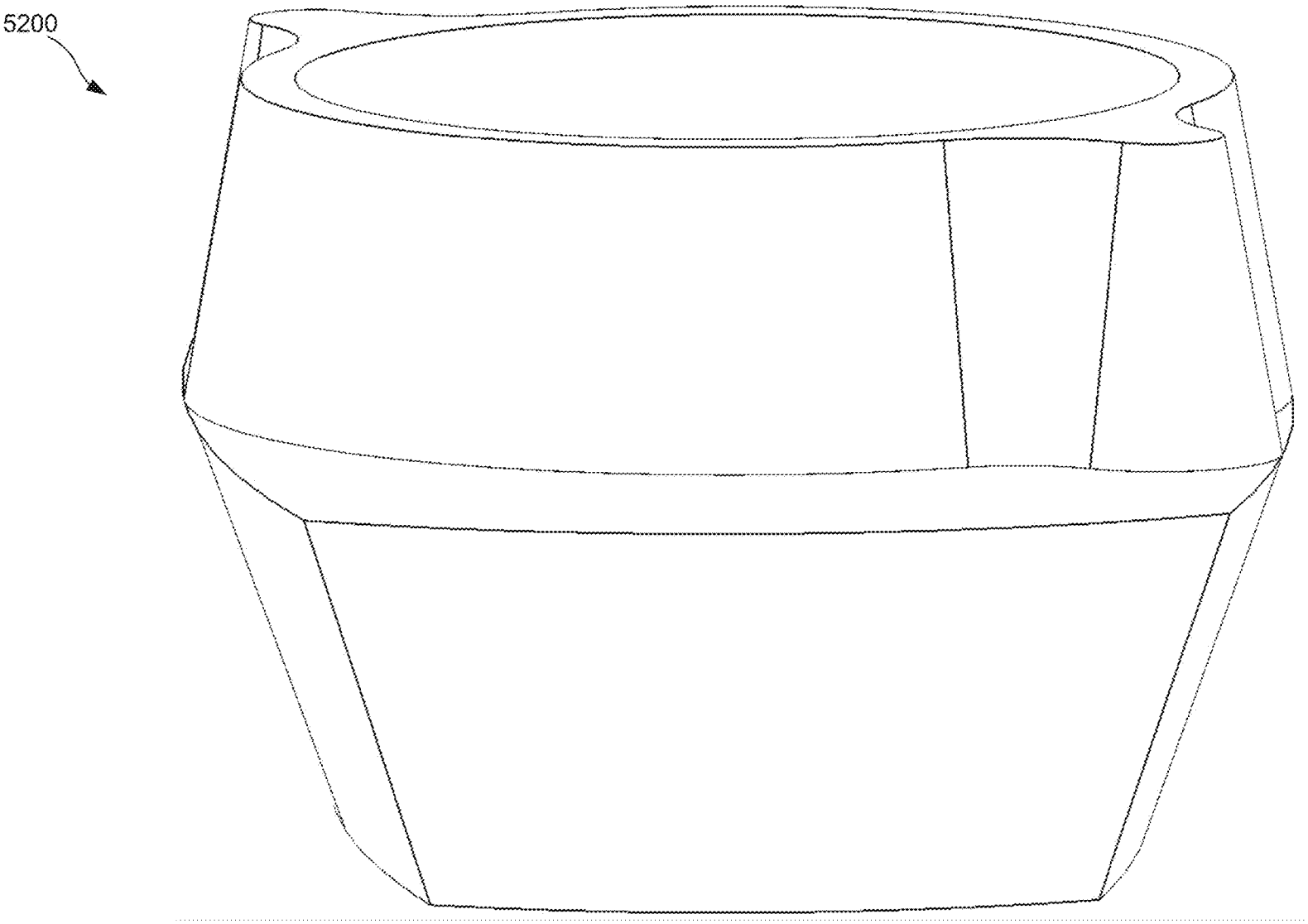
FIG. 54 shows a front perspective view of the embodiment of the second fastener shown in FIG. 52.
Figure 55:
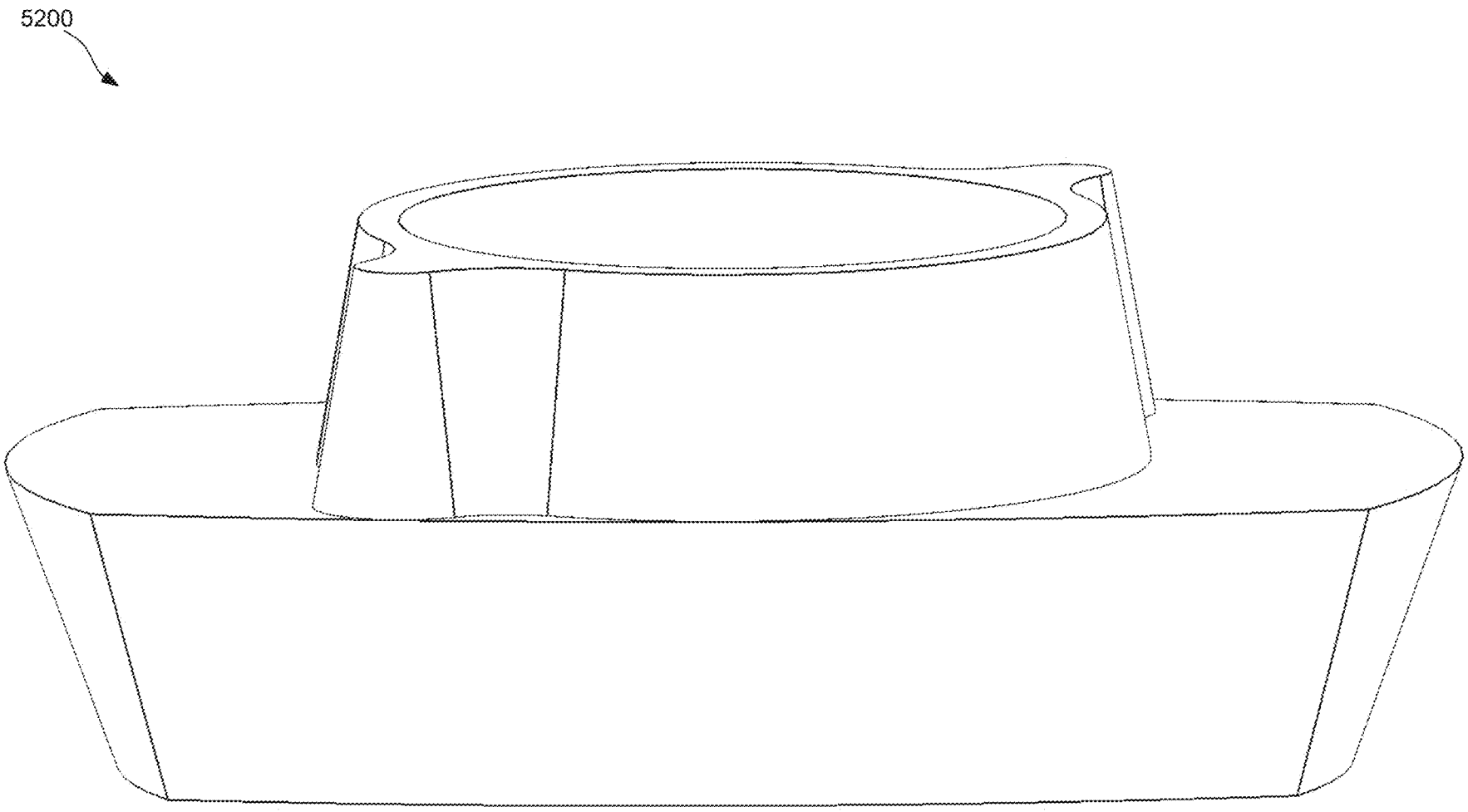
FIG. 55 shows a side perspective view of the embodiment of the second fastener shown in FIG. 52.

FIGS. 53-55 show a top view, a front perspective view, and a side perspective view of the variation of FIG. 52.

Figure 56:
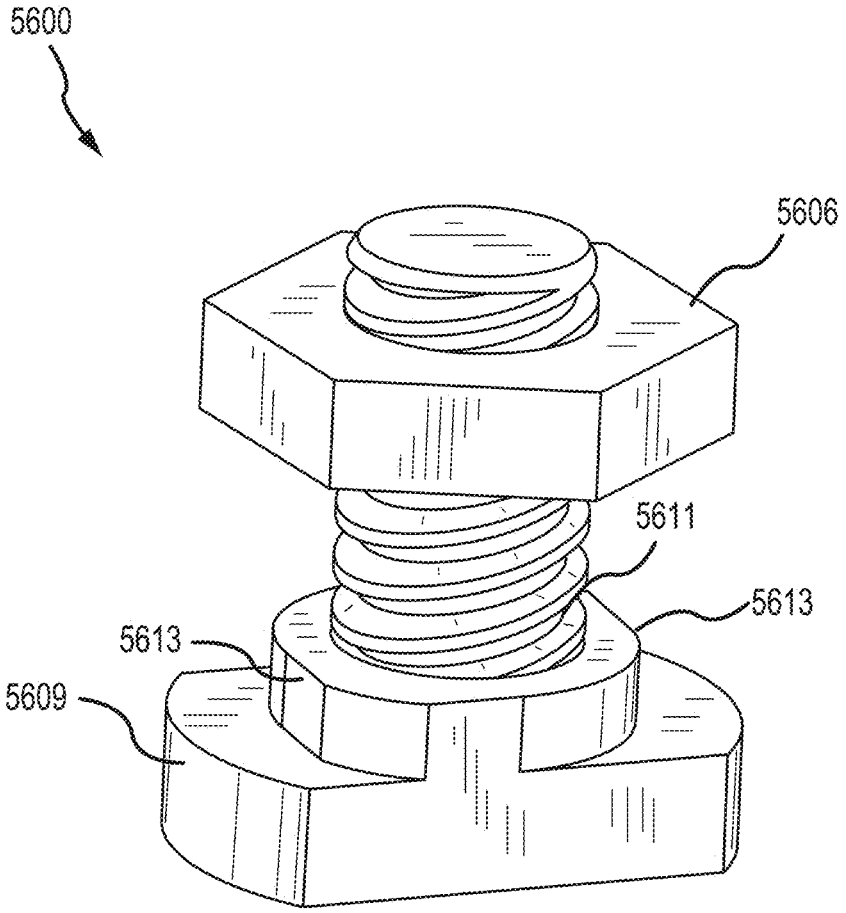
FIG. 56 shows a perspective view of another embodiment of a firearm accessory mounting interface.

Turning now to FIG. 56, another aspect of an interface 5600 is now discussed. As illustrated in FIG. 56, the interface 5600 may have a first fastener 5606 and a second fastener 5609 wherein the first fastener 5606 is a nut or female fastener that can be rotated about the second fastener 5609. The second fastener 5609 may include other features previously described with reference to FIGS. 1-55, as well as an elongated portion 5611 that extends through the wall of the firearm and the firearm accessory to rotatingly mate with the first fastener 5606. That is, the second fastener 5609 may be elongated, while the first fastener 5606 is not. It should be understood that any means of rotatingly mating the first fastener 5606 and the second fastener 5609 are contemplated.

As in other embodiments previously described, the second fastener 5609 may have at least two straight edges 5613, which may be parallel to each other. The second fastener 5609 can pass through the elongated slot when the longitudinal axis of the second fastener 5609 is arranged parallel to a longitudinal axis of the elongated slot, but cannot pass through the elongated slot when the longitudinal axis of the second fastener is arranged obliquely to the longitudinal axis of the elongated slot. At least one of the straight edges 5613 may prevent the second fastener 5609 from rotating beyond a closed position when a portion of the second fastener 5609 has passed through and at least partially cleared the elongated slot.

While this disclosure has been described primarily relative to a first elongated fastener and a second fastener, in other embodiments, various alternative complementary fasteners can be implemented. For instance, cammed fasteners (e.g., threaded fasteners) can be used.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An accessory mounting system for a firearm comprising:

a mounting surface defining a slot having a first end and a second end;

an accessory comprising a first protrusion and a second protrusion, the accessory defining a hole extending through the first protrusion;

a first fastener having an elongated body; and a second fastener defining a hole;

wherein:

the elongated body of the first fastener is configured to extend through the hole of the accessory and through the hole of the second fastener;

the elongated body of the first fastener and the second fastener are configured to extend through the slot of the mounting surface and couple the accessory with the mounting surface;

the first protrusion of the accessory is configured to sit within the slot and abut the first end of the slot; and the second protrusion of the accessory is configured to sit within the slot and abut the second end of the slot.

2. The accessory mounting system of claim 1, wherein:

the slot is a first slot;

the mounting surface further defining a second slot;

the hole of the accessory is a first hole;

the accessory further comprising a third protrusion;

the accessory further defining a second hole extending through the third protrusion; and the accessory mounting system further comprising:

a third fastener having an elongated body; and a fourth fastener defining a hole;

wherein:

the elongated body of the third fastener is configured to extend through the second hole of the accessory and through the hole of the fourth fastener;

the elongated body of the third fastener and the fourth fastener are configured to extend through the second slot of the mounting surface; and the third protrusion of the accessory is configured to sit within the second slot and abut an end of the second slot.

3. The accessory mounting system of claim 1, wherein:

the slot is a first slot;

the mounting surface further defining a second slot; and the first slot is spaced greater than or equal to about 18 millimeters and less than or equal to about 24 millimeters from the second slot.

4. The accessory mounting system of claim 3, wherein the mounting surface is a handguard of the firearm.

5. The accessory mounting system of claim 1, wherein:

the slot is a first slot of a plurality of slots defined by the mounting surface; and each slot of the plurality of slots is uniformly spaced apart from each other.

6. The accessory mounting system of claim 1, wherein the slot has an elongated shape.

7. The accessory mounting system of claim 1, wherein:

the accessory is configured to couple with a firearm accessory part; and the firearm accessory part is one of a vertical grip, a sling, a Picatinny rail, a hand stop, a rail cover, an optic, a light, a foregrip, or a bipod.

8. The accessory mounting system of claim 1, wherein the elongated body of the first fastener includes a polymer patch.

9. The accessory mounting system of claim 1, wherein:

the second fastener is configured to transition between a first position and a second position;

the second fastener is configured to extend through the slot of the mounting surface with the second fastener in the first position; and the second fastener is inhibited from retracting back through the slot of the mounting surface with the second fastener in the second position.

10. The accessory mounting system of claim 9, wherein:

with the second fastener in the first position, a longitudinal axis of the second fastener is substantially parallel to a longitudinal axis of the slot of the mounting surface; and with the second fastener in the second position, the longitudinal axis of the second fastener is rotated greater than or equal to about 40 degrees and less than or equal to about 95 degrees from the longitudinal axis of the slot of the mounting surface.

11. The accessory mounting system of claim 1, wherein:

the first fastener comprises a threaded surface, the second fastener comprises a threaded surface, the threaded surface of the second fastener defining the hole of the second fastener; and the threaded surface of the first fastener and the threaded surface of the second fastener are configured to engage.

12. A firearm accessory mounting system comprising:

a mounting surface defining an elongated slot;

a firearm accessory defining a hole and comprising a protrusion;

a first fastener having an elongated body; and a second fastener defining a hole;

wherein:

the elongated body of the first fastener is configured to extend through the hole of the firearm accessory and the hole of the second fastener;

the elongated body of the first fastener and the second fastener are configured to extend through the elongated slot of the mounting surface and couple the firearm accessory with the mounting surface; and the protrusion of the firearm accessory is configured to sit within the elongated slot and abut an end of the elongated slot.

13. The firearm accessory mounting system of claim 12, wherein:

the second fastener is configured to transition between a first position and a second position;

with the second fastener in the first position, a longitudinal axis of the second fastener is substantially parallel to a longitudinal axis of the elongated slot and the second fastener is configured to extend through the elongated slot; and with the second fastener in the second position, the longitudinal axis of the second fastener is rotated greater than or equal to about 40 degrees and less than or equal to about 95 degrees from the longitudinal axis of the elongated slot, and the second fastener is inhibited from extending back through the elongated slot.

14. The firearm accessory mounting system of claim 12, wherein:

the firearm accessory is an adapter configured to couple an accessory to the mounting surface; and the accessory is one of a vertical grip, a sling, a Picatinny rail, a hand stop, a rail cover, an optic, a light, a foregrip, or a bipod.

15. The firearm accessory mounting system of claim 12, wherein:

the protrusion of the firearm accessory is a first protrusion;

the firearm accessory further comprises a second protrusion; and the hole of the firearm accessory extends through the second protrusion.

16. The firearm accessory mounting system of claim 15, wherein:

the end of the elongated slot is a first end;

the elongated slot defining a second end opposite the first end; and the second protrusion of the firearm accessory is configured to sit within the elongated slot and abut the second end of the elongated slot.

17. The firearm accessory mounting system of claim 12, wherein:

the first fastener is an externally helical threaded fastener; and the second fastener is an internally helical threaded fastener configured to engage with the externally helical threaded fastener.

18. The firearm accessory mounting system of claim 12, wherein the first fastener includes a polymer patch.

19. The firearm accessory mounting system of claim 12, wherein a diameter of the hole of the firearm accessory and a diameter of the hole of the first fastener are substantially equal.

20. A method for mounting a firearm accessory to a firearm comprising:

setting an elongated body of a first fastener within a hole defined by a second fastener;

aligning the second fastener with a protrusion of the firearm accessory along a longitudinal axis of the firearm accessory;

positioning the elongated body of the first fastener, the second fastener, and the protrusion within an elongated slot defined by a mounting surface;

abutting the firearm accessory against a face of the mounting surface, wherein the second fastener extends through the elongated slot in response to the abutment; and rotating a head of the first fastener, wherein the elongated body of the first fastener rotates the second fastener greater than or equal to about 40 degrees and less than or equal to about 95 degrees in response to the rotation of the head.

* * * * *